US011565492B2

(12) United States Patent
Graham et al.

(10) Patent No.: US 11,565,492 B2
(45) **Date of Patent: *Jan. 31, 2023**

(54) METHODS FORMING A SHIPPING AND DISPLAY CONTAINER FROM A BLANK ASSEMBLY USING A PRE-FOLD MANDREL SECTION

(71) Applicant: WESTROCK SHARED SERVICES, LLC, Atlanta, GA (US)

(72) Inventors: Thomas D. Graham, Winter Garden, FL (US); Amer Aganovic, Orlando, FL (US); Claudio D'Alesio, Windmere, FL (US)

(73) Assignee: WestRock Shared Services, LLC, Atlanta, GA (US)

( * ) Notice: Subject to any disclaimer, the term of this patent is extended or adjusted under 35 U.S.C. 154(b) by 276 days.

This patent is subject to a terminal disclaimer.

(21) Appl. No.: 17/087,256

(22) Filed: Nov. 2, 2020

(65) Prior Publication Data

US 2021/0046723 A1 Feb. 18, 2021

Related U.S. Application Data

(60) Continuation of application No. 15/861,552, filed on Jan. 3, 2018, now Pat. No. 10,821,698, which is a (Continued)

(51) Int. Cl.
*B31B 50/28* (2017.01)
*B31B 50/60* (2017.01)

(Continued)

(52) U.S. Cl.
CPC ..... *B31B 50/28* (2017.08); *B31B 50/30* (2017.08); *B31B 50/60* (2017.08); *B31B 50/062* (2017.08);

(Continued)

(58) Field of Classification Search
CPC ..... B31B 50/28; B31B 50/60; B31B 50/30; B31B 2100/00; B31B 2120/102

(Continued)

(56) References Cited

U.S. PATENT DOCUMENTS 1,425,549 A 8/1922 Scruby
1,800,816 A 4/1931 Cooley (Continued)

FOREIGN PATENT DOCUMENTS

WO 1997027114 A1 7/1997

OTHER PUBLICATIONS

Manufacturer's Joint | Definition of Manufacturer's Joint by Merriam-Webster. Retrieved from URL https://www.merriam-webster.com/dictionary/manufacturer%27s on Jun. 23, 2020 (Year: 2020).

(Continued)

*Primary Examiner* — Valentin Neacsu
(74) *Attorney, Agent, or Firm* — Rohini K. Garg

(57) ABSTRACT

A method for forming a container from a blank assembly including a tray blank and lid blank includes folding a first portion of the blank assembly about at least a first face of a first mandrel to form a partially formed container, and transferring the partially formed container towards a second mandrel using a transfer assembly that extends through the first face of the first mandrel. The method also includes transferring the partially formed container from the first mandrel to the second mandrel along a pair of guide rails extending between the first mandrel and the second mandrel, wrapping a second portion of the blank assembly about at least a first face of the second mandrel to form the container, wherein the first face of the second mandrel opposes the first face of the first mandrel with respect to a vertical direction, and ejecting the container from the second mandrel.

20 Claims, 50 Drawing Sheets

Related U.S. Application Data division of application No. 14/033,153, filed on Sep. 20, 2013, now Pat. No. 9,878,512, which is a continuation-in-part of application No. 14/020,403, filed on Sep. 6, 2013, now Pat. No. 9,701,087.

(51) Int. Cl.

| | |
|---|---|
| ***B31B 50/30*** | (2017.01) |
| *B31B 50/52* | (2017.01) |
| *B31B 50/62* | (2017.01) |
| *B31B 50/81* | (2017.01) |
| *B31B 100/00* | (2017.01) |
| *B31B 50/07* | (2017.01) |
| *B31B 50/06* | (2017.01) |
| *B31B 120/10* | (2017.01) |

(52) U.S. Cl.
CPC ..... *B31B 50/07* (2017.08); *B31B 50/52* (2017.08); *B31B 50/62* (2017.08); *B31B 50/81* (2017.08); *B31B 2100/00* (2017.08); *B31B 2120/102* (2017.08)

(58) Field of Classification Search
USPC ..... 493/130, 147
See application file for complete search history.

(56) References Cited

U.S. PATENT DOCUMENTS 1,863,260 A 6/1932 Van Buren
1,892,715 A 1/1933 Wellman
2,156,999 A 5/1939 McNeil
RE23,046 E 10/1948 Blanchet
2,565,188 A 8/1951 Welshenbach
2,787,408 A 4/1957 Noble
2,967,655 A 1/1961 Seger
3,032,252 A 5/1962 Hill
3,461,642 A * 8/1969 Langen ..... B65B 43/10 493/131
3,683,755 A 8/1972 Lattke
3,744,702 A 7/1973 Ellison
3,800,677 A * 4/1974 Jones ..... B31B 50/00 493/127
3,829,000 A 8/1974 Ellison
3,844,088 A * 10/1974 McDonough ..... B65B 11/004 493/309
3,944,072 A 3/1976 Budington et al.
3,964,953 A * 6/1976 Mitchard ..... B32B 29/002 493/379
3,985,287 A 10/1976 Stetler
3,986,319 A * 10/1976 Puskarz ..... B65B 11/004 53/228
3,990,210 A 11/1976 McDonough et al.
4,094,124 A 6/1978 Ljungcrantz
4,119,266 A 10/1978 Dempster
4,133,474 A 1/1979 Hall
4,225,078 A 9/1980 Croley
4,242,949 A 1/1981 Auckenthaler
4,260,100 A 4/1981 Hoffman
4,308,023 A 12/1981 Bidegain
4,349,345 A 9/1982 Bodendoerfer
4,360,146 A 11/1982 Koltz
4,361,267 A 11/1982 Wozniacki
4,392,607 A 7/1983 Perkins
4,409,045 A 10/1983 Busse
4,448,008 A 5/1984 Pankratz et al.
4,452,596 A 6/1984 Clauss et al.
4,470,540 A 9/1984 Koltz
4,511,080 A 4/1985 Madsen et al.
4,552,293 A 11/1985 Blagg et al.
4,608,038 A 8/1986 Virta et al.
4,641,777 A 2/1987 Fronduti
4,702,408 A 10/1987 Powlenko
4,706,809 A 11/1987 Halsell
4,828,244 A 5/1989 Sardella
4,843,798 A 7/1989 Focke et al.
4,930,291 A 6/1990 Buisseau
4,932,930 A * 6/1990 Coalier ..... B31B 50/00 493/127
4,984,734 A 1/1991 Zion et al.
5,046,662 A 9/1991 Cowles
5,139,196 A 8/1992 Fry et al.
5,147,271 A * 9/1992 Bacques ..... B65D 5/029 493/143
5,160,307 A 11/1992 Bacques et al.
5,219,089 A 6/1993 Kiolbasa et al.
5,337,916 A 8/1994 Voss
5,350,348 A 9/1994 Guot
5,393,291 A 2/1995 Wingerter
5,400,955 A * 3/1995 Coalier ..... B31B 50/52 229/116
5,437,388 A 8/1995 Bartelt et al.
5,474,203 A 12/1995 Baker
5,593,375 A 1/1997 Franci
5,630,543 A 5/1997 Dugan
5,653,671 A 8/1997 Reuteler
5,656,006 A 8/1997 East et al.
5,704,540 A 1/1998 Coalier et al.
5,735,785 A 4/1998 Lucas et al.
5,752,648 A 5/1998 Quaintance
5,775,576 A 7/1998 Stone
5,827,162 A 10/1998 Rubin et al.
5,867,966 A 2/1999 Mogard
5,876,319 A 3/1999 Holton
5,878,946 A 3/1999 Frerot et al.
5,916,079 A 6/1999 Haring et al.
5,938,108 A 8/1999 Williams et al.
5,941,452 A 8/1999 Williams et al.
5,943,840 A 8/1999 Nilsson et al.
5,980,440 A 11/1999 Mitman et al.
5,992,489 A 11/1999 Busse
6,012,629 A 1/2000 Newcomer
6,015,084 A * 1/2000 Mathieu ..... B65D 5/566 493/94
6,042,527 A 3/2000 Anderson et al.
6,048,421 A 4/2000 White
6,074,331 A 6/2000 Ruggiere et al.
6,106,450 A * 8/2000 Brittain ..... B31B 50/78 493/171
6,202,920 B1 3/2001 Auclair
6,264,034 B1 7/2001 Bacques et al.
6,267,715 B1 7/2001 Sass et al.
6,328,202 B1 12/2001 Giblin
6,358,191 B1 3/2002 Greever
6,371,363 B1 4/2002 Franklin et al.
6,385,950 B1 5/2002 Anderson
6,387,028 B1 5/2002 Nishio et al.
6,446,859 B1 9/2002 Holladay
6,571,539 B2 6/2003 Gendre et al.
6,588,651 B2 7/2003 Quaintance
6,689,034 B2 2/2004 Walsh et al.
6,783,058 B2 8/2004 Quaintance
6,827,678 B1 12/2004 Kümpel
6,932,266 B2 8/2005 Jones et al.
6,935,557 B2 8/2005 Aubry et al.
7,090,115 B2 8/2006 Pierce
7,310,925 B2 12/2007 Monti
7,322,919 B2 1/2008 Malini
7,329,218 B2 2/2008 Kisch
7,338,422 B2 3/2008 Diehr et al.
7,350,670 B2 4/2008 Steeves et al.
7,434,721 B2 10/2008 Feltz
7,509,789 B2 3/2009 Scholtes et al.
7,699,215 B2 4/2010 Spivey
7,717,838 B2 5/2010 Strong et al.
7,731,080 B2 6/2010 Zacher et al.
7,857,743 B2 12/2010 Barner
7,935,041 B2 5/2011 Graham et al.
3,020,361 A1 9/2011 Kobierzycki et al.
8,105,223 B2 1/2012 Graham et al.
8,133,163 B2 3/2012 Strong et al.
8,323,165 B2 * 12/2012 Atoui ..... B31B 50/00 493/391

(56) References Cited

U.S. PATENT DOCUMENTS

| | | | | |
|---|---|---|---|---|
| 8,409,064 | B2 | 4/2013 | Desertot et al. | |
| 8,430,296 | B2 | 4/2013 | Mathieu et al. | |
| 9,701,087 | B2 * | 7/2017 | Graham | B31B 50/282 |
| 9,878,512 | B2 * | 1/2018 | Graham | B31B 50/60 |
| 10,786,964 | B2 * | 9/2020 | Graham | B31B 50/60 |
| 10,821,698 | B2 * | 11/2020 | Graham | B31B 50/60 |
| 2003/0192945 | A1 | 10/2003 | Quaintance | |
| 2004/0005977 | A1 | 1/2004 | Scholtes | |
| 2004/0188504 | A1 | 9/2004 | Pierce | |
| 2005/0067476 | A1 | 3/2005 | Hengami | |
| 2005/0075230 | A1 * | 4/2005 | Moshier | B31B 50/36 493/51 |
| 2005/0079965 | A1 | 4/2005 | Moshier et al. | |
| 2005/0103833 | A1 | 5/2005 | Aubry et al. | |
| 2005/0263573 | A1 | 12/2005 | Goglio | |
| 2005/0284922 | A1 | 12/2005 | Feltz | |
| 2006/0027638 | A1 | 2/2006 | Jones et al. | |
| 2006/0124709 | A1 | 6/2006 | Hengami | |
| 2006/0169755 | A1 | 8/2006 | Spivey | |
| 2006/0180642 | A1 | 8/2006 | Zacher et al. | |
| 2007/0037682 | A1 | 2/2007 | Scholtes et al. | |
| 2007/0142193 | A1 * | 6/2007 | Strong | B65D 5/722 493/175 |
| 2007/0228119 | A1 | 10/2007 | Barner | |
| 2008/0078819 | A1 | 4/2008 | Strong et al. | |
| 2008/0099541 | A1 | 5/2008 | Smith et al. | |
| 2008/0245849 | A1 | 10/2008 | Mathieu et al. | |
| 2009/0170678 | A1 | 7/2009 | Smith et al. | |
| 2009/0277953 | A1 | 11/2009 | Mathieu et al. | |
| 2010/0022373 | A1 | 1/2010 | Lebras | |
| 2010/0044423 | A1 * | 2/2010 | Graham | B65D 5/445 414/222.01 |
| 2010/0264200 | A1 | 10/2010 | Jacomelli et al. | |
| 2011/0053746 | A1 | 3/2011 | Desertot et al. | |
| 2011/0098167 | A1 | 4/2011 | Mathieu et al. | |
| 2011/0105290 | A1 | 5/2011 | Graham et al. | |
| 2012/0100976 | A1 | 4/2012 | Graham et al. | |
| 2012/0100977 | A1 | 4/2012 | Graham et al. | |
| 2012/0205428 | A1 | 8/2012 | Strong et al. | |
| 2013/0102447 | A1 | 4/2013 | Strong et al. | |
| 2013/0137563 | A1 | 5/2013 | Mathieu et al. | |
| 2015/0072847 | A1 * | 3/2015 | Graham | B31B 50/28 493/128 |
| 2015/0072848 | A1 * | 3/2015 | Graham | B31B 50/00 493/147 |
| 2018/0126684 | A1 * | 5/2018 | Graham | B31B 50/60 |
| 2018/0141300 | A1 * | 5/2018 | Graham | B31B 50/60 |
| 2021/0046723 | A1 * | 2/2021 | Graham | B31B 50/30 |

OTHER PUBLICATIONS

"Meta® Duo"—video presentation by Westrock published on Youtube.com on Aug. 19, 2019, retrieved from URL https://www.youtube.com/watch?v=wyFUYHIvQql on Jan. 18, 2020 (Year: 2019), (Cited in related U.S. Appl. No. 15/861,552; no longer available).

"Meta® Two-Piece SRP"—video presentation by Westrock published on Youtube.com on Sep. 23, 2015, retrieved from URL https://www.youtube.com/watch?v=7V3jcE7wzNw on Jan. 18, 2020 (Year: 2015), (Cited in related U.S. Appl. No. 15/861,552; no longer available).

* cited by examiner

METHODS FORMING A SHIPPING AND DISPLAY CONTAINER FROM A BLANK ASSEMBLY USING A PRE-FOLD MANDREL SECTION

CROSS REFERENCE TO RELATED APPLICATION

This application is a continuation of U.S. patent application Ser. No. 15/861,552, filed Jan. 3, 2018, which is a divisional of U.S. patent application Ser. No. 14/033,153, filed Sep. 20, 2013, and issued as U.S. Pat. No. 9,878,512 on Jan. 30, 2019, which is a continuation-in-part of U.S. patent application Ser. No. 14/020,403, filed Sep. 6, 2013, and issued as U.S. Pat. No. 9,701,087 on Jul. 11, 2017, each of which is hereby incorporated by reference in its entirety.

BACKGROUND

The embodiments described herein relate generally to a machine for forming a container from sheet material, and more particularly to methods and a machine for forming a shipping and display container from a blank assembly by pre-folding the blank assembly around a pre-fold mandrel section, transporting the blank assembly to a mandrel wrap section, and forming the container at the mandrel wrap section.

Containers fabricated from paperboard and/or corrugated paperboard material are often used to store and transport goods. These containers can include four-sided containers, six-sided containers, eight-sided containers, bulk bins and/or various size corrugated barrels. Such containers are usually formed from blanks of sheet material that are folded along a plurality of preformed fold lines to form an erected corrugated container. In some cases, these containers can be used to ship goods, and then be used to display the goods at a merchant's store or business after the goods have been shipped to the merchant.

At least some known containers are formed using a machine. For example, a blank may be positioned near a mandrel on a machine, and the machine may be configured to wrap the blank around the mandrel to form at least a portion of the container. Because the size and/or shape of blanks and containers can vary widely across industries, it is desirable for such machines to be able to accommodate blanks and/or containers of varying shapes and/or sizes.

At least some known container forming machines use complex devices and mechanisms for forming various sizes and/or shapes of blanks. In order to accommodate various sized and/or shaped blanks, these devices and mechanisms often require moving parts that need to move or rotate along substantially large paths of movement. These large paths of movement require the machine to be large.

Accordingly, it is desirable to have a machine that can form containers where the paths of movement of moving parts are reduced and thus, reduce the overall footprint of the machine.

BRIEF DESCRIPTION

In one aspect, a machine for forming a container from a blank assembly including a tray blank coupled to a lid blank is provided. The tray blank defines a tray portion of the container, and the lid blank defines a lid portion of the container. The machine has an upstream end at which the blank assembly is loaded and a downstream end at which the container is discharged. The machine includes a frame, a mandrel assembly mounted to the frame, a pre-folding assembly, and a glue panel presser assembly. The mandrel assembly includes a first mandrel and a second mandrel positioned downstream from the first mandrel. The first mandrel has an external shape complementary to an internal shape of at least a first portion of the container, and the second mandrel has an external shape complementary to an internal shape of at least a second portion of the container. The pre-folding assembly is configured to fold a first portion of the blank assembly around the first mandrel to form a partially formed container. The first portion of the blank assembly corresponds to the first portion of the container. The glue panel presser assembly includes a first presser plate configured to form a first manufacturer joint along the lid portion of the container, and a second presser plate configured to form a second manufacturer joint along the tray portion of the container.

In another aspect, a method of forming a container from a blank assembly using a machine is provided. The blank assembly includes a tray blank coupled to a lid blank. The tray blank defines a tray portion of the container, and the lid blank defines a lid portion of the container. The machine includes a mandrel assembly having a first mandrel and a second mandrel positioned downstream from the first mandrel. The method includes positioning the blank assembly proximate to the first mandrel, folding a first portion of the blank assembly about the first mandrel to form a partially formed container, transferring the partially formed container from the first mandrel to the second mandrel, wrapping a second portion of the blank assembly about the second mandrel to form the container, and ejecting the container from the second mandrel.

In yet another aspect, a machine for forming a container from a blank assembly including a tray blank coupled to a lid blank is provided. The tray blank defines a tray portion of the container, and the lid blank defines a lid portion of the container. The machine has an upstream end at which the blank assembly is loaded and a downstream end at which the container is discharged. The machine includes a frame, a mandrel assembly mounted to the frame, a pre-folding assembly, and a wrapping assembly. The mandrel assembly includes a first mandrel and a second mandrel positioned downstream from the first mandrel. The first mandrel has an external shape complementary to an internal shape of at least a first portion of the container. The second mandrel has an external shape complementary to an internal shape of at least a second portion of the container. The pre-folding assembly is configured to fold a first portion of the blank assembly around the first mandrel to form a partially formed container. The first portion of the blank assembly corresponds to the first portion of the container. The pre-folding assembly includes folding rods adapted to rotate a plurality of panels from the first portion of the blank assembly around the first mandrel, and at least one tray panel folder configured to fold a panel from the tray blank around the first mandrel. The wrapping assembly is configured to wrap a second portion of the blank assembly around the second mandrel. The second portion of the blank assembly corresponds to the second portion of the container. The wrapping assembly includes a glue panel presser assembly. The glue panel presser assembly includes a first presser plate and a second presser plate. The first presser plate is configured to form a first manufacturer joint along the lid portion of the container. The second presser plate configured to form a second manufacturer joint along the tray portion of the container.

DETAILED DESCRIPTION OF THE DISCLOSURE

Figure 1:
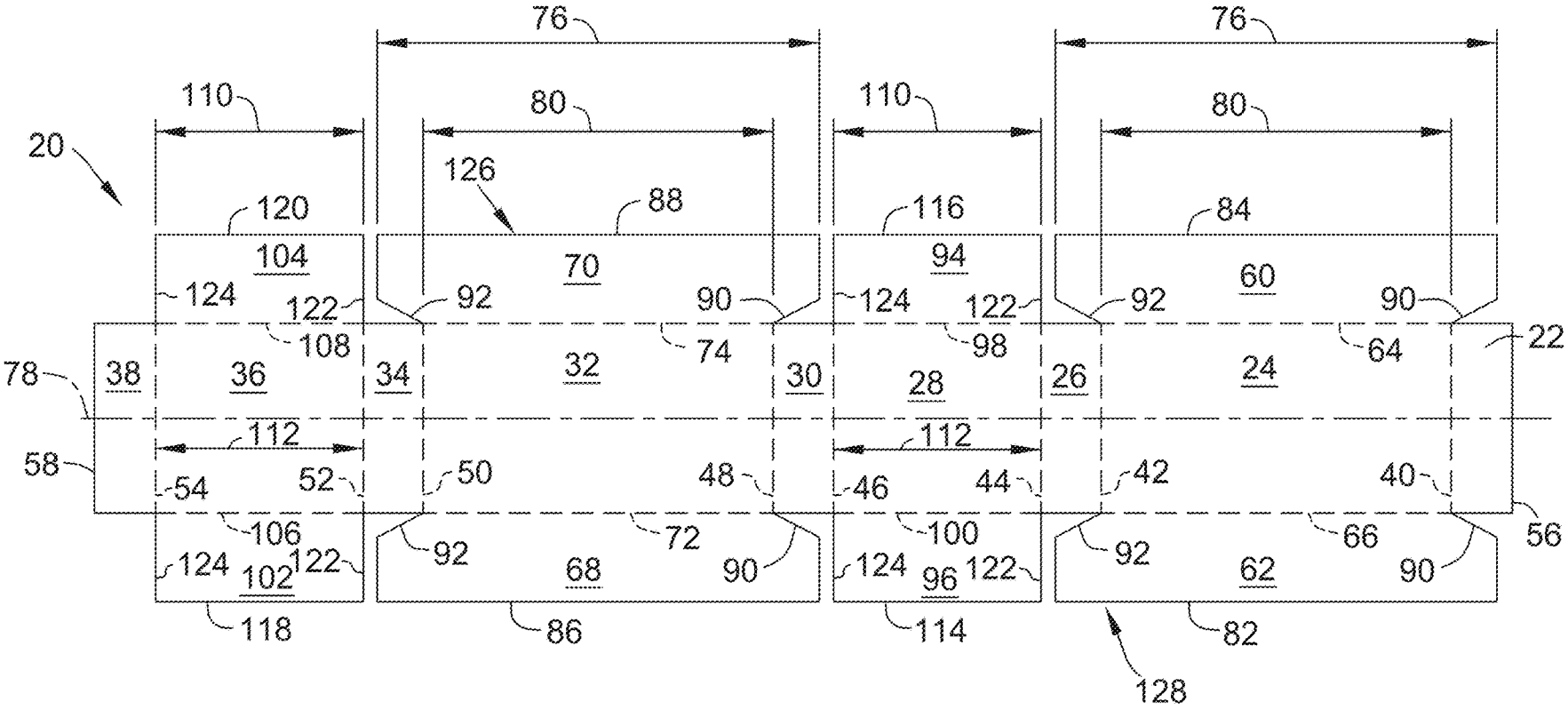
FIG. 1 is an interior view of an example embodiment of a blank of sheet material that may be used with the machine described herein.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

The present disclosure provides a machine for forming a container from a single sheet of material. The container described herein is sometimes referred to as an eight-sided container, but any number of sides of a container could be formed including, but not limited to, a four-sided or a six-sided container. In one embodiment, the container is fabricated from a paperboard material. The container, however, may be fabricated using any suitable material, and therefore is not limited to a specific type of material. In alternative embodiments, the container is fabricated using cardboard, fiberboard, paperboard, foamboard, corrugated paper, and/or any suitable material known to those skilled in the art and guided by the teachings herein provided. The container may have any suitable size, shape, and/or configuration, whether such sizes, shapes, and/or configurations are described and/or illustrated herein. Further, different embodiments described here can vary in size and/or dimensions. The container may also include lines of perforation for removal of a portion of the container for displaying articles for sale.

The present disclosure also provides an alternative embodiment of the machine for forming a container from a blank assembly of sheet material. The blank assembly includes a tray blank and a lid blank that are coupled together to form a container, sometimes referred to as a Retail Ready Package (RRP), that includes a tray portion and a lid portion. The container described herein is sometimes referred to as an eight-sided RRP container, but any number of sides of a container could be formed including, but not limited to, a four-sided or a six-sided container. In one embodiment, the container is fabricated from paperboard material. The container, however, may be fabricated using any suitable material, and therefore is not limited to a specific type of material. In alternative embodiments, the container is fabricated using cardboard, fiberboard, paperboard, foamboard, corrugated paper, and/or any suitable material known to those skilled in the art and guided by the teachings herein provided. The container may have any suitable size, shape, and/or configuration, whether such sizes, shapes, and/or configurations are described and/or illustrated herein. Further, different embodiments described here can vary in size and/or dimensions. The container may also include lines of perforation for removal of a portion of the container for displaying articles for sale.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

Referring now to the drawings, FIG. 1 is an interior view of an example embodiment of a substantially flat blank 20 of sheet material. As shown in FIG. 1, blank 20 includes a series of aligned wall panels and end panels connected together by a plurality of preformed, generally parallel, fold lines. Specifically, the wall panels include a first corner panel 22, a first side panel 24, a second corner panel 26, a first end panel 28, a third corner panel 30, a second side panel 32, a fourth corner panel 34, a second end panel 36, and a glue panel 38 connected in series along a plurality of fold lines 40, 42, 44, 46, 48, 50, 52, and 54. First corner panel 22 extends from a first free edge 56 to fold line 40, first side panel 24 extends from first corner panel 22 along fold line 40, second corner panel 26 extends from first side panel 24 along fold line 42, first end panel 28 extends from second corner panel 26 along fold line 44, third corner panel 30 extends from first end panel 28 along fold line 46, second side panel 32 extends from third corner panel 30 along fold line 48, fourth corner panel 34 extends from second side panel 32 along fold line 50, second end panel 36 extends from fourth corner panel 34 along fold line 52, and glue panel 38 extends from second end panel 36 along fold line 54 to a second free edge 58.

A first top side panel 60 and a first bottom side panel 62 extend from opposing edges of first side panel 24. More specifically, first top side panel 60 and first bottom side panel 62 extend from first side panel 24 along a pair of opposing preformed, generally parallel, fold lines 64 and 66, respectively. Similarly, a second bottom side panel 68 and a second top side panel 70 extend from opposing edges of second side panel 32. More specifically, second bottom side panel 68 and second top side panel 70 extend from second side panel 32 along a pair of opposing preformed, generally parallel, fold lines 72 and 74, respectively. Fold lines 64, 66, 72, and 74 are generally parallel to each other and generally perpendicular to fold lines 40, 42, 48, and 50. First bottom side panel 62 and first top side panel 60 each have a width 76 taken along a central horizontal axis 78 of blank 20 that is greater than a width 80 of first side panel 24, also taken along central horizontal axis 78. Similarly, second bottom side panel 68 and second top side panel 70 each have a width 76 that is greater than width 80 of second side panel 32, taken along central horizontal axis 78.

First bottom side panel 62 and first top side panel 60 each include a free edge 82 or 84, respectively. Similarly, second bottom side panel 68 and second top side panel 70 each include a free edge 86 or 88, respectively. Bottom side panels 62 and 68 and top side panels 60 and 70 each include opposing angled edge portions 90 and 92 that are each obliquely angled with respect to respective fold lines 64, 66, 72, and/or 74. Although other angles may be used without departing from the scope of the present disclosure, in one embodiment, edge portions 90 and 92 are angled at about 45° with respect to respective fold lines 64, 66, 72, and/or 74.

Figure 2:
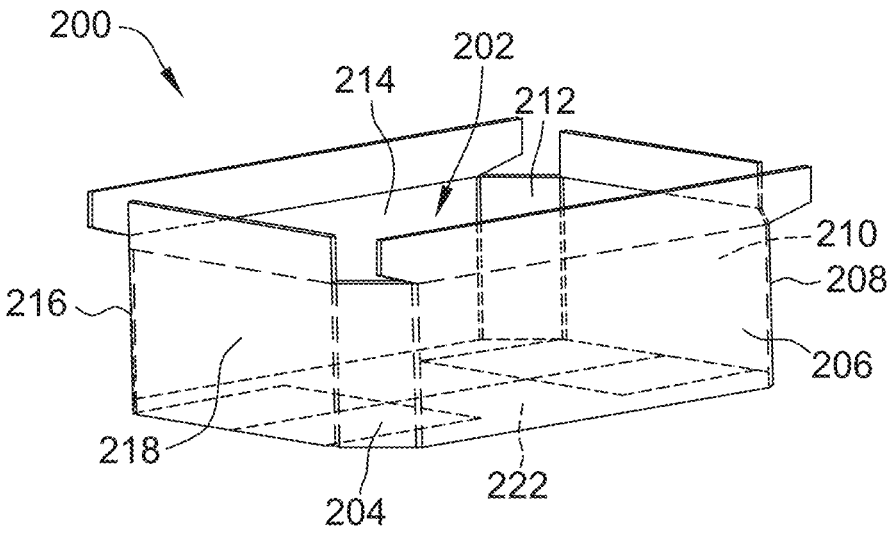
FIG. 2 is perspective view of an example embodiment of a container that may be formed from the blank shown in FIG. 1.
Figure 3:
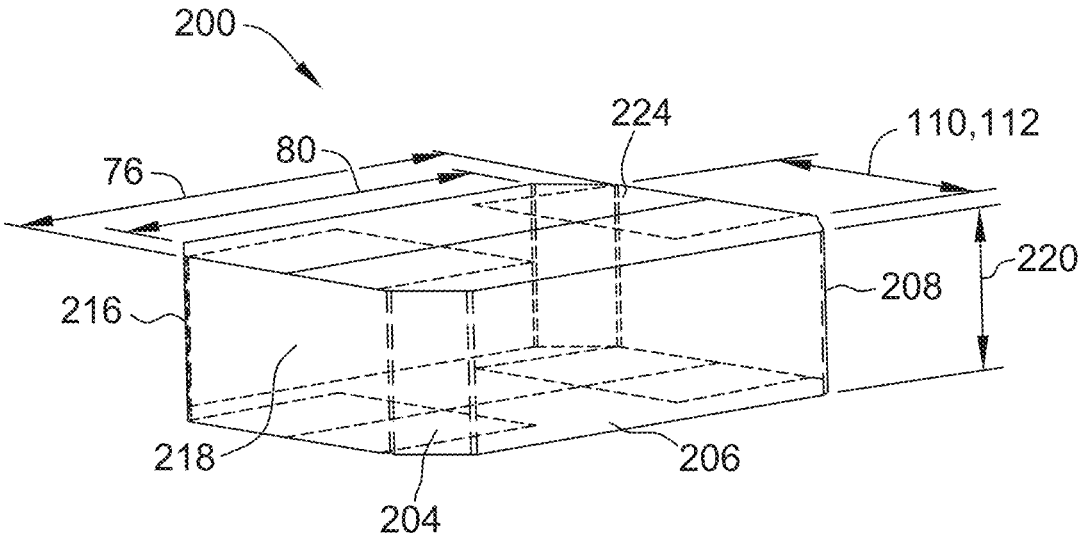
FIG. 3 is a perspective view of the container shown in FIG. 2 in a closed state.
Figure 4:
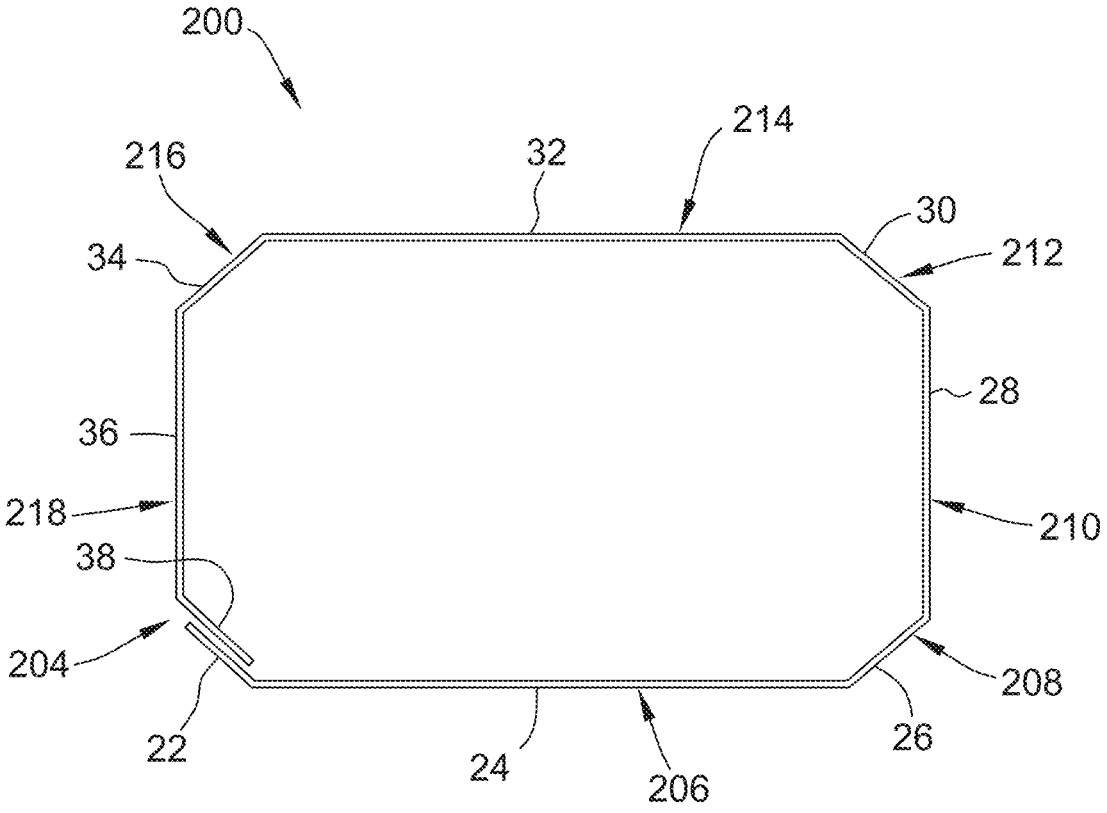
FIG. 4 is an overhead cross-sectional view of the container shown in FIG. 3.

The shape, size, and arrangement of bottom side panels 62 and 68 and top side panels 60 and 70 as shown in FIG. 1 and described above facilitates forming an octagonal container 200 having angled corners, an example of which is shown in FIGS. 2-4. More specifically, the shape, size, and arrangement of bottom side panels 62 and 68 and top side panels 60 and 70 facilitates forming container 200 having corner walls that are obliquely angled with respect to, and interconnect side walls and end walls of formed container 200.

As shown in FIG. 1, a first top end panel 94 and a first bottom end panel 96 extend from opposing edges of first end panel 28. More specifically, first top end panel 94 and first bottom end panel 96 extend from first end panel 28 along a pair of opposing preformed, generally parallel, fold lines 98 and 100, respectively. Similarly, a second bottom end panel 102 and a second top end panel 104 extend from opposing edges of second end panel 36. More specifically, second bottom end panel 102 and second top end panel 104 extend from second end panel 36 along a pair of opposing preformed, generally parallel, fold lines 106 and 108, respectively. Fold lines 98, 100, 106, and 108 are generally parallel to each other and generally perpendicular to fold lines 44, 46, 52, and 54. First bottom end panel 96 and first top end panel 94 each have a width 110 taken along central horizontal axis 78 of blank 20 that is substantially equal to a width 112 of first end panel 28, also taken along central horizontal axis 78. Similarly, second bottom end panel 102 and second top end panel 104 each have width 110 that is greater than width 112 of second end panel 36, taken along central horizontal axis 78.

First bottom end panel 96 and first top end panel 94 each include a free edge 114 or 116, respectively. Similarly, second bottom end panel 102 and second top end panel 104 each include a free edge 118 or 120, respectively. Bottom end panels 96 and 102 and top end panels 94 and 104 each include opposing side edge portions 122 and 124 that are each substantially parallel to respective fold lines 44, 46, 52, and/or 54. Although other angles may be used without departing from the scope of the present disclosure, in one embodiment, side edge portions 122 and 124 are angled at about 180° with respect to respective fold lines 44, 46, 52, and/or 54.

As a result of the above example embodiment of blank 20, a manufacturer joint, a container bottom wall, and a container top wall formed therefrom may be securely closed so that various products may be securely contained within a formed container. Therefore, less material may be used to fabricate blank 20 having suitable strength for construction of a container that can contain various loads.

As will be described below in more detail with reference to FIGS. 5-43, blank 20 is intended to form a container 200 as shown in FIGS. 2-4 by folding and/or securing panels 22, 24, 26, 28, 30, 32, 34, 36, and/or 38 (shown in FIG. 1) and bottom panels 62, 68, 96, and/or 102 (shown in FIG. 1). Of course, blanks having shapes, sizes, and configurations different than blank 20 described and illustrated herein may be used to form container 200 shown in FIGS. 2-4 without departing from the scope of the present disclosure. In other words, the machine and processes described herein can be used to form a variety of different shaped and sized containers, and is not limited to blank 20 shown in FIG. 1 and/or container 200 shown in FIGS. 2-4.

FIG. 2 illustrates a perspective view of an example container 200, which is erected and in an open configuration, that may be formed from blank 20 (shown in FIG. 1). FIG. 3 illustrates a perspective view of container 200 in a closed configuration. FIG. 4 illustrates an overhead cross-sectional view of container 200. Referring to FIGS. 1-4, in the example embodiment, container 200 includes a plurality of walls defining a cavity 202. More specifically, container 200 includes a first corner wall 204, a first side wall 206, a second corner wall 208, a first end wall 210, a third corner wall 212, a second side wall 214, a fourth corner wall 216, and a second end wall 218. First corner wall 204 includes first corner panel 22 and glue panel 38, first side wall 206 includes first side panel 24, second corner wall 208 includes second corner panel 26, first end wall 210 includes first end panel 28, third corner wall 212 includes third corner panel 30, second side wall 214 includes second side panel 32, fourth corner wall 216 includes fourth corner panel 34, and second end wall 218 includes second end panel 36, as described in more detail below. Each wall 204, 206, 208, 210, 212, 214, 216, and 218 has a height 220. Although each wall may have a different height without departing from the scope of the present disclosure, in the embodiment shown FIGS. 1-4, each wall 204, 206, 208, 210, 212, 214, 216, and 218 has substantially the same height 220.

In the example embodiment, first corner wall 204 connects first side wall 206 to second end wall 218, second corner wall 208 connects first side wall 206 to first end wall 210, third corner wall 212 connects first end wall 210 to second side wall 214, and fourth corner wall 216 connects second side wall 214 to second end wall 218. Further, bottom panels 62, 68, 96, and 102 form a bottom wall 222 of container 200, and top panels 60, 70, 94, and 104 form a top wall 224 of container 200. Although container 200 may have other orientations without departing from the scope of the present disclosure, in the embodiments shown in FIGS. 2-4, end walls 210 and 218 are substantially parallel to each other, side walls 206 and 214 are substantially parallel to each other, first corner wall 204 and third corner wall 212 are substantially parallel to each other, and second corner wall 208 and fourth corner wall 216 are substantially parallel to each other. Corner walls 204, 208, 212, and 216 are obliquely angled with respect to walls 206, 210, 214, and 218 they interconnect to form angled corners of container 200.

Bottom panels 62, 68, 96, and 102 are each orientated generally perpendicular to walls 204, 206, 208, 210, 212, 214, 216, and 218 to form bottom wall 222. More specifically, bottom end panels 96 and 102 are folded beneath/inside of bottom side panels 62 and 68. Similarly, in a fully closed position (shown in FIG. 3), top panels 60, 70, 94, and 104 are each orientated generally perpendicular to walls 204, 206, 208, 210, 212, 214, 216, and 218 to form top wall 224. Although container 200 may be secured together using any suitable fastener at any suitable location on container 200 without departing from the scope of the present disclosure, in one embodiment, adhesive (not shown) is applied to an inner surface and/or an outer surface of first corner panel 22 and/or glue panel 38 to form first corner wall 204. In one embodiment, adhesive may also be applied to exterior surfaces of bottom end panels 96 and/or 102 and/or interior surfaces of bottom side panels 62 and/or 68 to secure bottom side panels 62 and/or 68 to bottom end panels 96 and/or 102. As a result of the above example embodiment of container 200, the manufacturer joint, bottom wall 222, and/or top wall 224 may be securely closed so that various products may be securely contained within container 200. Therefore, less material may be used to fabricate a stronger container 200.

Figure 5:
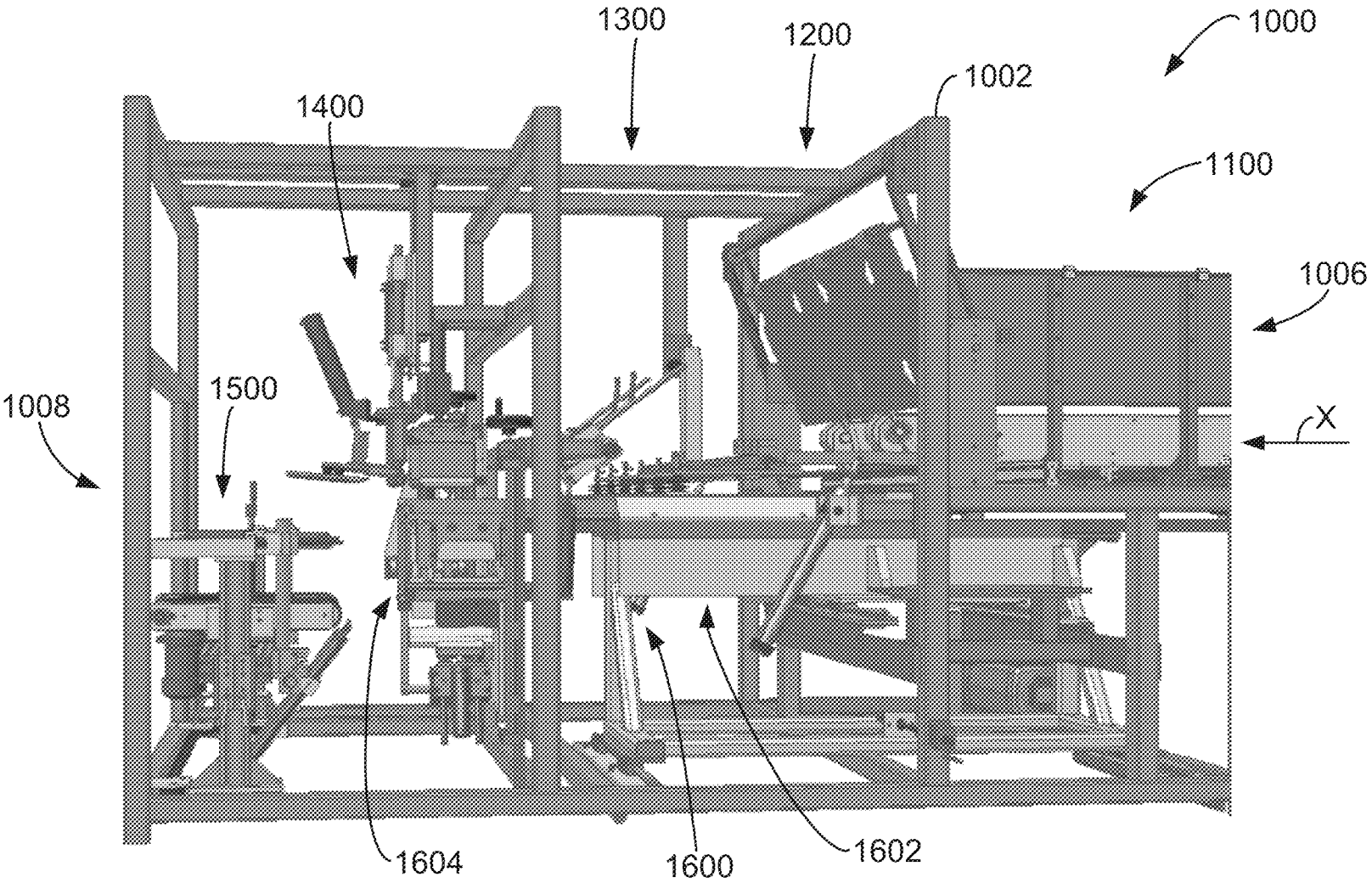
FIG. 5 is a perspective view of an example embodiment of a machine that may be used to form a container from the blank of sheet material shown in FIG. 1.
Figure 6:
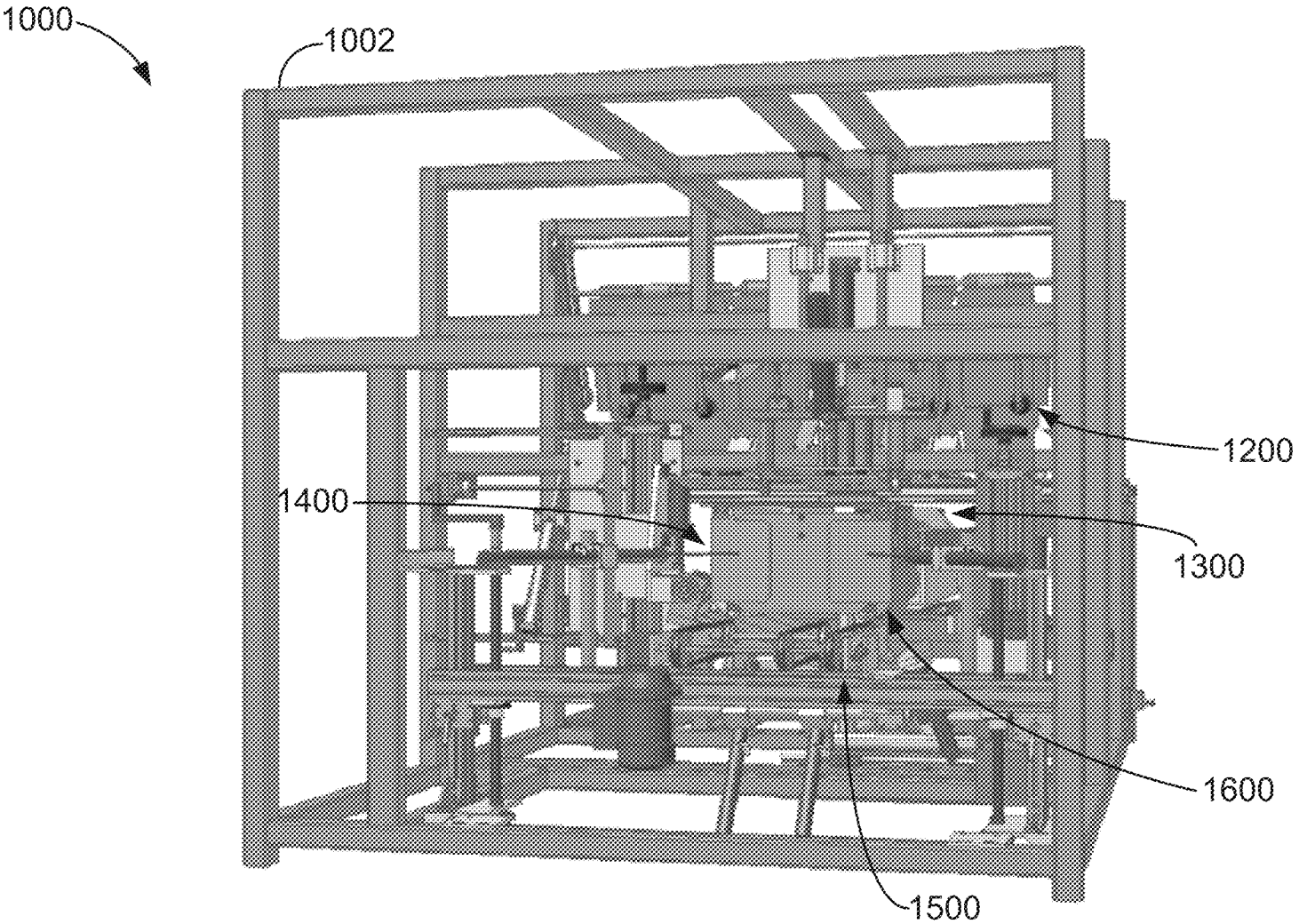
FIG. 6 is another perspective view of the machine shown in FIG. 5 looking from downstream to upstream on the machine.

FIG. 5 illustrates a perspective view of an example machine 1000 for forming a container, such as container 200 (shown in FIGS. 2-4) from a blank of sheet material, such as blank 20 (shown in FIG. 1). FIG. 6 illustrates an additional perspective view of machine 1000. Machine 1000 will be discussed hereafter with reference to forming corrugated container 200 from blank 20; however, machine 1000 may be used to form a box or any other container having any size, shape, and/or configuration from a blank having any size, shape, and/or configuration without departing from the scope of the present disclosure.

Figure 8:
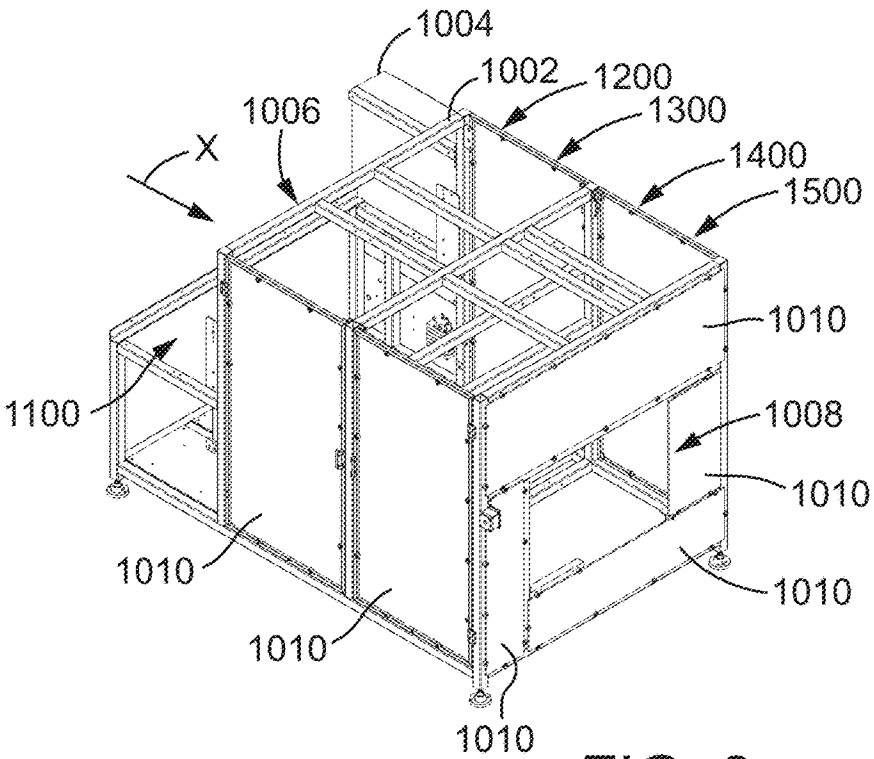
FIG. 8 is another perspective view of the control system and protective panels shown in FIG. 7.
Figure 7:
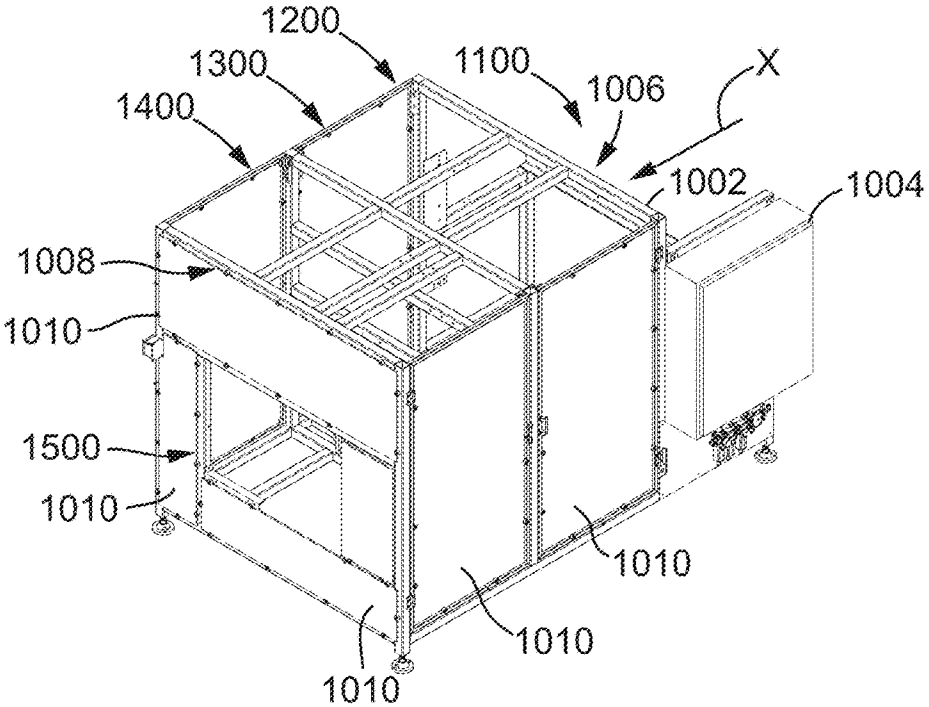
FIG. 7 is a perspective view of an example control system and example protective panels which are included in the machine shown in FIGS. 5-6.

As shown in FIGS. 5-6, machine 1000 includes a magazine feed section 1100, a vacuum transfer section 1200, a mandrel pre-fold section 1300, a mandrel wrap section 1400, and an outfeed section 1500, each positioned with respect to and/or coupled to a frame 1002. As shown in FIGS. 7-8, a control system 1004 is coupled in operative control communication with one or more components of machine 1000. Magazine feed section 1100 is positioned at an upstream end 1006 of machine 1000 with respect to a blank forming path direction indicated by an arrow X. Vacuum transfer section 1200 is positioned downstream from magazine feed section 1100 in blank forming path direction X. Moreover, mandrel pre-fold section 1300 is positioned downstream from vacuum transfer section 1200 in blank forming path direction X, mandrel wrap section 1400 is positioned downstream from mandrel pre-fold section 1300 in blank forming path direction X, and outfeed section 1500 is positioned at a downstream end 1008 of machine 1000 and downstream from mandrel wrap section 1400 in blank forming path direction X. In some embodiments, machine 1000 may also include a product load section (not shown) positioned downstream from outfeed section 1500 with respect to a container discharge direction. Product load section is where a product is loaded into formed container 200, and container 200 is closed and sealed for shipping and/or storing the product. In the example embodiment, the container discharge direction is in substantially the same direction as blank forming path direction X.

Machine 1000 also includes a mandrel assembly, indicated generally at 1600, mounted to frame 1002. Mandrel assembly 1600 extends from the mandrel pre-fold section 1300 to the mandrel wrap section 1400, and includes a first or pre-fold mandrel 1602 and a second mandrel 1604 positioned downstream from the first mandrel 1602.

As shown in FIGS. 7 and 8, machine 1000 also includes a plurality of protective panels 1010 coupled to frame 1002. Protective panels 1010 are omitted from FIGS. 5 and 6 for illustration. Also, certain elements of machine 1000 are omitted from FIGS. 7 and 8 for illustration. Protective panels 1010 prevent external objects from interfering with operation of machine 1000. Protective panels 1010 may be made of plastic, glass, and/or any suitable material that facilitates protecting components of machine 1000. In the example embodiment, protective panels 1010 are substantially transparent, enabling an operator to visually monitor operation of machine 1000.

FIGS. 9-22 illustrate various portions and perspectives of magazine feed section 1100, as well as vacuum transfer section 1200, mandrel pre-fold section 1300, and mandrel assembly 1600.

Figure 9:
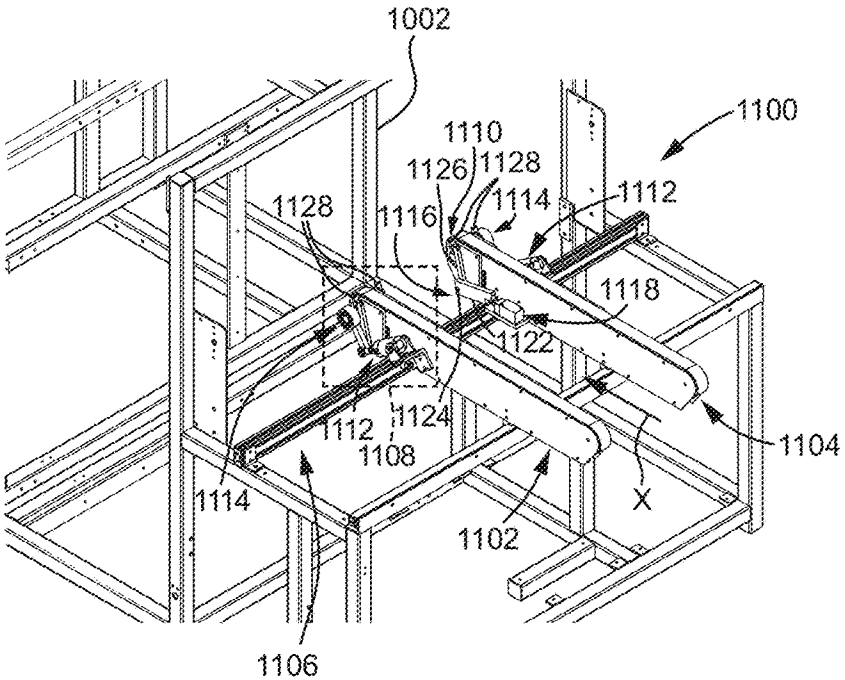
FIG. 9 is a perspective view of a portion of an example magazine feed section included within the machine shown in FIGS. 5-6.
Figure 10:
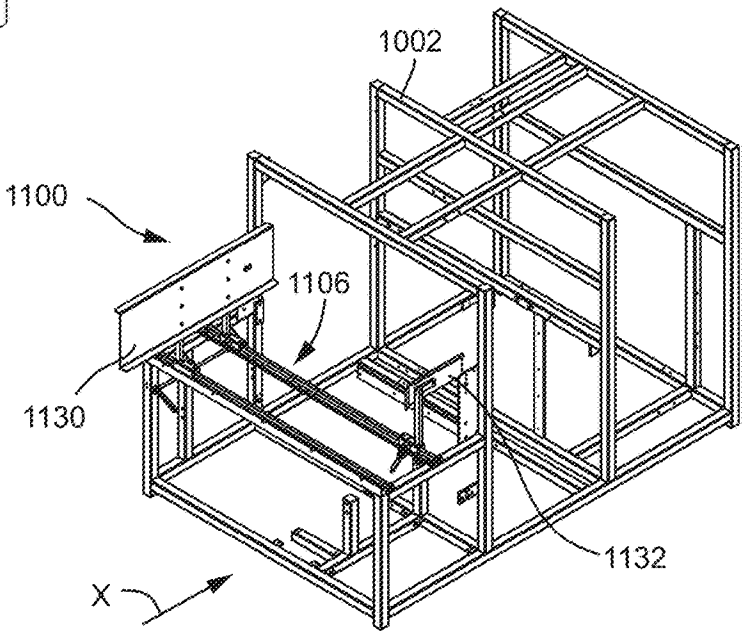
FIG. 10 is a perspective view of another portion of the magazine feed section included within the machine shown in FIGS. 5-6.
Figure 11:
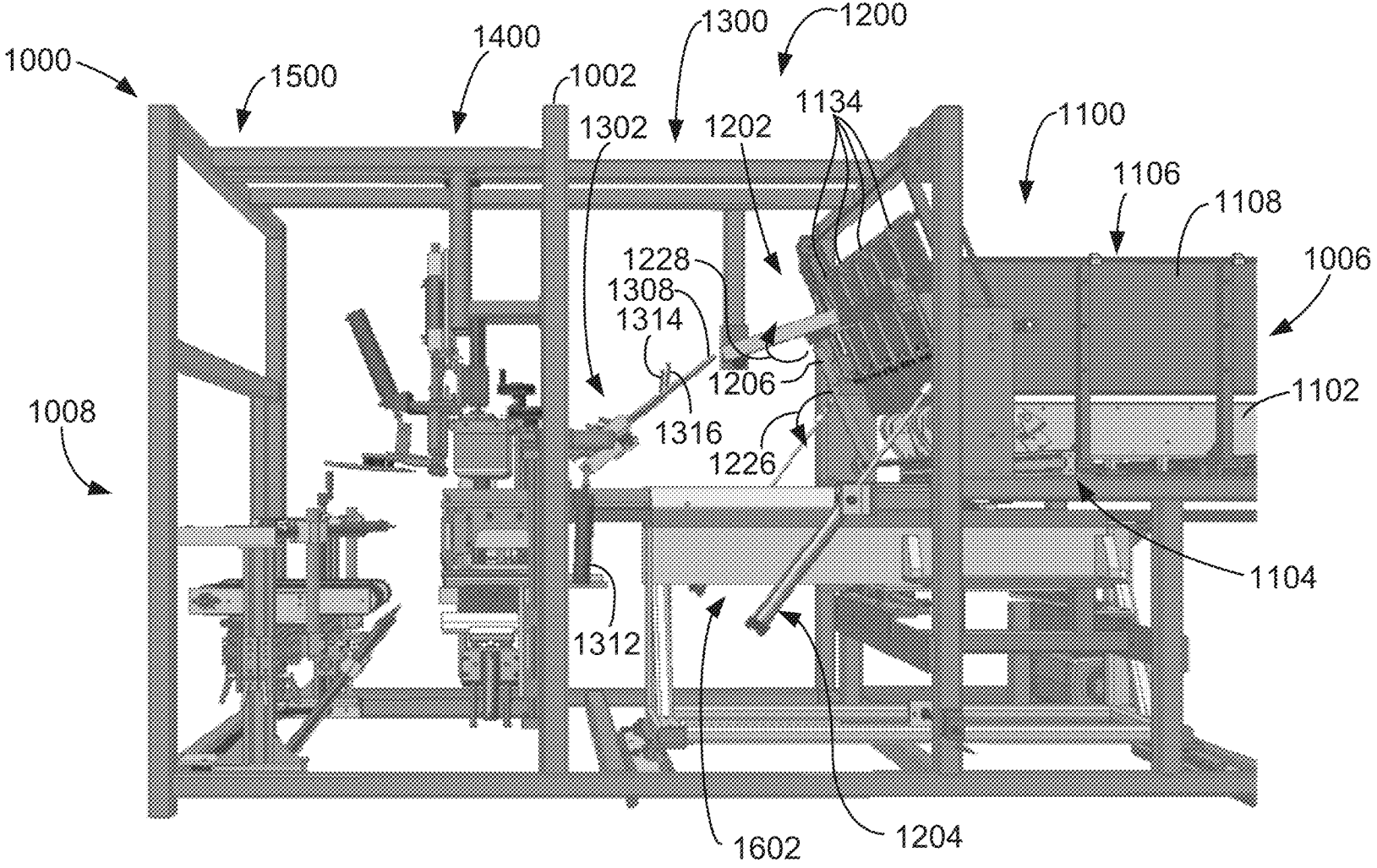
FIG. 11 is a perspective view of the magazine feed section shown in FIGS. 9 and 10, an example vacuum transfer section, and a pre-fold section included in the machine shown in FIGS. 5-6.
Figure 12:
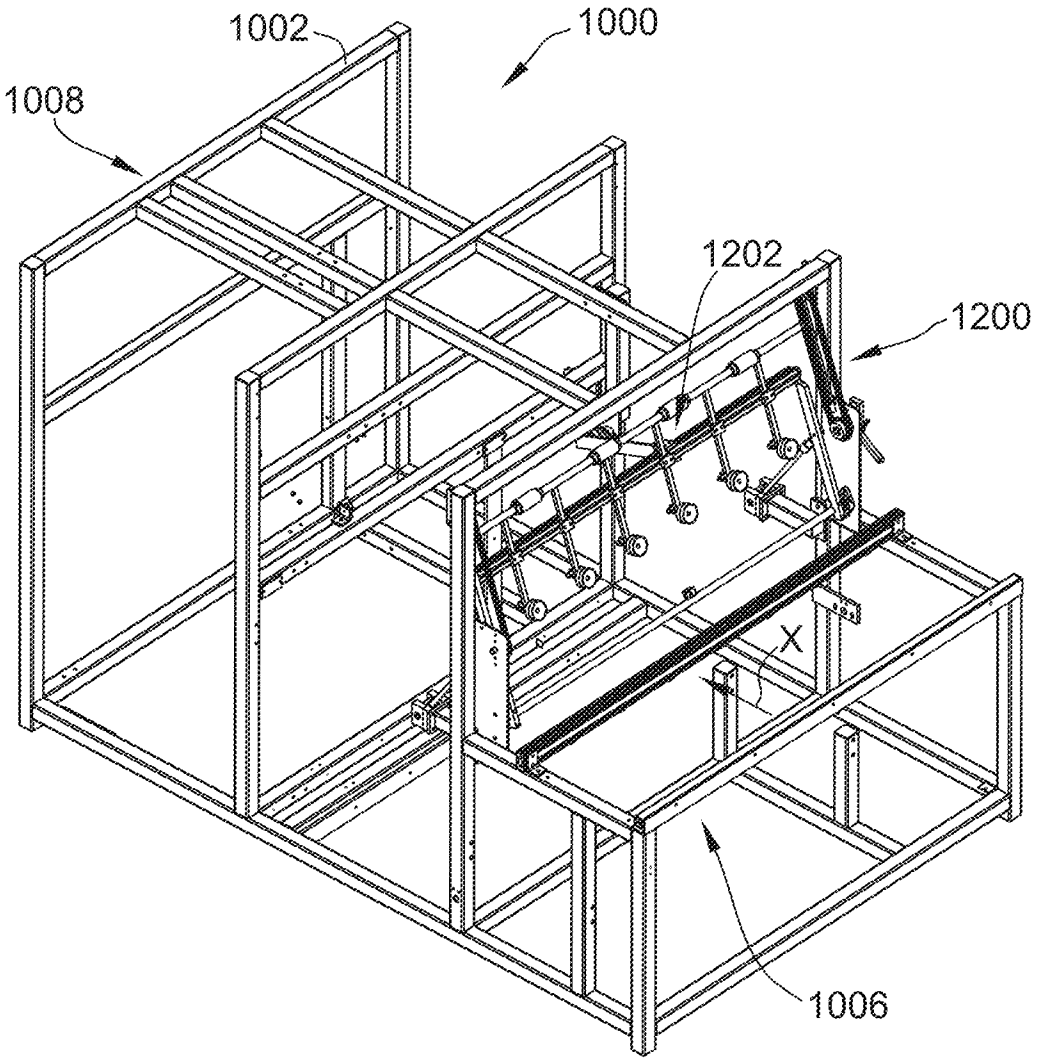
FIG. 12 is a perspective view of an example pick-and-place assembly which is included in the vacuum transfer section shown in FIG. 11.
Figure 13:
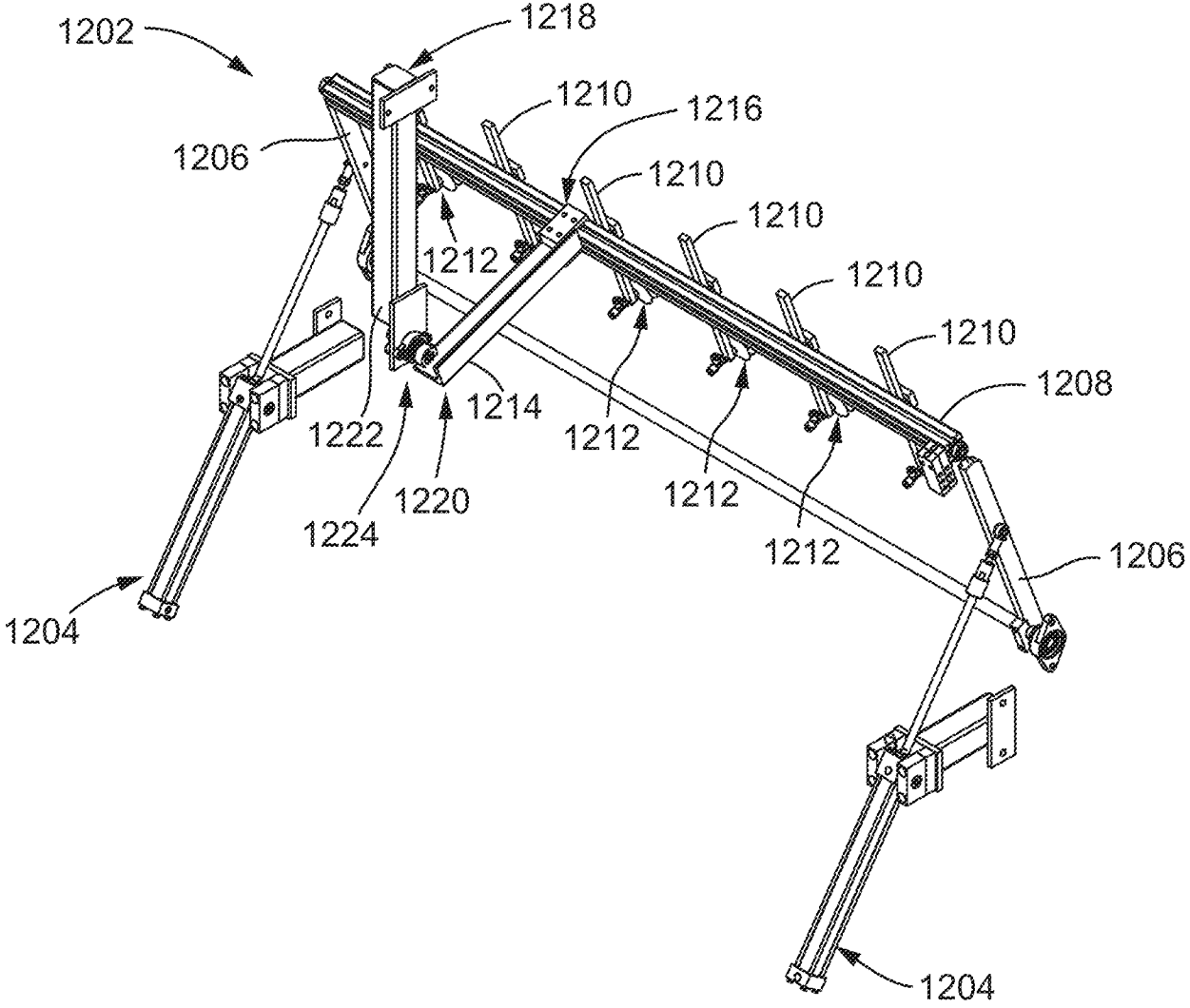
FIG. 13 is perspective view of the pick-and-place assembly shown in FIG. 12.
Figure 14:
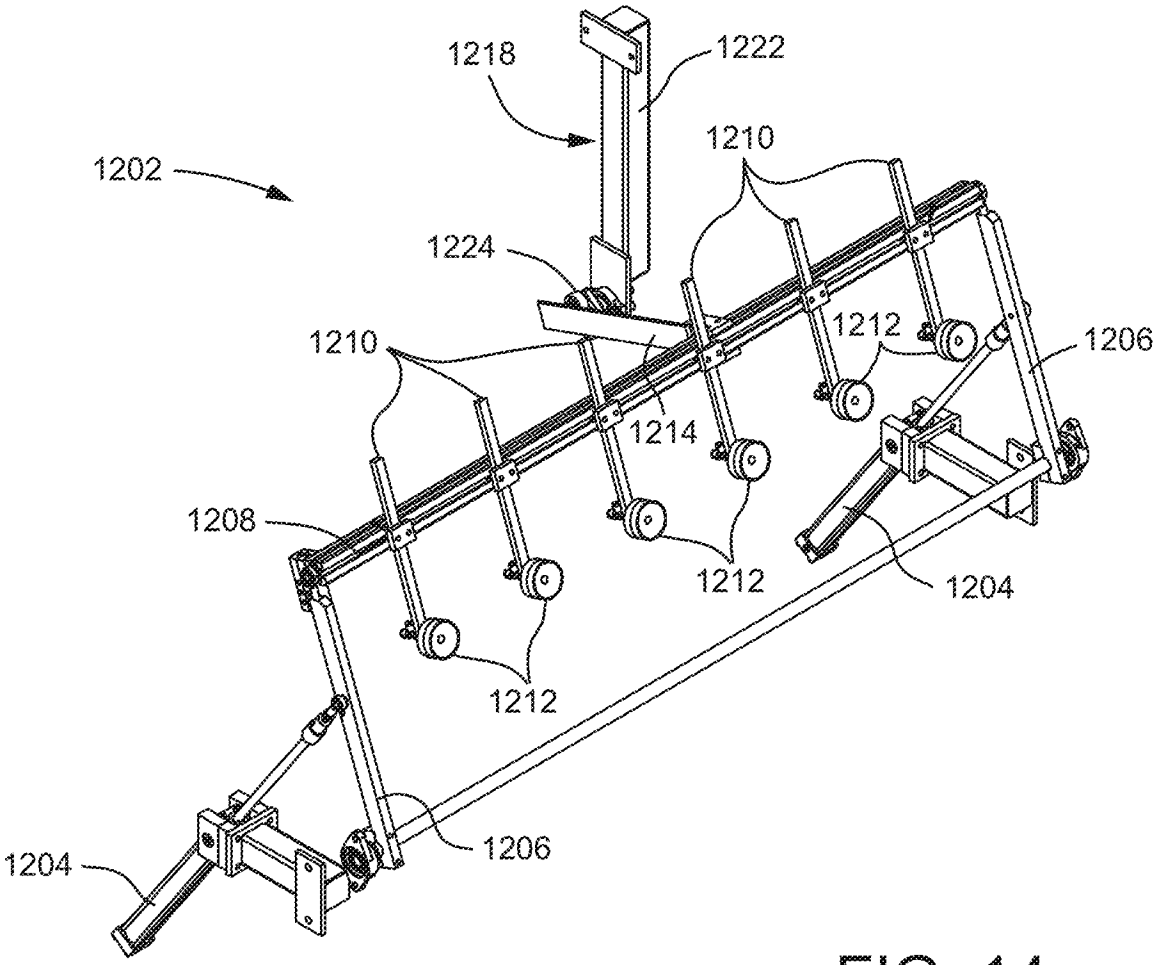
FIG. 14 is another perspective view of the pick-and-place assembly shown in FIG. 13.

Referring to FIGS. 9-11, in the example embodiment, magazine feed section 1100 includes a plurality of independently powered magazine drives 1102 and 1104 for receiving a plurality of blanks 20. Magazine drives 1102 and 1104 are adjustably mounted to rail system 1106 such that a distance between magazine drives 1102 and 1104 can be adjusted to accommodate blanks having different sizes and/or shapes.

Each magazine drive 1102 and 1104 is operatively coupled to a blank alignment device 1108 configured to align blanks 20 at a downstream end 1110 of magazine feed section 1100. More specifically, blank alignment devices 1108 are configured to independently drive magazine drives 1102 and 1104 until a blank 20 is aligned at downstream end 1110 of magazine feed section 1100. In the example embodiment, each blank alignment device 1108 includes a linear actuator 1112 pivotably coupled to a crank wheel 1114 configured to drive a corresponding magazine drive 1102 or 1104 upon actuation of linear actuator 1112. Linear actuator 1112 is operatively coupled to a blank detection device 1116 which controls operation of linear actuator 1112 depending upon whether one or more panels of a blank 20 are positioned and/or aligned at downstream end 1110 of magazine feed section 1100. More specifically, blank detection device 1116 is configured to intermittently or continuously actuate linear actuator 1112, and thereby drive magazine drive 1102 or 1104, until one or more panels of blank 20 are positioned and/or aligned with blank detection device 1116 at downstream end 1110 of magazine feed section 1100.

In the example embodiment, blank detection device 1116 includes a switch 1118 and a switch engaging device 1120 configured to turn switch on and off. Switch 1118 is operatively coupled to linear actuator 1112 such that when switch 1118 is in an off position, linear actuator 1112 does not actuate, and when switch 1118 is in an on position, linear actuator 1112 intermittently or continuously actuates until switch 1118 is turned off. Switch engaging device 1120 includes an arm 1122 rotatably coupled to a magazine drive 1102 or 1104 by a pin 1124, and two fingers 1126 extending from pin 1124 at an oblique angle with respect to arm 1122. Arm 1122 is configured to engage and disengage switch 1118, and thereby turn switch 1118 on and off. Fingers 1126 are positioned on opposite sides of magazine drive 1102 and 1104, and include tips 1128 configured to engage one or more panels of blank 20 when blank is at downstream end 1110 of magazine feed section 1100. When one or more tips 1128 of a switch engaging device 1120 are not engaged by a panel of blank 20, switch engaging device 1120 is in a first, down position (not shown) in which arm 1122 engages switch 1118, and maintains switch 1118 in an on position. Linear actuator 1112 intermittently or continuously actuates, thereby intermittently or continuously driving a corresponding magazine drive 1102 or 1104, until switch 1118 is turned off. When all tips 1128 of a switch engaging device 1120 are engaged by one or more panels of blank 20, switch engaging device 1120 is rotated upwards to a second, up position (shown in FIG. 9) in which arm 1122 is disengaged from switch 1118. Switch 1118 is thereby turned off, and actuation of linear actuator 1112 ceases.

Blanks 20 are loaded and/or orientated in magazine feed section 1100 in any manner that enables operation of machine 1000 as described herein. In the example embodiment, blanks 20 are loaded substantially vertically into magazine feed section 1100. After blanks 20 are loaded onto magazine drives 1102 and 1104, a bundle of blanks 20 is conveyed in the manner described above, in blank forming path direction X, from magazine feed section 1100 to vacuum transfer section 1200.

In the example embodiment, magazine feed section 1100 also includes a magazine alignment panel 1130 and a blank guide 1132, also configured to maintain alignment of blanks 20 within magazine feed section 1100, and a plurality of rollers 1134 (shown in FIG. 11) positioned at a downstream end of magazine feed section 1100. Rollers 1134 are configured to align and/or guide panels of blank 20 as blank 20 is transferred from magazine feed section 1100 to mandrel pre-fold section 1300. Rollers 1134 are aligned with one or more panels of a blank 20, and are configured to rotate as a blank 20 is pulled by vacuum transfer section 1200 from magazine feed section 1100.

As shown in FIGS. 11-15, vacuum transfer section 1200 includes a pick-and-place assembly 1202 (generally, a transfer assembly) configured to lay a blank 20 flat on top of first mandrel 1602. More specifically, pick-and-place assembly 1202 includes linear actuators 1204 operatively coupled to arms 1206 that are, in turn, pivotally coupled to a pick-up bar 1208. A plurality of pick-up arms 1210 are mounted to pick-up bar 1208, and a vacuum suction cup 1212 is fixedly coupled to each pick-up arm 1210. Suction cups 1212 are configured to retrieve a single blank 20 from the plurality of blanks 20 positioned within magazine feed section 1100. Suction cups 1212 include independent vacuum generators (not shown) for providing suction to attach suction cups 1212 to individual blanks 20. In an alternative embodiment, suction cups 1212 are attached to a centralized vacuum generator, which provides the vacuum for suction cups 1212 to attach to a blank 20. In the example embodiment, linear actuators 1204 are actuating cylinders that pneumatically transition between a first, extended position (shown in FIG. 11) and a second, retracted position (shown in FIG. 15).

An angle guide bar 1214 is fixedly coupled to pick-up bar 1208 at a first end 1216 of angle guide bar 1214, and is slidably and rotatably coupled to a pivot guide assembly 1218 at a second end 1220 of angle guide bar 1214. Angle guide bar 1214 and pivot guide assembly 1218 are operatively coupled to one another such that actuation of linear actuators 1204 causes pick-up bar 1208 to pivot and/or rotate a desired amount such that a blank 20 coupled to vacuum transfer section 1200 is aligned in a horizontal, generally flat position (shown in FIG. 15) on first mandrel 1602. Pivot guide assembly 1218 includes a pivot guide mount 1222 fixedly coupled to frame 1002, and one or more pivot guides 1224 configured to slidably and/or rotatably engage angle guide bar 1214. In the example embodiment, angle guide bar 1214 is an L-bracket, and pivot guides 1224 are rollers positioned on opposite sides of a leg of the L-bracket.

In operation, linear actuators 1204 are operated and/or controlled to position suction cups 1212 to facilitate picking up a blank 20 from magazine feed section 1100 and transferring blank 20 through vacuum transfer section 1200 to mandrel pre-fold section 1300. Linear actuators 1204 are actuated into the first position (shown in FIG. 11), causing suction cups 1212 to sealingly couple a blank 20 within magazine feed section 1100. Linear actuators 1204 are then actuated into the second position (shown in FIG. 15), causing arms 1206 to rotate in a first direction (generally, a downward or counter-clockwise direction) indicated by arrow 1226, which in turn cause angle guide bar 1214 to slidably and rotatably engage pivot guide assembly 1218, which in turn causes pick-up bar 1208 and pick-up arms 1210 to rotate in a second direction (generally an upward or clockwise direction) indicated by arrow 1228, generally opposite to the first direction. The general motion of pick-up bar 1208 and pick-up arms 1210 is movement along an arc in a first, generally counter-clockwise direction 1226 while rotating in a second, generally clockwise direction 1228 opposite the first direction 1226. Suction cups 1212 follow the general motion of pick-up arms 1210, and release blank 20 onto mandrel pre-fold section 1300. Once blank 20 is released, the direction of linear actuators 1204 is reversed to move suction cups 1212 to their original position to pick up the next blank 20. Pick-and-place assembly 1202 may include any suitable structure and/or means that may be used to attach to blank 20 and transfer blank 20 from magazine feed section 1100 to mandrel pre-fold section 1300 without departing from the scope of the present disclosure.

Referring now to FIGS. 11 and 15-22, blanks 20 are received in mandrel pre-fold section 1300 from vacuum transfer section 1200. Mandrel pre-fold section 1300 includes first mandrel 1602, a pre-folding assembly 1302, and a transfer assembly 1304. Mandrel pre-fold section 1300 is configured to partially form container 200 by folding a first portion of blank 20 around first mandrel 1602.

Figure 16:
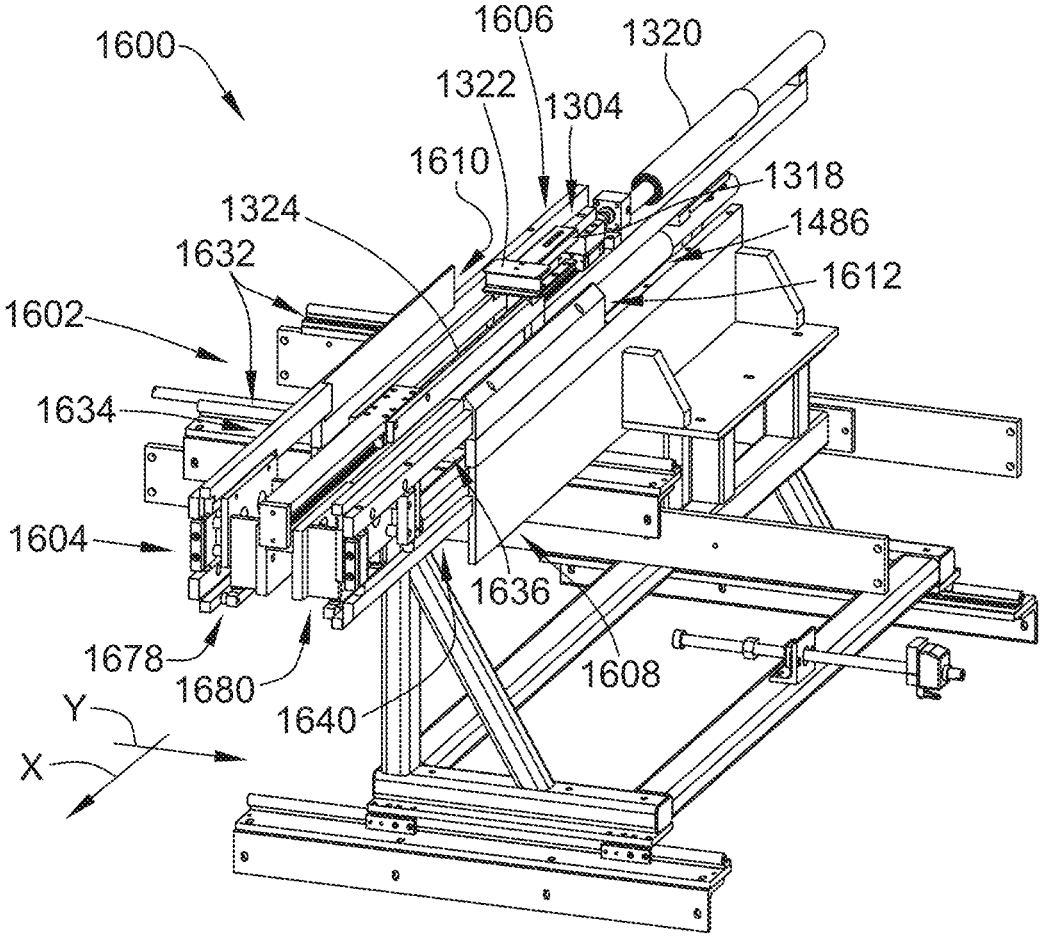
FIG. 16 is a perspective view of an example mandrel assembly and an example transfer assembly that are included within the machine shown in FIGS. 5-6.
Figure 17:
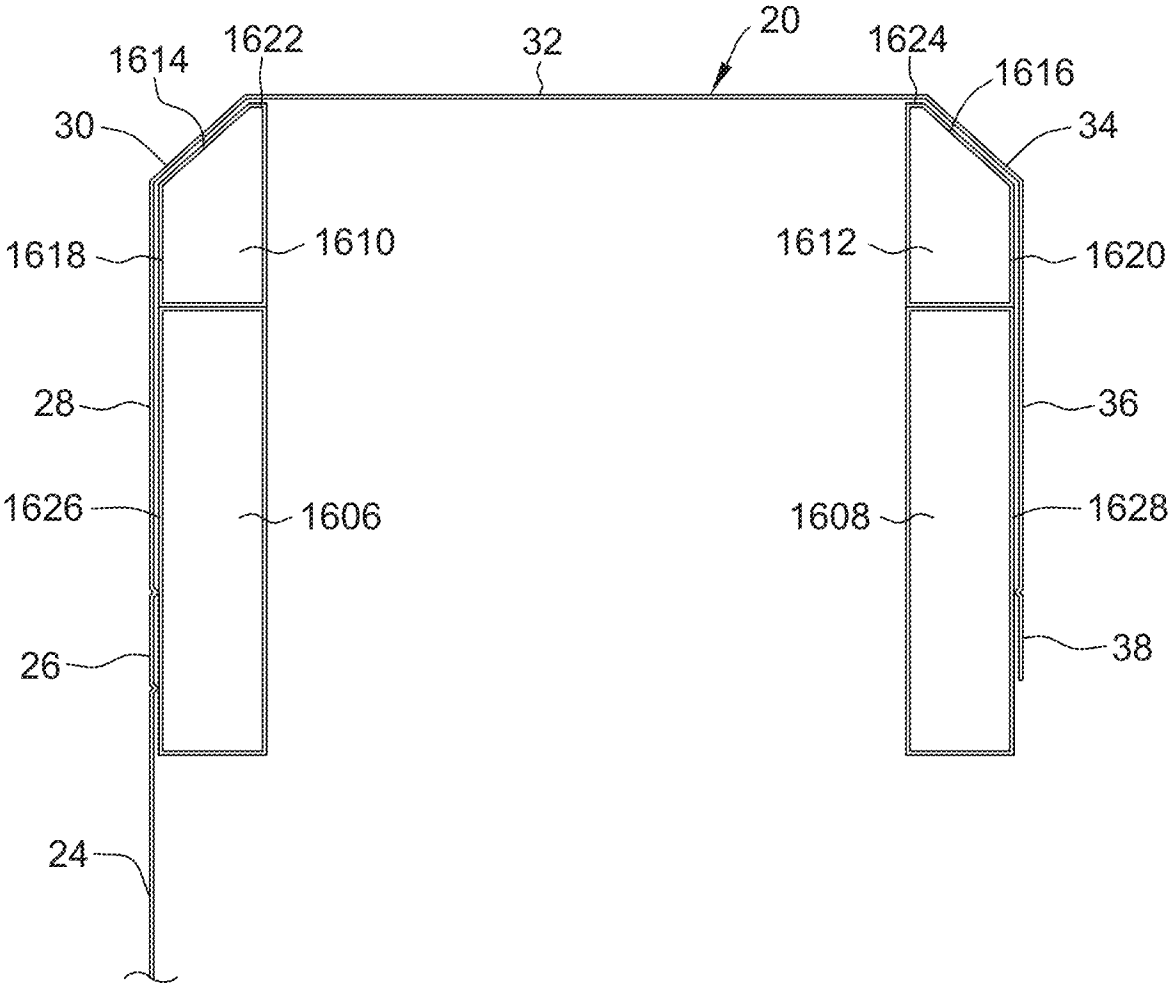
FIG. 17 is a cross-sectional view of a first mandrel which is part of the mandrel assembly shown in FIG. 16 with the blank shown in FIG. 1 partially wrapped around the first mandrel.

As shown in FIGS. 16-17, first mandrel 1602 has an external shape that is complementary to an internal shape of a first portion of container 200 that is formed at mandrel pre-fold section 1300. More specifically, first mandrel 1602 includes adjustable plates 1606 and 1608 and miter plates 1610 and 1612 each having a plurality of faces 1614, 1616, 1618, 1620, 1622, 1624, 1626, and 1628 that substantially correspond to at least some of the panels on blank 20.

In the example embodiment, miter plates 1610 and 1612 include angled faces 1614 and 1616 obliquely angled with respect to side faces 1618 and 1620, respectively. Angled faces 1614 and 1616 substantially correspond to third corner panel 30 and fourth corner panel 34, respectively, and side faces 1618 and 1620 substantially correspond to first and second end panels 28 and 36, respectively. In the example embodiment, each miter plate 1610 and 1612 also includes an upper face 1622 and 1624 obliquely angled with respect to angled faces 1614 and 1616, respectively. Blank 20 is placed upon upper faces 1622 and 1624 when blank 20 is transferred from magazine feed section 1100 to mandrel pre-fold section 1300. Accordingly, it is understood that the widths of upper faces 1622 and 1624 may vary depending on the size and/or shape of blank 20, and the widths of upper faces 1622 and 1624 are not limited to the relatively narrow widths illustrated in FIG. 17. Miter plates 1610 and 1612 are detachably mounted to adjustable plates 1606 and 1608 such that miter plates 1610 and 1612 can be interchanged with plates having different sizes and/or shapes such that first mandrel 1602 may be configured to accommodate blanks of varying sizes and/or shapes (e.g., a blank for forming a four-sided container). For example, in embodiments where machine 1000 is used to form a four-sided container, angled faces 1614 and 1616 of miter plates 1610 and 1612 may be omitted, and miter plates 1610 and 1612 may include only side faces 1618 and 1620 and upper faces 1622 and 1624 oriented at approximately 90 degrees with respect to one another. Miter plates 1610 and 1612 are constructed from low-friction, wear-resistant plastic to facilitate transferring blanks 20 from first mandrel 1602 to second mandrel 1604. It is understood, however, that miter plates 1610 and 1612 may be constructed from any suitable material that enables machine 1000 to function as described herein.

In the example embodiment, adjustable plates 1606 and 1608 also include side faces 1626 and 1628 that substantially correspond to at least one of the panels on blank 20. More specifically, side faces 1626 and 1628 of adjustable plates 1606 and 1608 correspond to first and second end panels 28 and 36, respectively. Alternatively, adjustable plates 1606 and 1608 do not include side faces that substantially correspond to any of the panels on blank 20.

Figure 21:
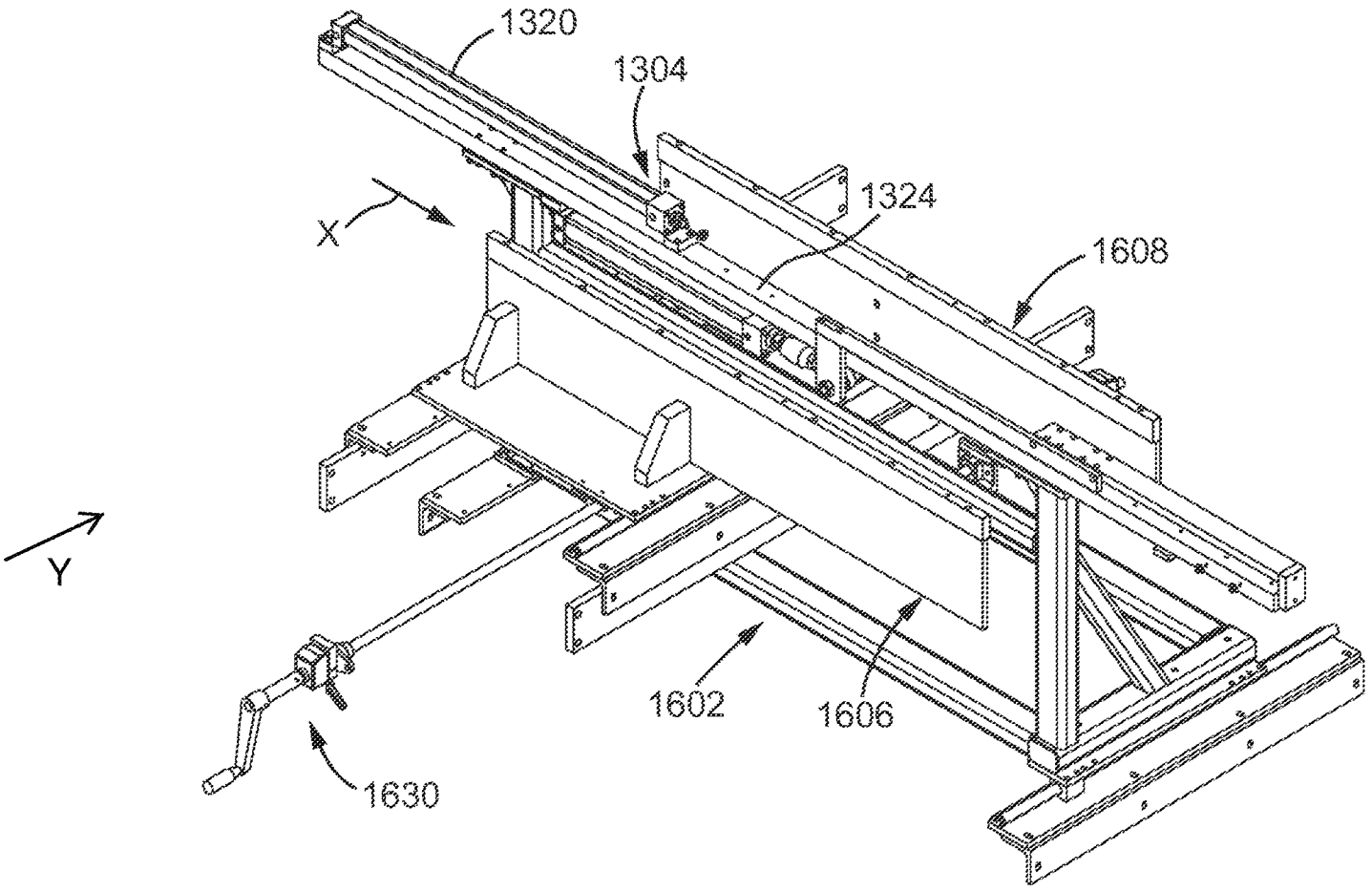
FIG. 21 is another perspective view of the portion of the mandrel assembly and the portion of the transfer assembly shown in FIG. 20.

Adjustable plates 1606 and 1608 are operatively coupled to an adjustment device 1630 (shown in FIG. 21) configured to adjust a distance between adjustable plates 1606 and 1608 in a direction substantially perpendicular to the X direction, referred to as the transverse direction and indicated by an arrow Y (shown in FIG. 21). Adjustable plates 1606 and 1608 are therefore configured be adjusted to accommodate blanks of varying sizes and/or shapes. Adjustable plates 1606 and 1608 are also slidably mounted to a rail system 1632 extending in the transverse direction, to facilitate adjustment of adjustable plates 1606 and 1608. In the example embodiment, adjustment device 1630 is a crank configured to adjust plates 1606 and 1608 via a threaded connection with a nut mounted to adjustable plates 1606 and/or 1608. Also in the example embodiment, adjustable plate 1608 is fixed and only adjustable plate 1606 is moveable in the transverse direction using adjustment device 1630.

Although faces 1614, 1616, 1618, 1620, 1622, 1624, 1626, and 1628 of first mandrel 1602 are described with reference to plates 1606, 1608, 1610 and 1612, it is understood that any of the first mandrel faces 1614, 1616, 1618, 1620, 1622, 1624, 1626, and 1628 may be incorporated into solid plates, frames, plates including openings defined therein, and/or any other suitable component that provides a face and/or surface configured to enable a container to be at least partially formed from a blank as described herein.

FIGS. 11, 15, and 18-19 illustrate various portions and perspectives of pre-folding assembly 1302. Pre-folding assembly 1302 is configured to fold a first portion of blank 20 down and around first mandrel 1602 while blank 20 is positioned within pre-fold section 1300 and/or adjacent first mandrel 1602. In the example embodiment, pre-folding assembly 1302 is also configured to at least partially detach vacuum suction cups 1212 from blank 20 after blank 20 is placed on mandrel pre-fold section 1300.

Pre-folding assembly 1302 includes folding fingers 1306 and 1308 (generally, rods) adjustably coupled to an arm 1310, which is in turn, rotatably mounted to frame 1002. Arm 1310 is operatively coupled to a linear actuator 1312 which, when actuated, causes arm 1310 to rotate, which in turn causes folding fingers 1306 and 1308 to rotate towards and engage an upward-facing surface of a corresponding panel of blank 20, thereby folding one or more panels of blank 20 around first mandrel 1602.

Figure 15:
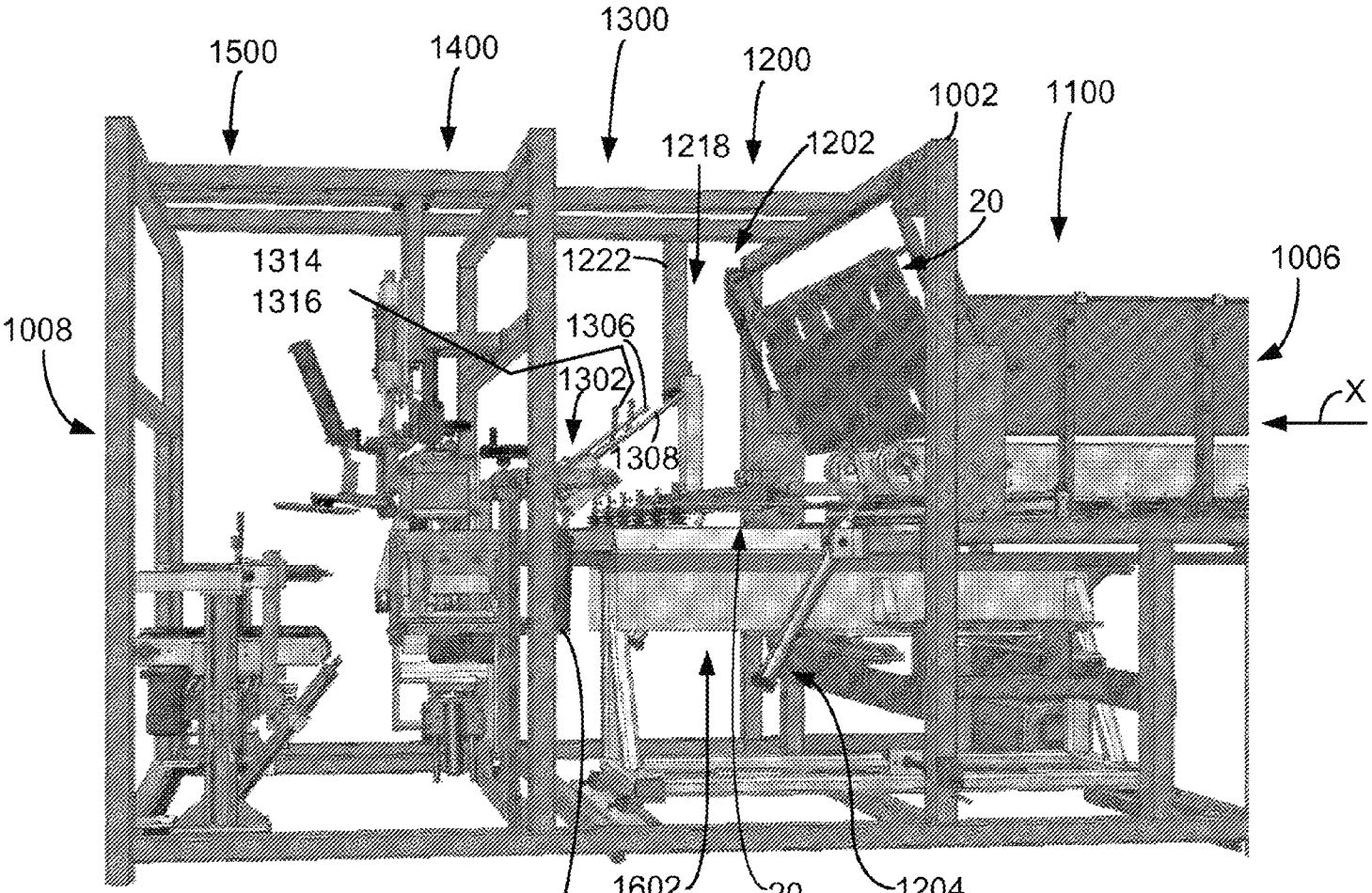
FIG. 15 is a perspective view of the machine shown in FIG. 5 illustrating various portions of an example pre-fold section included in the machine.
Figure 18:
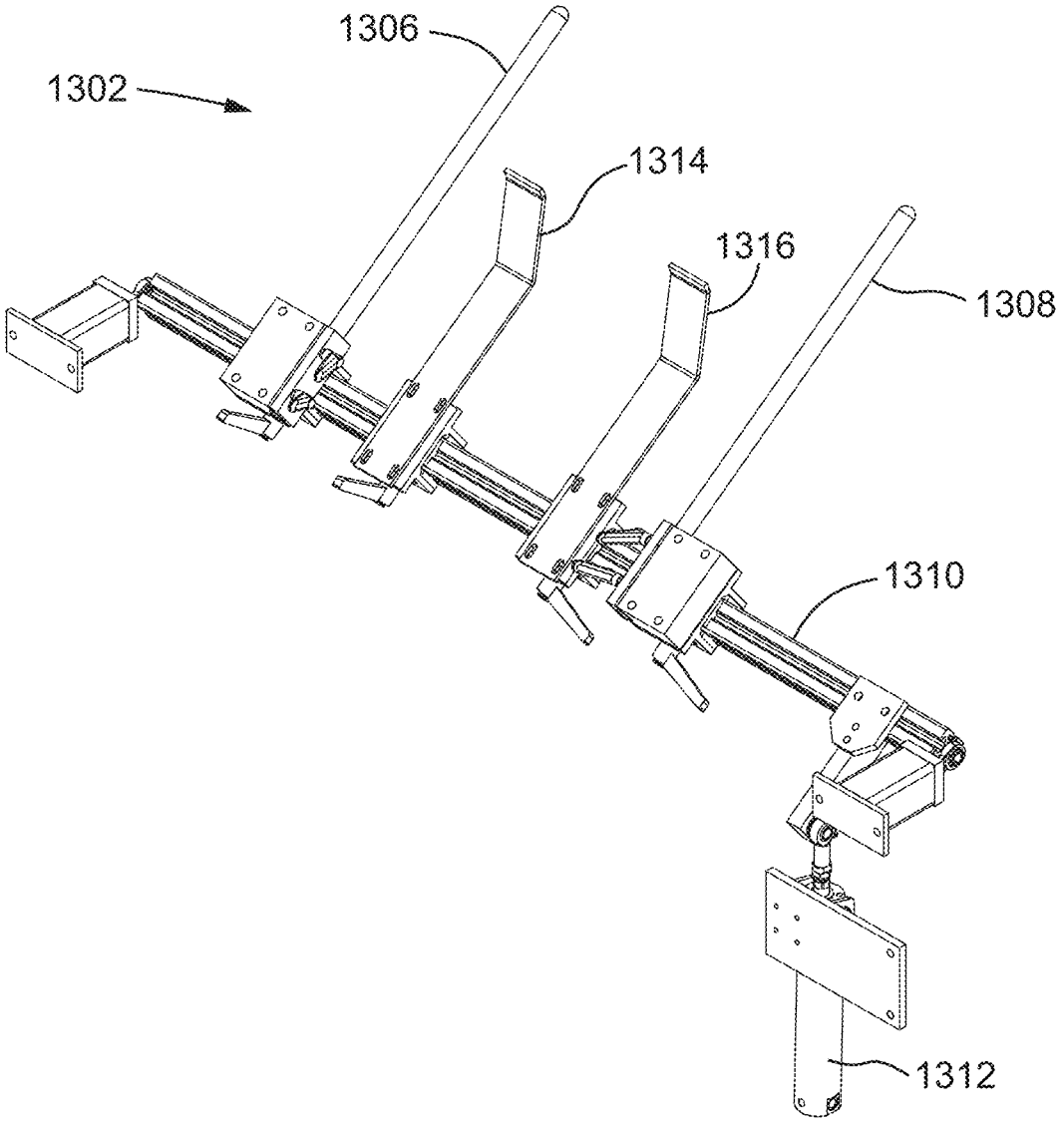
FIG. 18 is a perspective view of an example pre-folding assembly which is part of the pre-fold section shown in FIGS. 11 and 15.

In operation, folding fingers 1306 and 1308 are initially positioned in a first, generally raised position (shown in FIGS. 15 and 18). After a blank 20 is placed on first mandrel 1602 by vacuum transfer section 1200, linear actuator 1312 is actuated to rotate arm 1310 and folding fingers 1306 and 1308 into a second, generally lowered position (shown in FIG. 19). As folding fingers 1306 and 1308 rotate towards the second position, folding fingers 1306 and 1308 engage one or more panels of blank 20 and fold the panels around a corresponding miter plate 1610 and 1612 and/or adjustable plate 1606 and 1608 of the first mandrel 1602. In the example embodiment, pre-folding assembly 1302 and folding fingers 1306 and 1308 are held in the second position while a pre-folded blank 20 is transferred from mandrel pre-fold section 1300 to mandrel wrap section 1400 (described in more detail below) to maintain alignment of blank 20 as blank 20 is transferred from mandrel pre-fold section 1300 to mandrel wrap section 1400. A sufficient amount of lateral spacing is maintained between folding fingers 1306, blank 20, and faces 1618, 1620, 1626, and 1628 of miter plates 1610 and 1612 and adjustable plates 1606 and 1608 so that blank 20 may be transferred with minimal frictional drag. Pre-folding assembly 1302 is therefore also configured to guide a blank 20 as it is transferred from mandrel pre-fold section 1300 to mandrel wrap section 1400. Linear actuator 1312 then reverses direction and rotates pre-folding assembly 1302 and folding fingers 1306 and 1308 back to the first position to repeat the pre-folding procedure for a subsequently placed blank 20. In the example embodiment, vacuum transfer section 1200 transfers another blank 20 to mandrel pre-fold section 1300 after pre-folding assembly 1302 is in the first position. In alternative embodiments, vacuum transfer section 1200 may begin transferring a blank 20 to mandrel pre-fold section 1300 while pre-folding assembly 1302 is being rotated from the second position to the first position.

Folding fingers 1306 and 1308 can be adjusted along the length of arm 1310 such that each folding finger 1306 and 1308 is aligned with a corresponding panel of blank 20. In the example embodiment, folding fingers 1306 and 1308 are spaced apart by a distance greater than the width 76 of side panels 24 and 32, and are aligned with end panels 28 and 36 of blank 20, respectively. Folding fingers 1306 and 1308 are thereby configured to fold end panels 28 and 36, respectively, around first mandrel 1602 about fold lines 46 and/or 48, and 50 and/or 52, respectively. In the example embodiment, folding fingers 1306 and 1308 are also configured to fold corner panels 30 and 34, respectively, around first mandrel 1602 about fold lines 48 and 50, respectively. As such, in the example embodiment, the first portion of blank 20 wrapped around first mandrel 1602 includes first end panel 28, third corner panel 30, second side panel 32, fourth corner panel 34, and second end panel 36.

Pre-folding mechanism also includes retention plows 1314 and 1316 adjustably coupled to arm 1310. Retention plows 1314 and 1316 are configured to prevent blank 20 from bowing or lifting off of mandrel assembly 1600 when folding fingers 1306 and 1308 engage one or more panels of blank 20. More specifically, retention plows 1314 and 1316 are configured to rotate from a first, raised position (shown in FIG. 15) to a second, lowered position (shown in FIG. 19) proximate to one or more panels of blank 20. Retention plows 1314 and 1316 thereby prevent blank 20 from bowing or lifting off of mandrel assembly 1600 when folding fingers 1306 and 1308 fold a first portion of blank 20 around first mandrel 1602.

Figure 20:
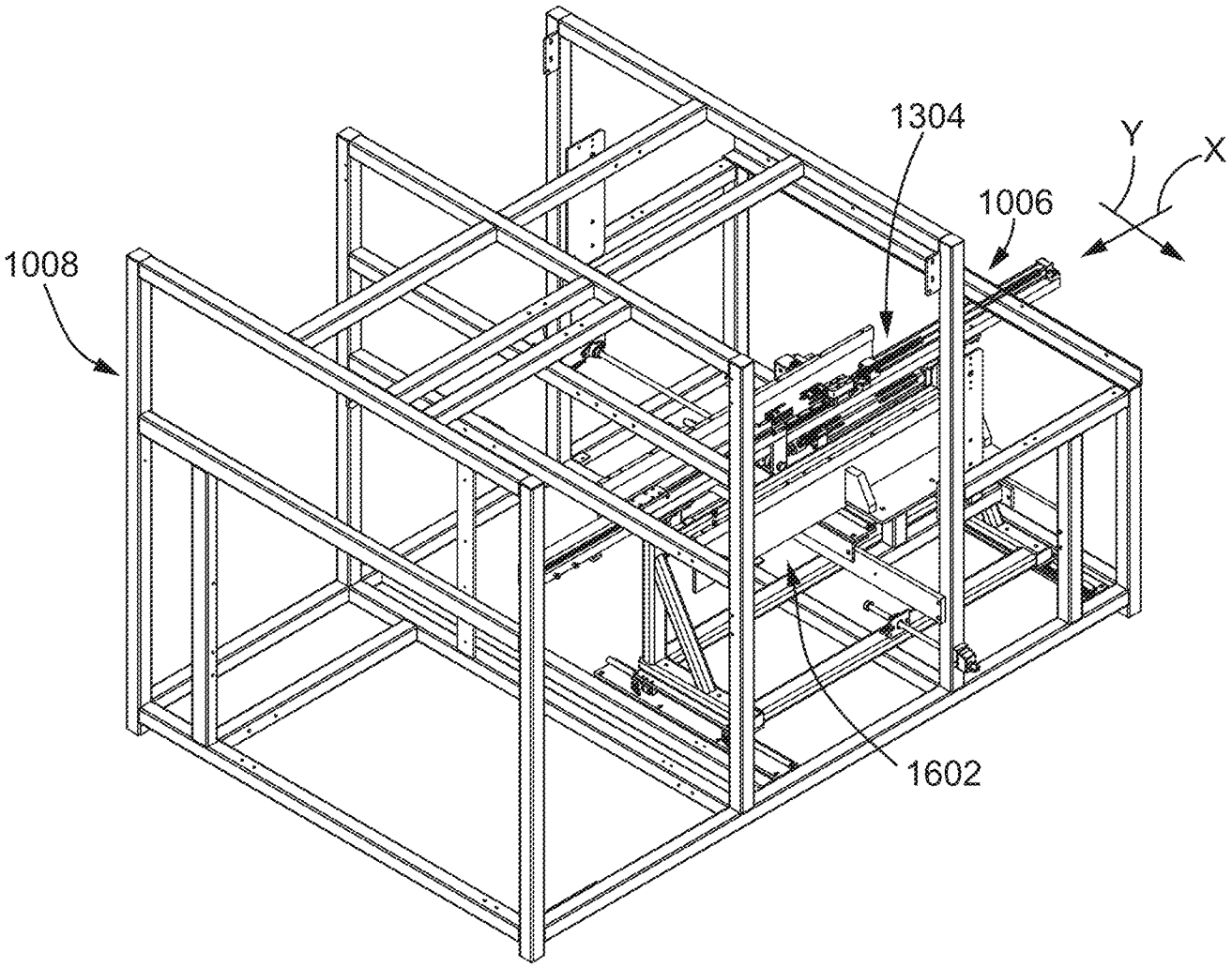
FIG. 20 is a perspective view of a portion of the mandrel assembly and a portion of the transfer assembly shown in FIG. 16.

Referring to FIGS. 16 and 20-21, transfer assembly 1304 is configured to transfer a pre-folded blank 20 from the mandrel pre-fold section 1300 to the mandrel wrap section 1400. More specifically, transfer assembly 1304 is configured to transfer a pre-folded blank (wherein the pre-folded blank is a partially formed container) from first mandrel 1602 to second mandrel 1604. Transfer assembly 1304 includes a pusher bar 1318 operatively coupled to a linear actuator 1320, and one or more pusher feet 1322 coupled to the pusher bar 1318. Pusher feet 1322 are slidably mounted to a guide rail 1324 extending in the X direction to facilitate linear motion of pusher feet 1322. Pusher feet 1322 are detachably coupled to pusher bar 1318 and guide rail 1324 such that pusher feet 1322 may be interchanged with pusher feet having different shapes and/or sizes to accommodate blanks having different sizes and/or shapes. In the example embodiment, transfer assembly 1304 is positioned within mandrel assembly 1600, and, more particularly, within first mandrel 1602 to decrease the necessary size of machine 1000, and thereby reduce the overall footprint of machine 1000.

Transfer assembly 1304 operates to move blanks 20 from mandrel pre-fold section 1300 to mandrel wrap section 1400. More specifically, linear actuator 1320 drives pusher bar 1318 in a direction parallel to direction X, and causes pusher feet 1322 to contact a trailing edge 126 (shown in FIG. 1) of a blank 20 and push and/or slide blank 20 along mandrel guide rails 1634, 1636, 1638 and/or 1640 (described below) toward mandrel wrap section 1400. Linear actuator 1320 then reverses direction and moves pusher bar 1318 in a direction opposite to direction X to transfer the next blank 20 from mandrel pre-fold section 1300. In the example embodiment, transfer assembly 1304 includes one pusher foot 1322 configured to engage a trailing edge 126 of top side panel 70. Alternative embodiments may include any suitable number of pusher feet 1322 configured to engage a trailing edge 126 of one or more of top panels 60, 70, 94, and 104.

Figure 22:
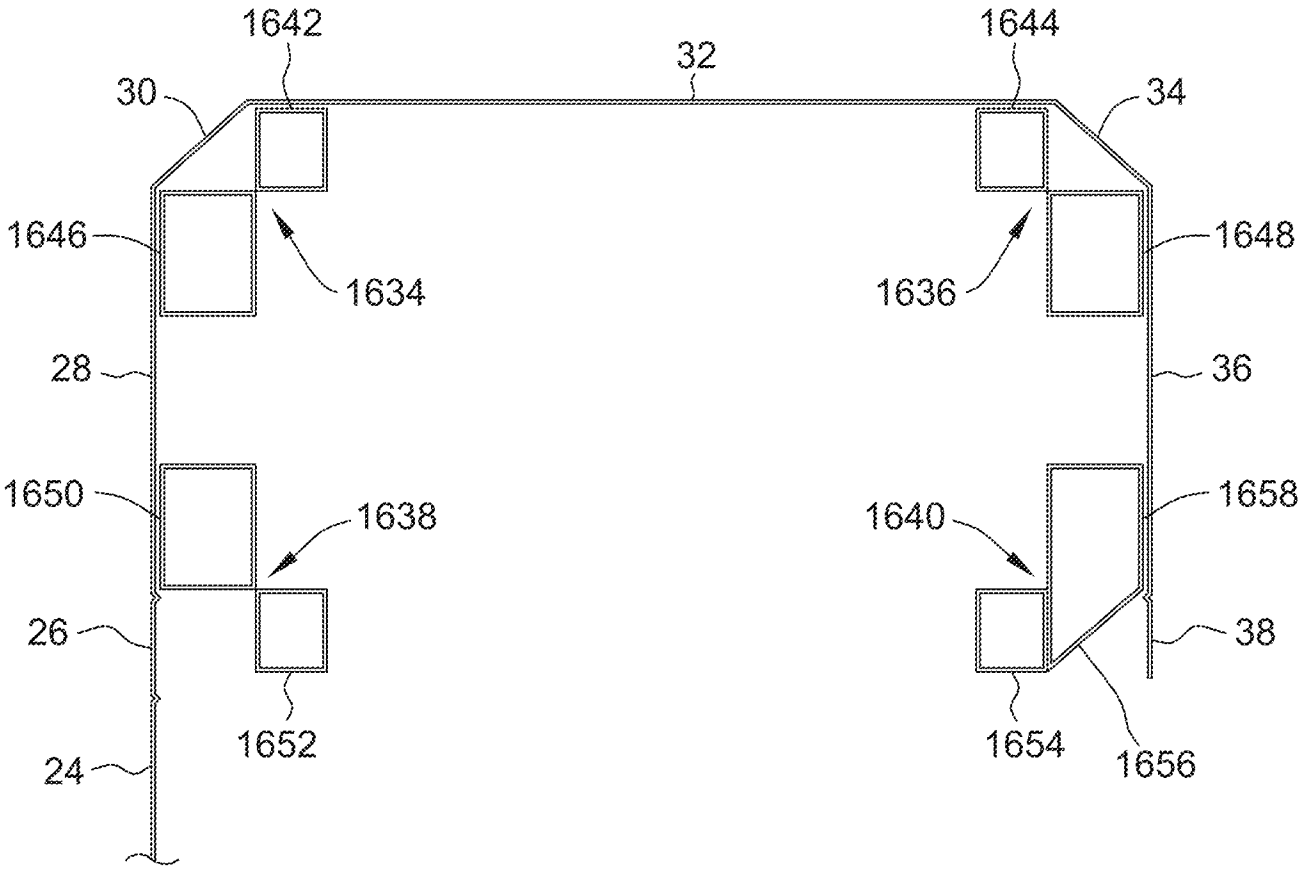
FIG. 22 is a cross-sectional view of example mandrel guide rails which are part of the mandrel assembly shown in FIG. 16 with the blank shown in FIG. 1 partially wrapped around the mandrel guide rails.

Referring to FIGS. 16 and 22, mandrel assembly 1600 includes mandrel guide rails 1634, 1636, 1638 and 1640 to facilitate the transfer of blanks 20 from mandrel pre-fold section 1300 to mandrel wrap section 1400. More specifically, mandrel guide rails 1634, 1636, 1638 and 1640 are configured to maintain the alignment of blank 20 as transfer assembly 1304 transfers blank 20 from mandrel pre-fold section 1300 to mandrel wrap section 1400.

Mandrel guide rails 1634, 1636, 1638 and 1640 extend between first mandrel 1602 and a second mandrel 1604 along the X direction. Mandrel guide rails 1634, 1636, 1638 and 1640 are configured to maintain the alignment of blank 20 as blank 20 is transferred between mandrel pre-fold section 1300 and mandrel wrap section 1400. More specifically, mandrel guide rails 1634, 1636, 1638 and 1640 are generally aligned with one or more of adjustable plates 1606 and 1608 and/or miter plates 1610 and 1612, and include a plurality of faces 1642, 1644, 1646, 1648, 1650, 1652, 1654, 1656, and 1658 configured to an engage an interior surface of one or more panels of blank 20.

In the example embodiment, mandrel guide rails 1634, 1636, 1638 and 1640 include upper mandrel guide rails 1634 and 1636 and lower mandrel guide rails 1638 and 1640. Upper mandrel guide rails 1634 and 1636 are L-shaped rails oriented in opposing orientations with respect to one another. Upper mandrel guide rails 1634 and 1636 include top faces 1642 and 1644, respectively, configured to engage an interior surface of second side panel 32, and side faces 1646 and 1648 configured to engage interior surfaces of first end panel 28 and/or third corner panel 30, and second side panel 32 and/or fourth corner panel 34, respectively. Top faces 1642 and 1644 are substantially coplanar with upper faces 1622 and 1624 of first mandrel 1602 such that a blank 20 may be slid from first mandrel 1602 to second mandrel 1604 along mandrel guide rails 1634 and 1636 without lifting or moving blank 20 out of the plane in which it is initially placed on first mandrel 1602. Lower mandrel guide rail 1638 is also an L-shaped rail having a side face 1650 configured to engage an interior surface of first end panel 28 and/or second corner panel 26, and a bottom face 1652 configured to engage an interior surface of first side panel 24. Lower mandrel guide rail 1640 is a beveled L-shaped rail having a bottom face 1654 configured to engage an interior surface of first side panel 24, an angled face 1656 configured to engage an interior surface of first corner panel 22 and/or glue panel 38, and a side face 1658 configured to engage an interior surface of second end panel 36 and/or glue panel 38.

One or more faces 1642, 1644, 1646, 1648, 1650, 1652, 1654, 1656, and/or 1658 of mandrel guide rails 1634, 1636, 1638, and 1640 may define or may be defined by one or more faces 1660, 1662, 1664, 1666, 1668, 1670, 1672, 1674, and/or 1676 of second mandrel 1604, described in more detail below. In the example embodiment, mandrel guide rails 1634, 1636, 1638, and 1640 are an extension of second mandrel extension 1604. Thus, faces 1644, 1642, 1646, 1650, 1652, 1654, 1656, 1658, and 1648 of mandrel guide rails 1634, 1636, 1638, and 1640 are at least partially defined by faces 1660, 1662, 1664, 1666, 1668, 1670, 1672, 1674, and 1676 of second mandrel 1604, respectively.

Figure 23:
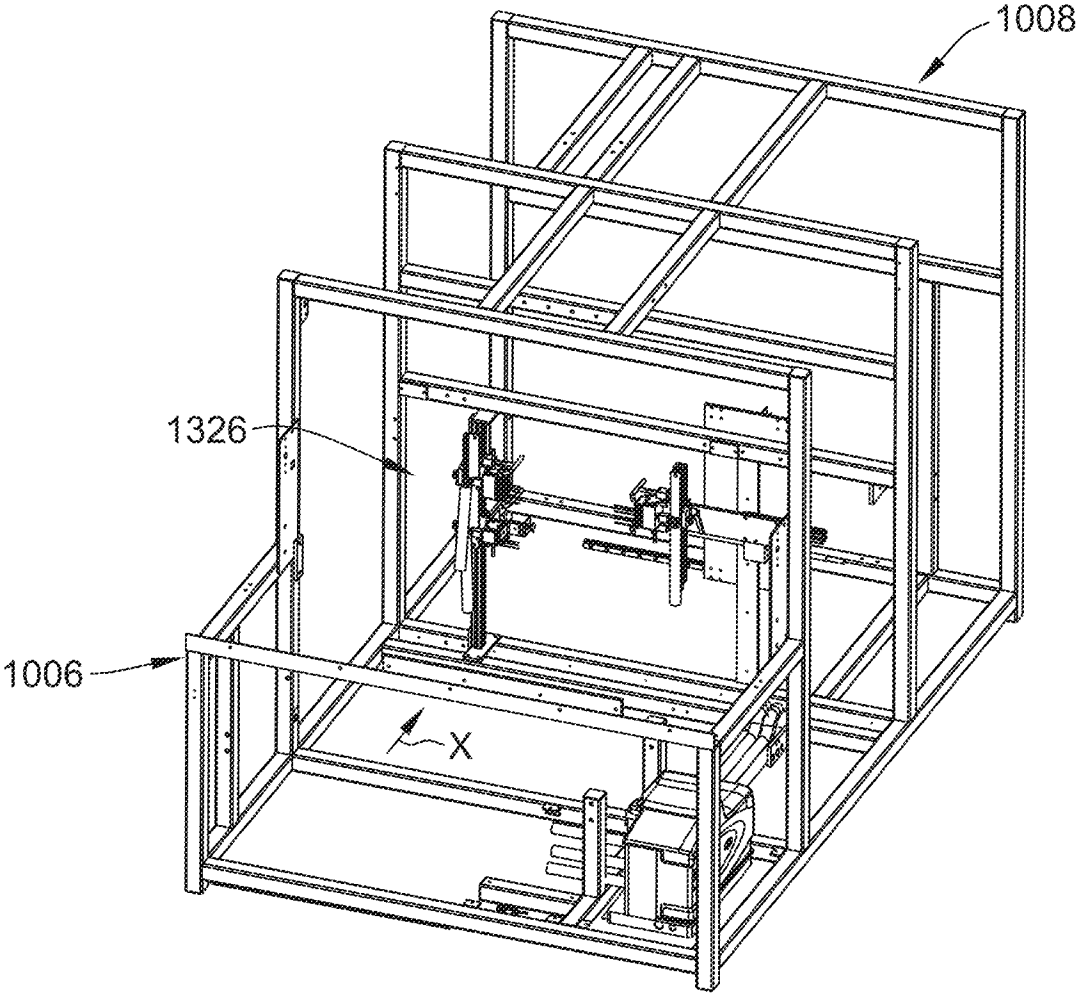
FIG. 23 is a perspective view of an example adhesive applicator assembly which is included within the machine shown in FIGS. 5-6.
Figure 24:
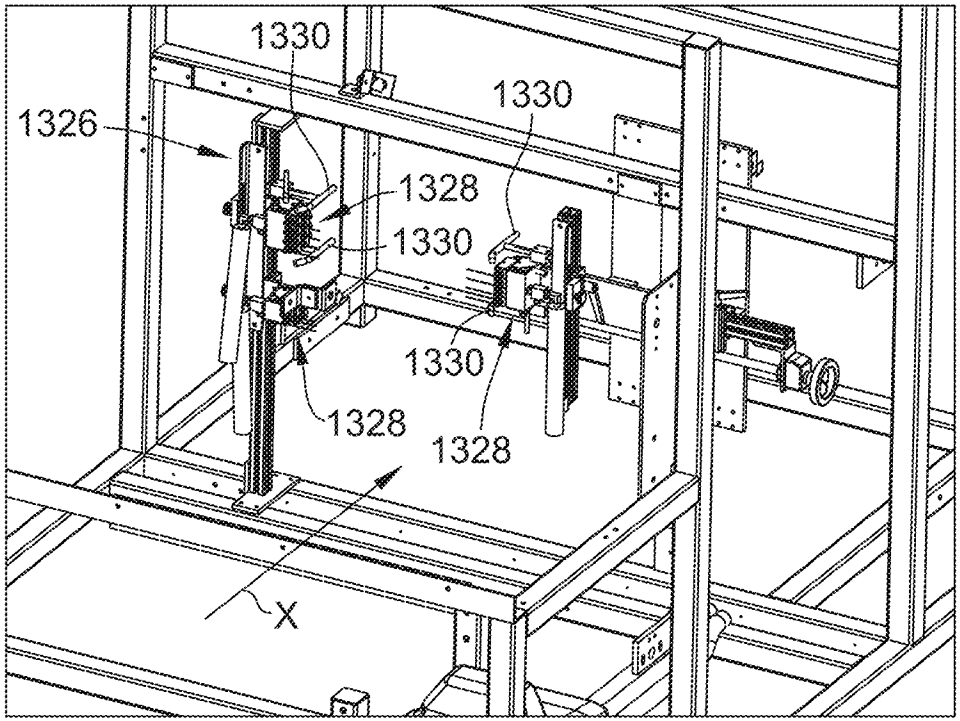
FIG. 24 is another perspective view of the adhesive applicator assembly shown in FIG. 23.

Referring to FIGS. 23 and 24, in the example embodiment, an adhesive applicator assembly 1326 is positioned between first mandrel 1602 and second mandrel 1604, such as adjacent mandrel guide rails 1634, 1636, 1638, and 1640, to apply adhesive to blank 20 as blank 20 is transferred from first mandrel 1602 to second mandrel 1604. Adhesive applicator assembly 1326 includes a plurality of adhesive applicators 1328, shown as nozzles in the example embodiment, configured to dispense and/or apply adhesive (not shown) to predetermined panels of blank 20 while blank 20 is transferred from first mandrel 1602 to second mandrel 1604. In the example embodiment, adhesive applicator assembly 1326 includes three adhesive applicators 1328, two of which are configured to apply adhesive to an exterior surface of bottom end panels 96 and 102, and one of which is configured to apply adhesive to an exterior surface of glue panel 38.

Adhesive applicators 1328 are coupled in communication with an adhesive supply (not shown), which may be controlled by control system 1004 (shown in FIG. 7) to control a starting time, a pattern, an ending time, a length of adhesive bead, and/or any other suitable operations of adhesive applicators 1328.

Adhesive applicator assembly 1326 is positioned downstream from mandrel pre-fold section 1300. As such, adhesive applicators 1328 may apply adhesive to one or more panels of blank 20 while the panels are in a substantially vertical orientation (shown in FIG. 19). As a result, adhesive applicators 1328 may be configured to apply adhesive to one or more panels of blank 20 while adhesive applicators 1328 are arranged in a substantially horizontal orientation (shown in FIGS. 23 and 24), thereby reducing the likelihood of adhesive seeping or leaking back into and clogging adhesive applicators 1328.

As shown in FIG. 24, adhesive applicator assembly 1326 also includes adhesive applicator guide rails 1330 configured to maintain alignment of a blank 20 during the adhesive application process and/or as the blank is transferred from the mandrel pre-fold section 1300 to the mandrel wrap section 1400. Adhesive applicator guide rails 1330 are positioned adjacent mandrel guide rails 1634, 1636, 1638, and 1640, adjustable plates 1606 and 1608, and/or miter plates 1610 and 1612, and extend along the X direction. In operation, adhesive applicator guide rails 1330 engage an exterior surface of one or more panels of blank 20, thereby maintaining alignment of blank 20 against one or more of mandrel guide rails 1634, 1636, 1638, and/or 1640, adjustable plates 1606 and/or 1608, and/or miter plates 1610 and/or 1612. In the example embodiment, adhesive applicator guide rails 1330 are configured to engage an exterior surface of bottom end panels 96 and 102, end panels 28 and 36, and top end panels 94 and 104, as blank 20 is transferred from mandrel pre-fold section 1300 to mandrel wrap section 1400. In additional and/or alternative embodiments, machine 1000 may include guide rails substantially identical to guide rails 1330 positioned along mandrel assembly 1600 at any desired location. For example, in one alternative embodiment, machine 1000 may include guide rails substantially identical to guide rails 1330 positioned above mandrel guide rails and configured to engage an exterior surface second side panel 32.

FIGS. 25-43 illustrate various portions and perspectives of mandrel wrap section 1400, as well as outfeed section 1500 and mandrel assembly 1600. As discussed above, blanks 20 are received in mandrel wrap section 1400 from mandrel pre-fold section 1300 by transfer assembly 1304. Mandrel wrap section 1400 is configured to wrap one or more unfolded portions of blank 20 (generally referred to as a second portion of blank 20) around second mandrel 1604, and to form a container 200 by securing one or more panels of blank 20 together.

Mandrel wrap section 1400 includes second mandrel 1604, a mandrel retention assembly 1402, a wrapping assembly 1404, a bottom folder assembly 1406, a bottom presser assembly 1408, and an ejection assembly 1410.

Referring to FIGS. 16 and 25-27, second mandrel 1604 has an external shape complementary to an internal shape of a second portion of container 200 that is formed at mandrel wrap section 1400. More specifically, referring to FIG. 27, second mandrel 1604 includes a plurality of faces 1660, 1662, 1664, 1666, 1668, 1670, 1672, 1674, and 1676 that substantially correspond to at least some of the panels on blank 20. In the example embodiment, second mandrel 1604 includes top faces 1660 and 1662 that substantially correspond to second side panel 32, side faces 1664 and 1666 that substantially correspond to first end panel 28, bottom faces 1668 and 1670 that substantially corresponds to first side panel 24, a corner face 1672 that substantially corresponds to first corner panel 22 and/or glue panel 38, and side faces 1674 and 1676 that substantially correspond to second end panel 36. Corner face 1672 (interchangeably referred to as miter face) extends from bottom face 1670 at an oblique angle. Any of the mandrel faces can be solid plates, frames, plates including openings defined therein, and/or any other suitable component that provides a face and/or surface configured to enable a container to be formed from a blank as described herein.

In the example embodiment, second mandrel 1604 is a two-piece mandrel. More specifically, second mandrel 1604 includes two interchangeable mandrel plates 1678 and 1680 slidably mounted to frame 1002 by a plurality of bolts (not shown). Mandrel plates 1678 and 1680 define faces 1660, 1662, 1664, 1666, 1668, 1670, 1672, 1674, and 1676 of second mandrel 1604. Specifically, faces 1662, 1664, 1666, 1668 are defined by mandrel plate 1678, and faces 1660, 1670, 1672, 1674, and 1676 are defined by mandrel plate 1680. The two-piece construction of second mandrel 1604 facilitates selectively adjusting the size and/or shape of second mandrel 1604 to accommodate blanks and containers of varying sizes and/or shapes (e.g., four- or six-sided containers).

As shown in FIG. 16, mandrel guide rails 1634, 1636, 1638, and 1640 are extensions of mandrel plates 1678 and 1680. Thus, faces 1660, 1662, 1664, 1666, 1668, 1670, 1672, 1674, and 1676 of second mandrel 1604 at least partially define faces 1644, 1642, 1646, 1650, 1652, 1654, 1656, 1658, and 1648 of mandrel guide rails 1634, 1636, 1638, and 1640, respectively.

In the example embodiment, mandrel plates 1678 and 1680 are constructed from the same low-friction, wear-resistant plastic that miter plates 1610 and 1612 are constructed from to facilitate transferring blanks 20 from first mandrel 1602 to second mandrel 1604. It is understood, however, that mandrel plates 1678 and 1680 may be constructed from any suitable material that enables machine 1000 to function as described herein.

Figure 25:
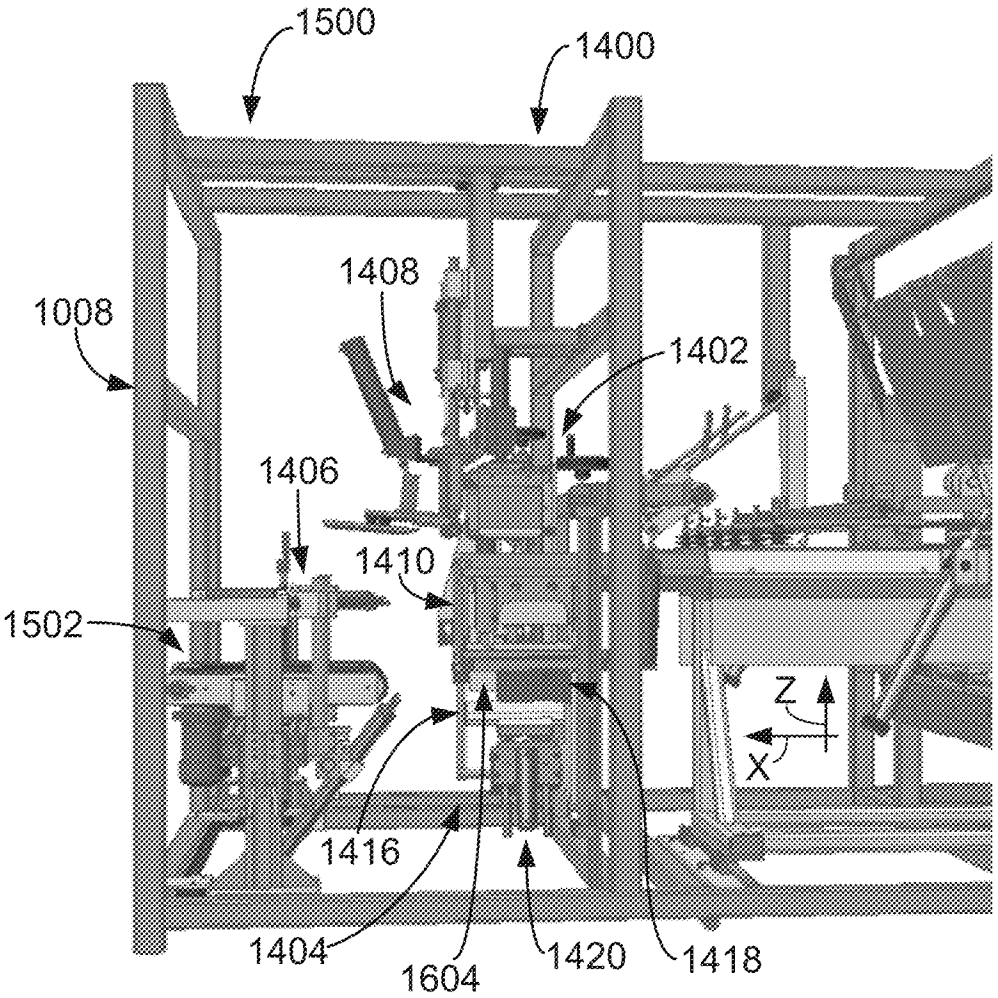
FIG. 25 is a perspective view of an example mandrel wrap section which is included within the machine shown in FIGS. 5-6.
Figure 28:
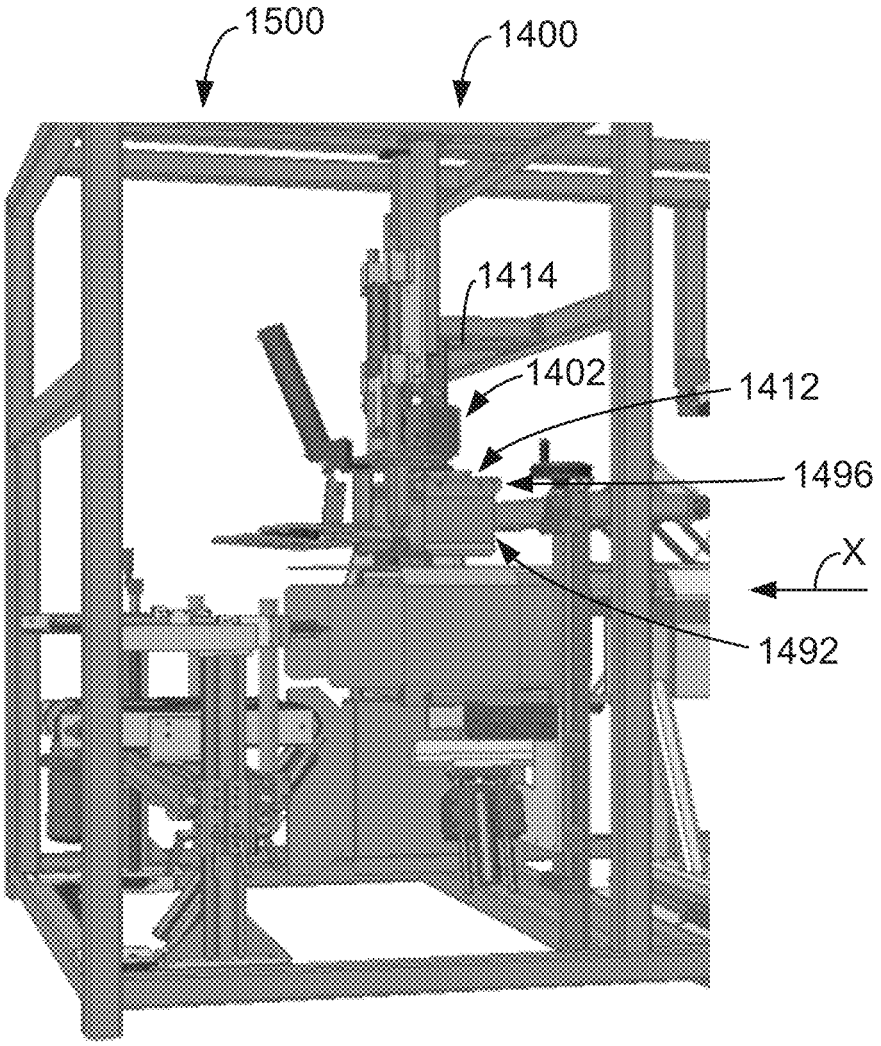
FIG. 28 is a perspective view of a mandrel retention assembly which is part of the mandrel wrap section shown in FIG. 25.
Figure 29:
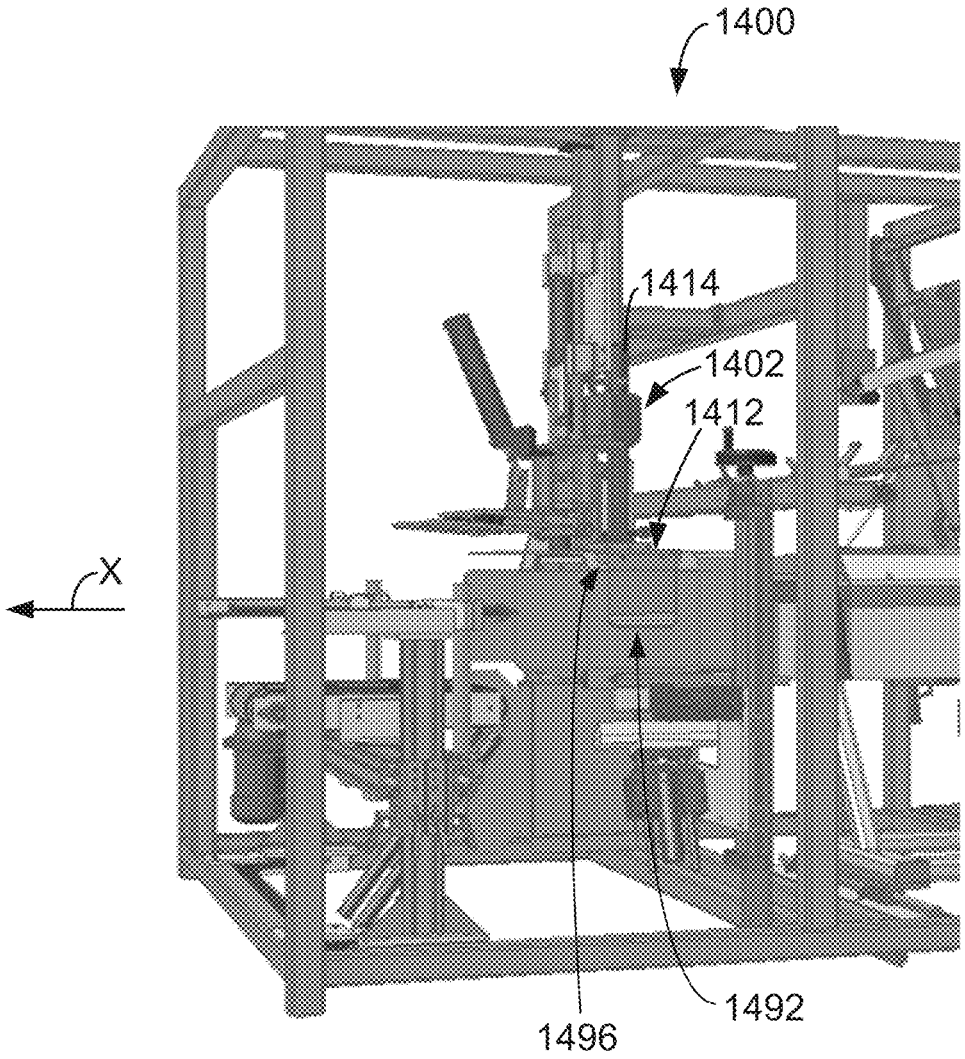
FIG. 29 is another perspective view of the mandrel retention assembly shown in FIG. 28.

Referring to FIGS. 25 and 28-29, mandrel retention assembly 1402 is configured to secure a blank 20 between second mandrel 1604 and mandrel retention assembly 1402 while one or more unfolded portions of blank 20 are wrapped around second mandrel 1604. More specifically, mandrel retention assembly 1402 includes a plate-over tool 1412 having an interior surface shaped complementary to one or more faces 1660, 1662, 1664, 1666, 1668, 1670, 1672, 1674, and/or 1676 of second mandrel 1604. Plate-over tool 1412 is operatively coupled to a linear actuator 1414 configured to move plate-over tool 1412 from a first, generally raised position (shown in FIG. 28) vertically downward to a second, generally lowered position (shown in FIG. 29). As shown in FIG. 29, when plate-over tool 1412 is in the second position, the interior surface of plate-over tool 1412 engages one or more panels of blank 20, and thereby secures blank 20 between second mandrel 1604 and plate-over tool 1412. In the example embodiment, plate-over tool 1412 includes side locking panels 1490 and 1492 and miter bars 1494 and 1496 (also seen in FIG. 42) configured to engage first end panel 28 and second end panel 36, and third corner panel 30 and fourth corner panel 34, respectively. Side locking panels 1490 and 1492 are obliquely angled towards one another such that when plate-over tool 1412 is moved to the second position, side locking panels 1490 and 1492 press first end panel 28 and second end panel 36 against second mandrel 1604, and cause third corner panel 30 and fourth corner panel 34 to become aligned with miter bars 1494 and 1496 before miter bars 1494 and 1496 engage third corner panel 30 and fourth corner panel 34. Plate-over tool 1412 is removably coupled within mandrel retention assembly 1402 such that plate-over tool 1412 may be interchanged with plate-over tools having interior surfaces of different sizes and/or shapes to accommodate blanks of varying sizes and/or shapes. Further, miter bars 1494 and 1496 are removably coupled within plate-over tool 1412 such that miter bars 1494 and 1496 may be selectively removed (e.g., when forming a container without corner or miter panels).

In operation, plate-over tool 1412 is initially positioned in the first, raised position as a blank 20 is transferred from mandrel pre-fold section 1300 to mandrel wrap section 1400. After blank is stopped within mandrel wrap section 1400, linear actuator 1414 actuates, thereby moving plate-over tool 1412 vertically downward from the first position to the second position. Plate-over tool 1412 is held in the second position while a second portion of blank 20 is wrapped around second mandrel 1604 and/or while container 200 is formed. After the second portion of blank 20 is wrapped around second mandrel 1604 and before ejector assembly 1410 ejects formed container 200 from mandrel wrap section 1400 (described below), linear actuator 1414 reverses direction and raises plate-over tool 1412 from the second position to the first position. In the example embodiment, plate-over tool 1412 is raised after a manufacturing joint is formed and before the bottom wall 222 of container 200 is formed.

Referring to FIGS. 25-26 and 30-37, wrapping assembly 1404 is positioned adjacent second mandrel 1604, and is configured to wrap one or more unfolded portions of blank 20 under and/or around second mandrel 1604. Wrapping assembly 1404 includes a fold-under assembly 1416, a glue panel folder assembly 1418, and a glue panel presser assembly 1420.

Figure 30:
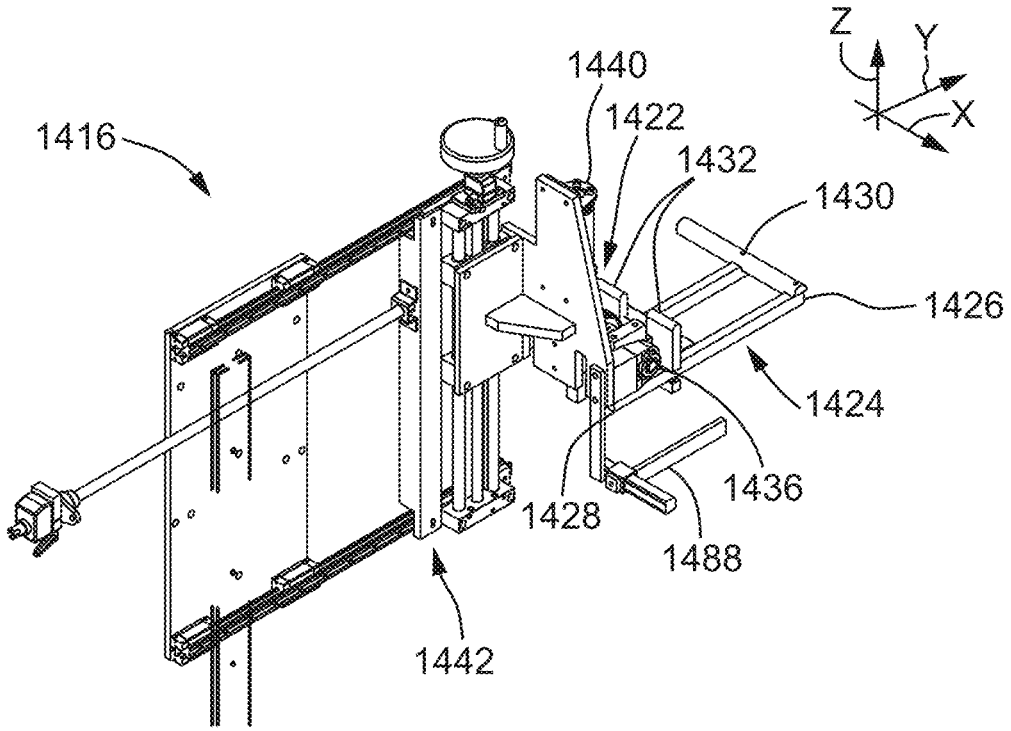
FIG. 30 is a perspective view of an example fold-under assembly which is part of the mandrel wrap section shown in FIG. 25.
Figure 31:
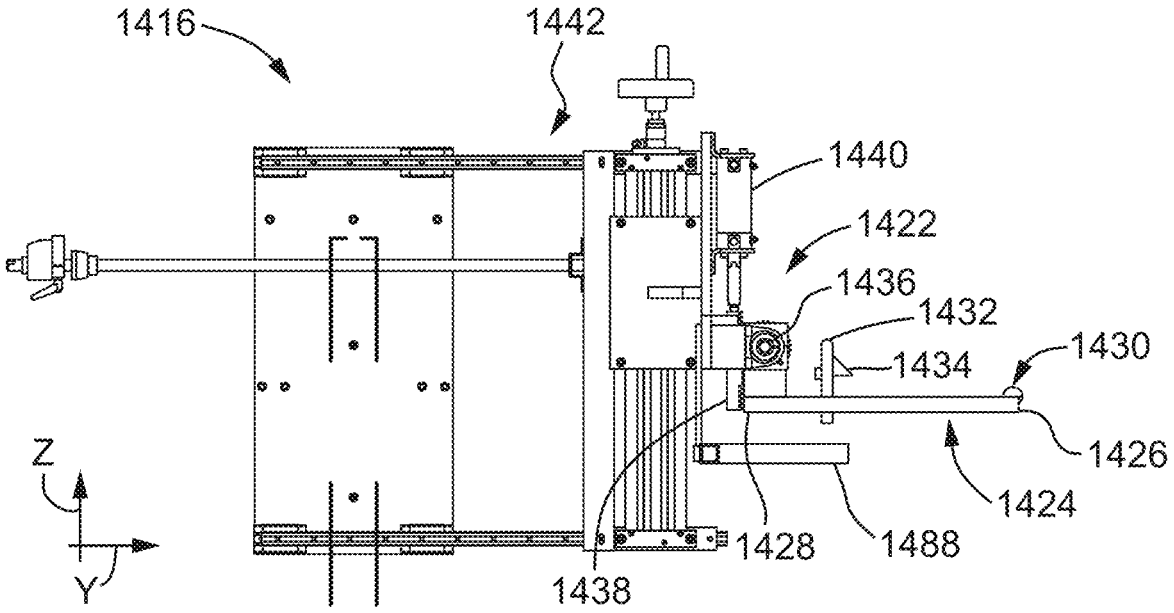
FIG. 31 is a side plan view of the fold-under assembly shown in FIG. 30.

As shown in FIGS. 30-31, fold-under assembly 1416 includes a rotary drive mechanism 1422 and a folding arm 1424 having opposing first and second ends 1426 and 1428, an engaging bar 1430 disposed at first end 1426, squaring bars 1432 disposed between first and second ends 1426 and 1428, and miter bars 1434 disposed between first and second ends 1426 and 1428. Folding arm 1424 and rotary drive mechanism 1422 are configured to wrap a second portion of blank 20 around second mandrel 1604. More specifically, engaging bar 1430 is configured to contact a second portion of a partially folded blank 20 to wrap blank 20 about second mandrel 1604 as folding arm 1424 is rotated by rotary drive mechanism 1422. In the example embodiment, engaging bar 1430 is configured to contact one or more of first side panel 24 and/or first corner panel 22. Miter bars 1434 are configured to contact second corner panel 26 to position second corner panel 26 adjacent and/or against side face 1666 and/or bottom face 1668 of second mandrel 1604 as folding arm 1424 is rotated by rotary drive mechanism 1422. Squaring bar 1432 is configured to contact first end panel 28 adjacent fold line 44 to facilitate aligning and folding panels 26 and 28 against second mandrel 1604 as the second portion of blank 20 is wrapped about second mandrel 1604. One or more of folding arm 1424, engaging bar 1430, squaring bar 1432, and/or miter bar 1434 may be detachably coupled within fold-under assembly 1416 such that the components of fold-under assembly 1416 may be interchanged with other components to accommodate blanks of varying sizes and/or shapes. Moreover, the position of engaging bar 1430, squaring bar 1432, and/or miter bar 1434 may be adjusted with respect to one another and/or with respect to ends 1426 and 1428 of folding arm 1424 to accommodate blanks of varying sizes and/or shapes.

Folding arm 1424 is coupled to rotary drive mechanism 1422 at second end 1428 such that operation of rotary drive mechanism 1422 causes folding arm 1424 to rotate towards and/or away from bottom faces 1668 of second mandrel 1604. In the example embodiment, rotary drive mechanism 1422 is a rack-and-pinion drive system including a pinion gear 1436 operatively coupled to a rack 1438, which is in turn operatively coupled to a linear actuator 1440 (e.g., a pneumatic cylinder).

Fold-under assembly 1416 is mounted to a bi-directional positioning system 1442 configured to permit manual adjustment of the position of fold-under assembly 1416 with respect to second mandrel 1604. Bi-directional positioning system 1442 is configured to permit movement of fold-under assembly 1416 in a plane substantially perpendicular to the X direction, defined by the transverse direction Y and a vertical direction indicated by an arrow Z. That is, bi-directional positioning system 1442 permits fold-under assembly 1416 to be moved laterally towards and away from one or more of side faces 1664, 1666, 1674 and/or 1676, and upwards and downwards with respect to second mandrel 1604.

In operation, folding arm 1424 is initially positioned in a first, generally down position (shown in FIGS. 30 and 31). After a blank 20 is positioned on second mandrel 1604, rotary drive mechanism 1422 activates and rotates folding arm 1424 towards bottom faces 1668 and 1670 of second mandrel 1604 into a second, general up position (shown in FIG. 32). As folding arm 1424 rotates towards bottom faces 1668 and 1670, engaging bar 1430 contacts the second portion of blank, and folds the second portion about second mandrel 1604 until one or more panels of blank 20 is adjacent and/or against a corresponding face of second mandrel 1604. Also, as folding arm 1424 rotates towards the second position, squaring bar 1432 and miter bar 1434 contact an end panel and a corner of blank 20, respectively, and position the end panel and corner panel adjacent and/or against side face 1666 and bottom face 1668 of second mandrel 1604, respectively. Rotary drive mechanism 1422 then reverses direction and rotates folding arm 1424 back into the first position to repeat the fold-under process for subsequent blanks 20. In the example embodiment, folding arm 1424 is held in the second position while a manufacturing joint is formed by glue panel folder assembly 1418 and glue panel presser assembly 1420, described in more detail below.

In the example embodiment, folding arm 1424 also includes a stopper 1488. Stopper 1488 is configured to stop motion of blank 20 in the X direction resulting from operation of transfer assembly 1304. More specifically, stopper 1488 is configured to engage a leading edge 128 (shown in FIG. 1) of one or more bottom panels 62, 68, 96 and/or 102 to stop motion of blank 20 in the X direction. Stopper 1488 is positioned adjacent mandrel wrap section 1400 such that blank 20 is stopped within mandrel wrap section 1400. In the example embodiment, stopper 1488 is a stationary bar. Stopper 1488 is configured to engage a leading edge 128 of a panel, such as first bottom side panel 62, that is subsequently wrapped around second mandrel 1604 such that stopper 1488 does not impede motion of blank 20 in the X direction after blank 20 is wrapped around second mandrel 1604 in mandrel wrap section 1400. In alternative embodiments, stopper 1488 may be retractable from a first, extended position to a second, retracted position. In such embodiments, stopper 1488 may be initially positioned in the first, extended position to stop a blank 20 as blank 20 moves in the X direction. Once stopper 1488 stops blank 20, stopper may be retracted to the second, retracted position to permit blank 20 to move in the X direction after blank 20 is wrapped around second mandrel 1604 in the mandrel wrap section 1400. In yet further alternative embodiments, stopper 1488 may be operable to move between the first position and the second position by any suitable means (e.g., rotation) that enables stopper 1488 to function as described herein. In yet further alternative embodiments, stopper 1488 may be included within transfer assembly 1304.

Referring to FIGS. 25-26 and 33-37, glue panel folder assembly 1418 and glue panel presser assembly 1420 are configured to fold a second portion of blank 20 about second mandrel 1604, and form a manufacturer joint of container 200. Thus, glue panel folder assembly 1418 and glue panel presser assembly 1420 are positioned opposite fold-under assembly 1416 with respect to second mandrel 1604. In the example embodiment, glue panel folder assembly 1418 and glue panel presser assembly 1420 are positioned adjacent corner face 1672 of second mandrel 1604.

Glue panel folder assembly 1418 includes an angled plate 1444 having a face 1446 substantially parallel to corner face 1672 of second mandrel 1604. Angled plate 1444 is operatively coupled to a linear actuator 1448 via mounting plate 1450 that moves angled plate 1444 toward and away from second mandrel 1604. Angled plate 1444 is configured to contact and/or fold glue panel 38 during formation of container 200. In the example embodiment, angled plate 1444 is configured to rotate glue panel 38 about fold line 54 towards and/or into contact with corner face 1672. Glue panel presser assembly 1420 includes a presser plate 1452 having a pressing surface 1454 substantially parallel to corner face 1672 of second mandrel 1604. Presser plate 1452 is coupled to a linear actuator 1456 via a mounting plate 1458 that moves presser plate 1452 toward and away from second mandrel 1604. Presser plate 1452 is configured to contact and/or fold first corner panel 22 and/or glue panel 38 to form container 200. In the example embodiment, presser plate 1452 is configured to press first corner panel 22 and glue panel 38 together against corner face 1672 of second mandrel 1604 to form a manufacturing joint at first corner wall 204 of container 200.

Glue panel folder assembly 1418 and glue panel presser assembly 1420 are each adjustably coupled to a rail system 1460 such that glue panel folder assembly 1418 and glue panel presser assembly 1420 can be adjusted in the vertical direction Z to accommodate blanks having different sizes and/or shapes.

Figure 35:
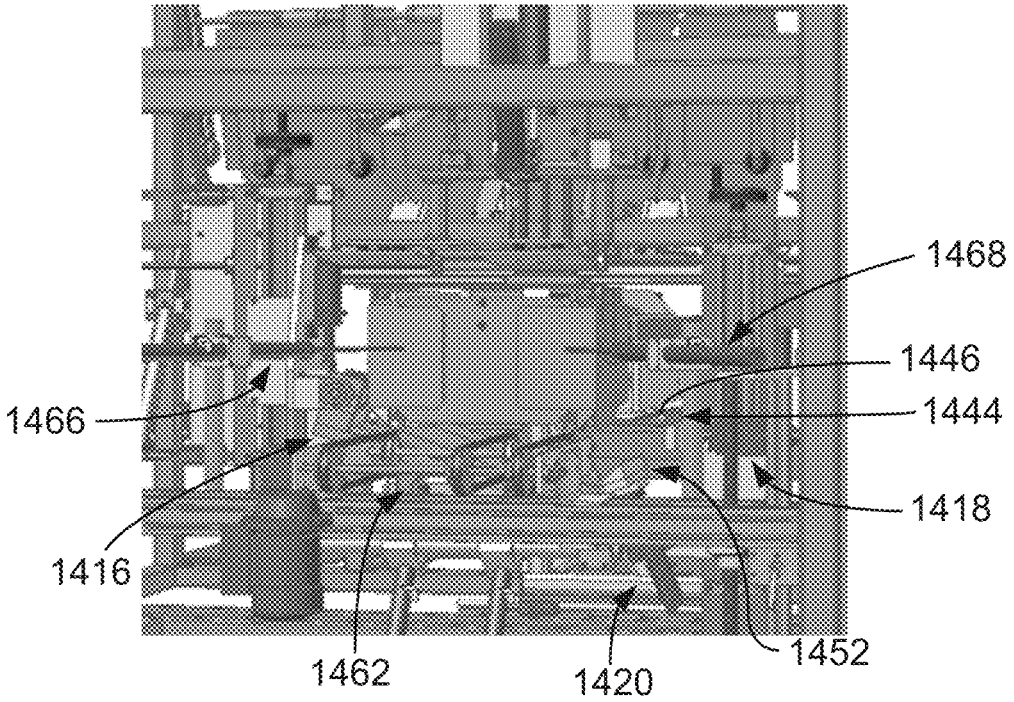
FIG. 35 is a perspective view of the glue panel folder assembly and the glue panel presser assembly shown in FIG. 33, and an example bottom folder assembly which is part of the mandrel wrap section shown in FIG. 25.

In operation, angled plate 1444 and presser plate 1452 are each initially positioned in a respective first position (shown in FIG. 35). As folding arm 1424 is rotated by rotary drive mechanism 1422 and the second portion of blank 20 is folded about second mandrel 1604, linear actuator 1448 moves angled plate 1444 from the first position towards corner face 1672 of second mandrel 1604 and into a second position (shown in FIG. 36). As angled plate 1444 moves towards the second position, angled face 1446 contacts a corner panel of blank 20 and positions the corner panel adjacent and/or in contact with corner face 1672. In the example embodiment, angled plate 1444 contacts and folds first corner panel 22 around second mandrel 1604 about fold line 40.

Figure 37:
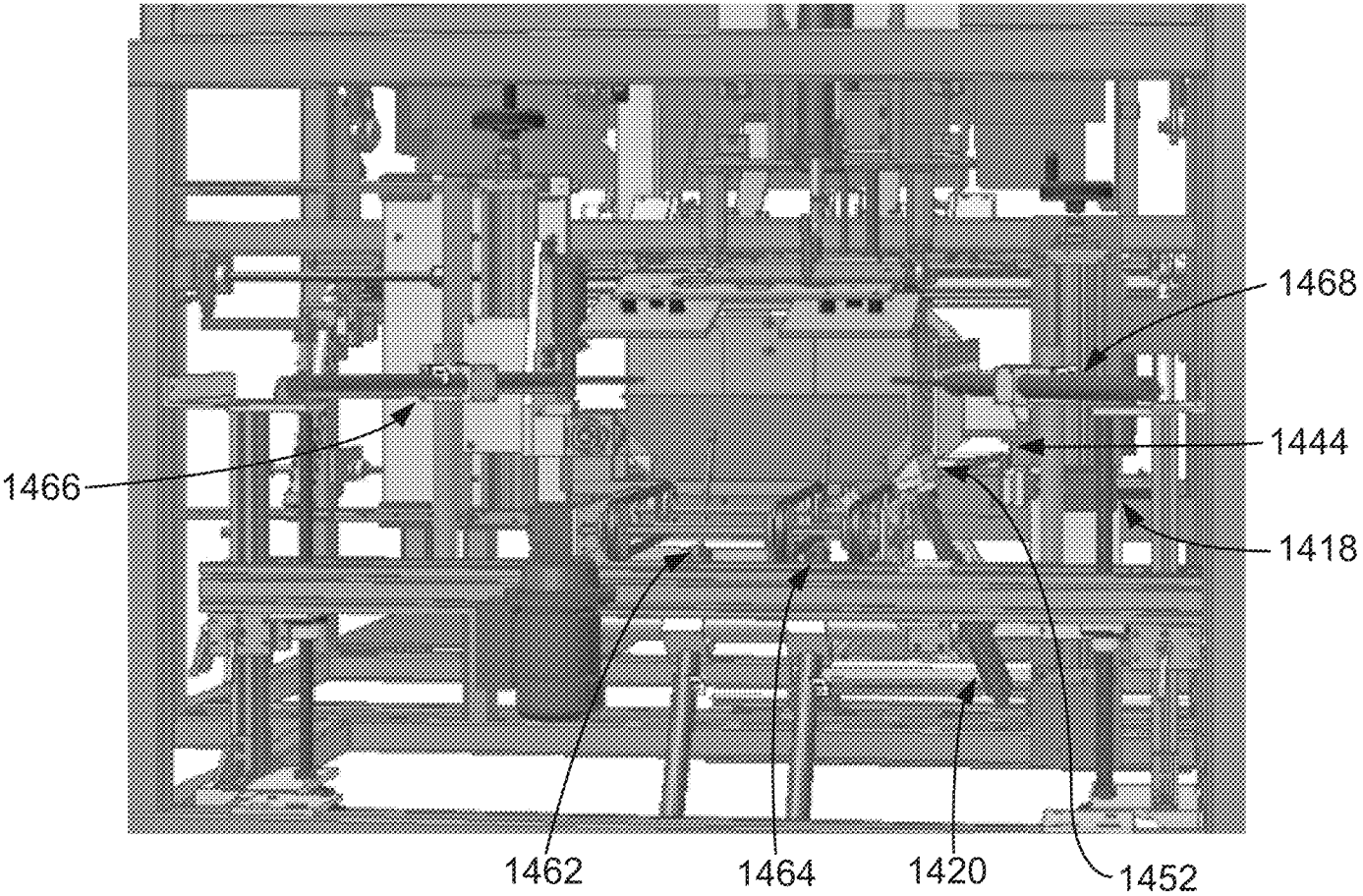
FIG. 37 is another perspective view of the glue panel folder assembly, the glue panel presser assembly, and the bottom folder assembly shown in FIG. 35.

While angled plate 1444 is in the second position, linear actuator 1456 activates and begins moving presser plate 1452 from the first position towards corner face 1672 of second mandrel 1604 and into a second position (shown in FIG. 37). As presser plate 1452 moves toward the second position, linear actuator 1448 reverses direction and moves angled plate 1444 from the second position back into the first position. Also, as presser plate 1452 moves toward the second position, presser plate 1452 contacts a corner panel of blank 20 and presses the corner panel together with another corner panel of blank 20 against corner face 1672 of second mandrel 1604.

In the example embodiment, presser plate 1452 contacts and folds glue panel 38 around second mandrel 1604 about fold line 54. Presser plate 1452 presses first corner panel 22 and glue panel 38 together against corner face 1672 of second mandrel 1604. Presser plate 1452 is held against panels 22 and 38 for a predetermined time period and/or duration to ensure that adhesive bonds panels 22 and 38 together. Accordingly, fold-under assembly 1416, glue panel folder assembly 1418, and glue panel presser assembly 1420 cooperate to fold blank 20 along fold lines 40, 42, 44, and 54 to form container 200.

Referring to FIGS. 25-26 and 35-40, bottom folder assembly 1406 is positioned downstream from second mandrel 1604, and is configured to fold one or more bottom panels 62, 68, 96 and/or 102 of blank 20 about second mandrel 1604. Bottom folder assembly 1406 includes a pair of side panel bullet arms 1462 and 1464 configured to fold a bottom side panel 62 or 68 of blank 20 about second mandrel 1604, and a pair of end panel bullet arms 1466 and 1468 configured to fold bottom end panels 96 and 102 of blank 20 about second mandrel 1604, respectively.

Figure 38:
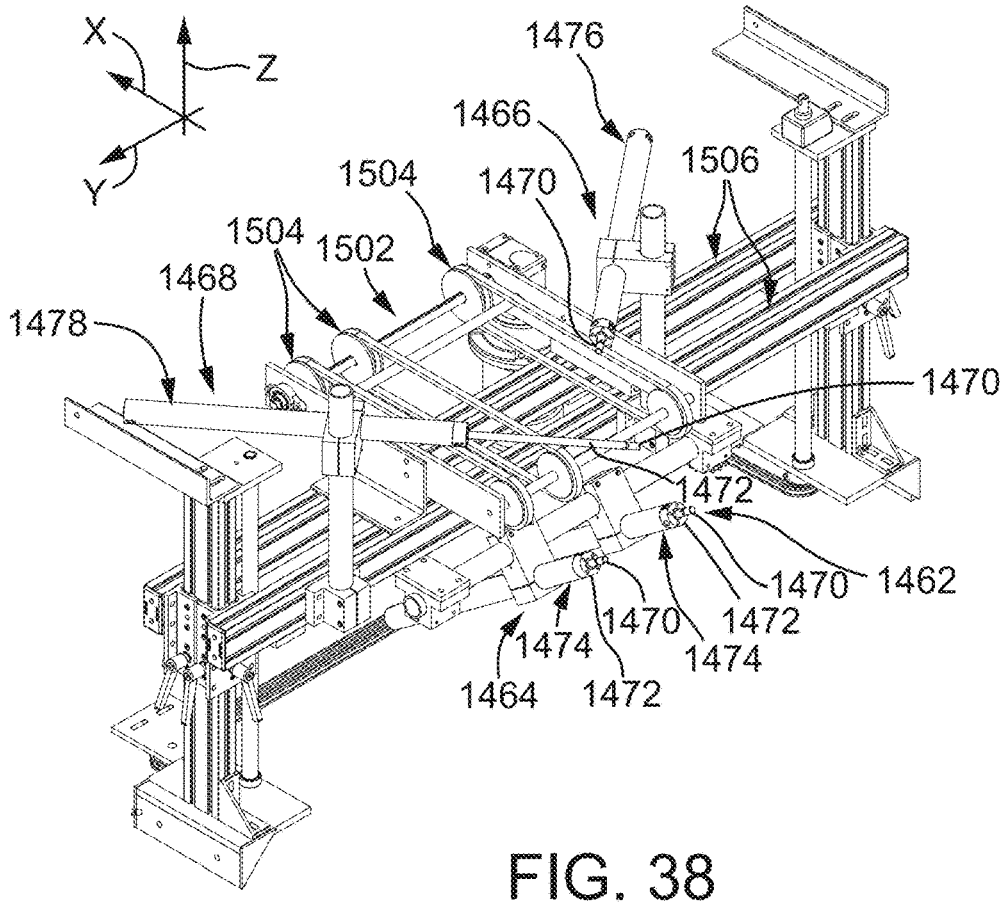
FIG. 38 is a perspective view of the bottom folder assembly shown in FIG. 35 and an example conveyor assembly which is included within the machine shown in FIGS. 5-6.
Figure 39:
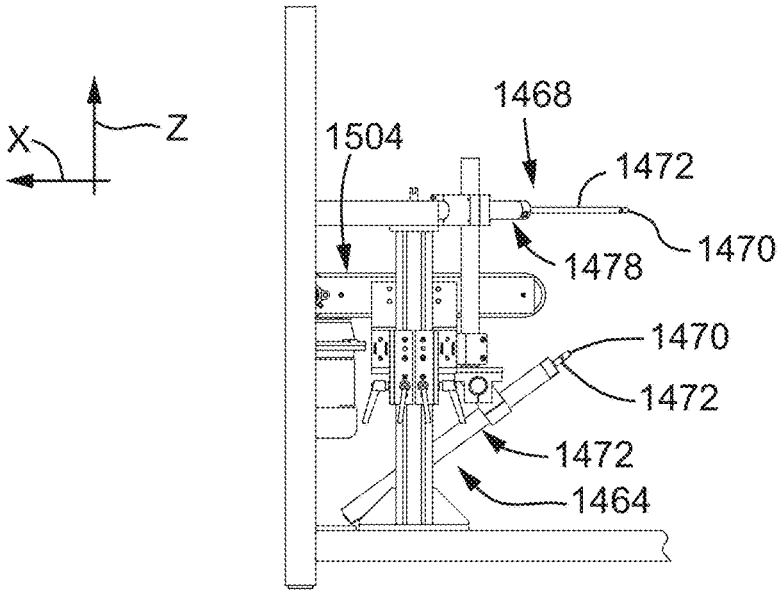
FIG. 39 is a side plan view of the bottom folder assembly and the conveyor assembly shown in FIG. 38.
Figure 40:
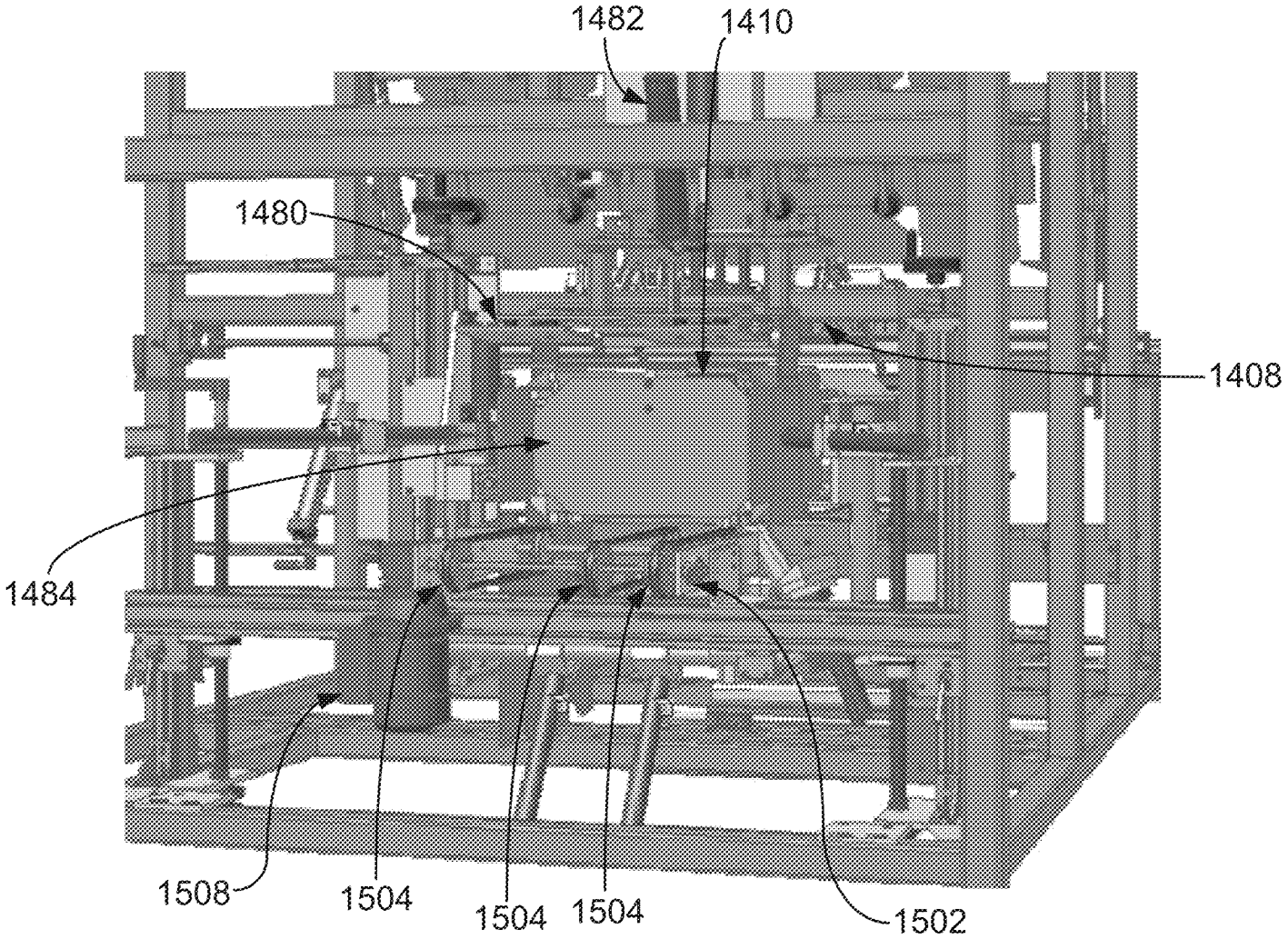
FIG. 40 is a perspective view of an example bottom presser assembly, a portion of an example ejection assembly, and a conveyor assembly which are part of the machine shown in FIGS. 5-6.
Figure 41:
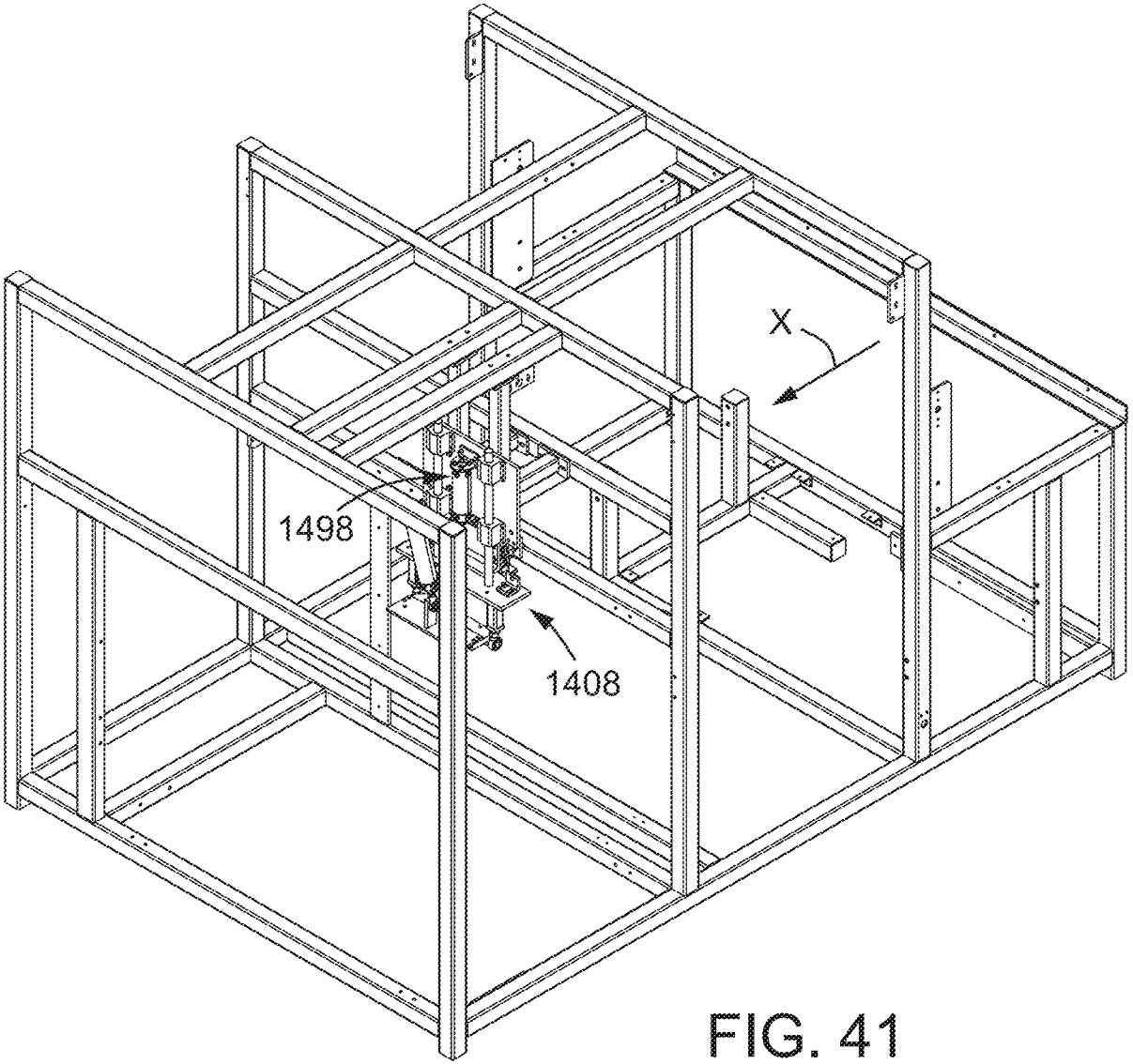
FIG. 41 is a perspective view of a portion of the bottom presser shown in FIG. 40.

As shown in FIGS. 38-39, each side panel bullet arm 1462 and 1464 includes a tip 1470 and a shaft 1472 operatively coupled to a linear actuator 1474. Side panel bullet arms 1462 and 1464 are obliquely angled with respect to bottom faces 1668 and 1670 of second mandrel 1604 such that operation of linear actuators 1474 causes tips 1470 to move towards second mandrel 1604 and fold a bottom side panel 62 or 68 around second mandrel 1604 about fold line 66 or 72. In the example embodiment, side panel bullet arms 1462 and 1464 are configured to fold first bottom side panel 62 about fold line 66.

Each end panel bullet arm 1466 and 1468 includes a tip 1470 and a shaft 1472 similar to tips 1470 and shafts 1472 of side panel bullet arms 1462 and 1464. Shafts 1472 of end panel bullet arms 1466 and 1468 are operatively coupled to linear actuators 1476 and 1478, respectively. End panel bullet arms 1466 and 1468 are obliquely angled with respect to side faces 1664, 1666, 1674, and 1676 of second mandrel 1604. Further, end panel bullet arms 1466 and 1468 are angled with respect to one another such that operation of linear actuator 1476 causes tip 1470 of end panel bullet arm 1466 to move towards second mandrel 1604 and fold bottom end panel 96 around second mandrel 1604 about fold line 100, and operation of linear actuator 1478 causes tip 1470 of end panel bullet arm 1468 to move towards second mandrel 1604 and fold bottom end panel 102 around second mandrel 1604 about fold line 106.

Referring to FIGS. 25-26 and 40-42, bottom presser assembly 1408 is positioned above second mandrel 1604, and is configured to form bottom wall of container 200. More specifically, bottom presser assembly 1408 includes an upper plate 1480 configured to press bottom panels 62, 68, 96, and/or 102 together to form bottom wall 222 of container 200. Upper plate 1480 is pivotably mounted to a linear actuator 1482, the operation of which causes upper plate 1480 to rotate between a first, generally flat position (shown in FIG. 40) and a second, generally vertical position (shown in FIG. 42). Upper plate 1480 is configured to lay flat in the first position and rotate toward second mandrel 1604 to the second position. When upper plate 1480 is in the first position, container 200 can be ejected from second mandrel 1604 beneath upper plate 1480 to outfeed section 1500, described in more detail below. When upper plate 1480 is in the second position, upper plate 1480 compresses bottom panels 62, 68, 96, and/or 102 together.

As upper plate 1480 rotates toward the second position, upper plate 1480 contacts one or more of bottom panels 62, 68, 96, and 102 of blank 20, and presses bottom panels 62, 68, 96, and 102 of blank 20 together to form bottom wall 222 of container 200. In the example embodiment, upper plate also folds first and second bottom side panels 62 and 68 about fold lines 66 and 72, respectively, as upper plate 1480 moves from the first position to the second position. In the example embodiment, upper plate 1480 includes separate plate sections which may be interchanged with other plate sections to accommodate blanks having different sizes and/or shapes.

To facilitate adjusting and interchanging elements of second mandrel assembly 1604, and cleaning and/or clearing debris from machine 1000, mandrel retention assembly 1402 and bottom presser assembly 1408 are operatively mounted to a linear actuator 1498 (shown in FIGS. 41 and 43) configured to raise and lower both mandrel retention assembly 1402 and bottom presser assembly 1408. Specifically, mandrel retention assembly 1402 and bottom presser assembly 1408 may be raised from a lowered, operational position to a raised, standby position using linear actuator 1498 such that a user (not shown) may access second mandrel 1604 to adjust and/or interchange components of second mandrel 1604, and clean and/or clear debris from machine 1000. A locking pin (not shown) may also be provided to secure mandrel retention assembly 1402 and bottom presser assembly 1408 in the raised, standby position.

In the example embodiment, bottom folder assembly 1406 and bottom presser assembly 1408 are illustrated as two separate assemblies. In alternative embodiments, bottom folder assembly 1406 and bottom presser assembly 1408 may be integrated into a single bottom forming assembly (not shown) that is configured to perform all of the functions and operations of bottom folder assembly 1406 and bottom presser assembly 1408.

Figure 43:
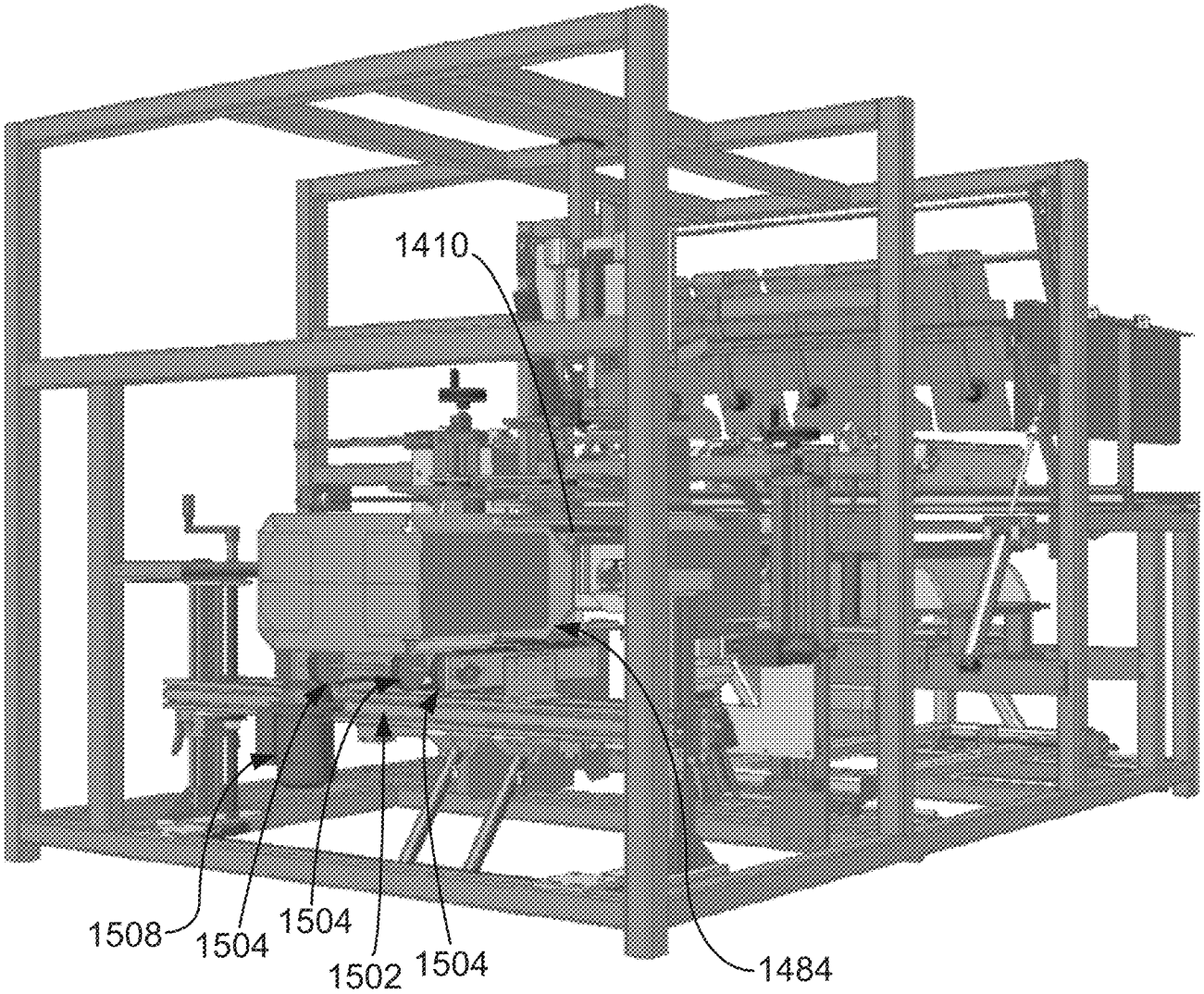
FIG. 43 is a perspective view of the ejection assembly shown in FIG. 40 illustrating an example ejection plate of the ejection assembly in an extended position.

Ejection assembly 1410 includes an ejection plate 1484 moveable from a first position within second mandrel 1604 (shown in FIG. 40) to a second, generally extended position downstream from second mandrel 1604 (shown in FIG. 43). When ejection plate 1484 is at the first position, bottom folder assembly 1406 and bottom presser assembly 1408 fold and/or press bottom panels 62, 68, 96, and/or 102 against ejection plate 1484 to form bottom wall 222 of container 200. When ejection plate 1484 is at the second position, container 200 is removed from second mandrel 1604. In the example embodiment, ejection plate 1484 is positioned within the second mandrel 1604, and is operatively coupled to a linear actuator 1486 (shown in FIG. 16) positioned within mandrel assembly 1600 upstream from ejection plate 1484.

Referring to FIGS. 25, 38-40, and 42-43, outfeed section 1500 includes a conveyor assembly 1502 that moves containers 200 from mandrel wrap section 1400 toward a product load section (not shown). More specifically, conveyor assembly 1502 includes a plurality of conveyor belts 1504 positioned downstream from mandrel wrap section 1400 such that ejection plate 1484 is above conveyor belts 1504 when ejection plate 1484 is at its second position. Outfeed section 1500 facilitates discharging a formed container 200 from machine 1000. Conveyor belts 1504 are slidably mounted to rails 1506 such that conveyor belts 1504 may be adjusted in the transverse direction Y to accommodate blanks and containers of varying sizes and/or shapes. In the example embodiment, end panel bullet arms 1466 and 1468 are also slidably mounted on rails 1506 such that end panel bullet arms 1466 and 1468 may be adjusted in the transverse direction Y to accommodate blanks and containers of varying sizes and/or shapes. Further, rails 1506 are slidably mounted on a rail system 1510 such that rails 1506 may be selectively adjusted in the vertical direction Z. As a result, the entire conveyor assembly 1502 as well as end panel bullet arms 1466 and 1468 may be adjusted in the vertical direction to accommodate blanks and containers of varying sizes and/or shapes.

In the example embodiment, conveyor assembly 1502 is operatively coupled to a drive mechanism 1508 configured to continuously drive conveyor belts 1504 while machine 1000 is forming containers 200. In alternative embodiments, conveyor assembly 1502 may include a servomechanism (not shown) configured to remove container 200 from machine 1000 at a predetermined speed and timing. In such embodiments, conveyor assembly 1502 may be servo-controlled in synchronism with ejection plate 1484 such that conveyor belts 1504 are only activated when container 200 is being ejected from mandrel wrap section 1400.

Figure 19:
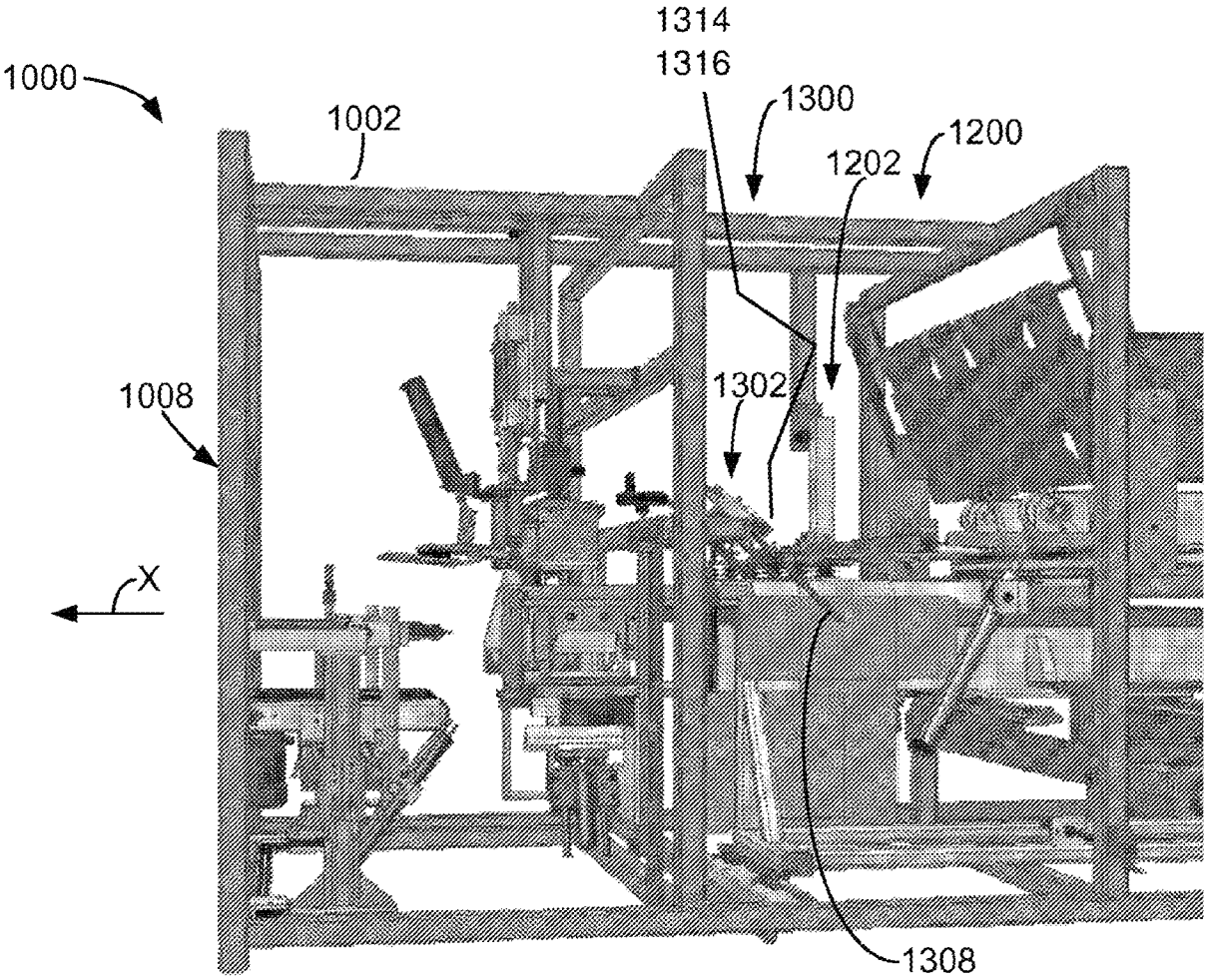
FIG. 19 is another perspective view of the pre-fold section shown in FIGS. 11 and 15.

During operation of machine 1000 to form container 200, blank 20 is positioned over first mandrel 1602 by pick-and-place assembly 1202. Referring to FIGS. 11, 15, and 19, when blank 20 is positioned on top of first mandrel 1602, folding fingers 1306 and 1308 of pre-folding assembly 1302 are rotated from the first position downward relative to blank 20 to the second position by linear actuator 1312. In the example embodiment, folding fingers 1306 and 1308 fold first and second end panels 28 and 36 downward about fold lines 42 and/or 48 and 50 and/or 52, respectively, to be adjacent to and/or in contact with side faces 1618 and 1620 of miter plates 1610 and 1612 and/or side faces 1626 and 1628 of adjustable plates 1606 and 1608, respectively. Folding first and second end panels 28 and 36 also causes third corner panel 30 and fourth corner panel 34 to be folded downward about fold lines 48 and 50, respectively, to be adjacent to and/or in contact with angled faces 1614 and 1616 of miter plates 1610 and 1612.

Transfer assembly 1304 facilitates transfer of partially formed container 200 from mandrel pre-fold section 1300 to mandrel wrap section 1400. More specifically, pusher foot 1322 engages a trailing edge 126 of blank 20 and pushes blank 20 toward mandrel wrap section 1400 along mandrel guide rails 1634, 1636, 1638, and/or 1640. As described above, folding fingers 1306 and 1308 of pre-folding assembly 1302 are held in the second position to facilitate maintaining the alignment of partially formed container 200 as it is transferred from mandrel pre-fold section 1300 to mandrel wrap section 1400.

As blank 20 is transferred from mandrel pre-fold section 1300 to mandrel wrap section 1400, adhesive applicator assembly 1326 applies adhesive to one or more panels of blank 20. In the example embodiment, adhesive applicator assembly 1326 applies adhesive to an exterior surface of bottom end panels 96 and 102, and glue panel 38.

Blank 20 arrives at the mandrel wrap section 1400 as a partially formed container 200. Stopper 1488 facilitates positioning blank 20 within mandrel wrap section 1400 by preventing blank 20 from being pushed by transfer assembly 1304 too far downstream in the X direction. A leading edge 128 of blank 20 contacts stopper 1488, which stops further progress of blank 20 in the X direction.

Referring to FIGS. 28-29, once blank 20 is positioned adjacent second mandrel 1604, plate-over tool 1412 is lowered downwardly relative to blank 20 by linear actuator 1414 to maintain the position and/or alignment of blank 20 while one or more remaining portions of blank 20 are wrapped around second mandrel 1604. In the example embodiment, plate-over tool 1412 engages first end panel 28, second side panel 32, and second end panel 36.

Figure 26:
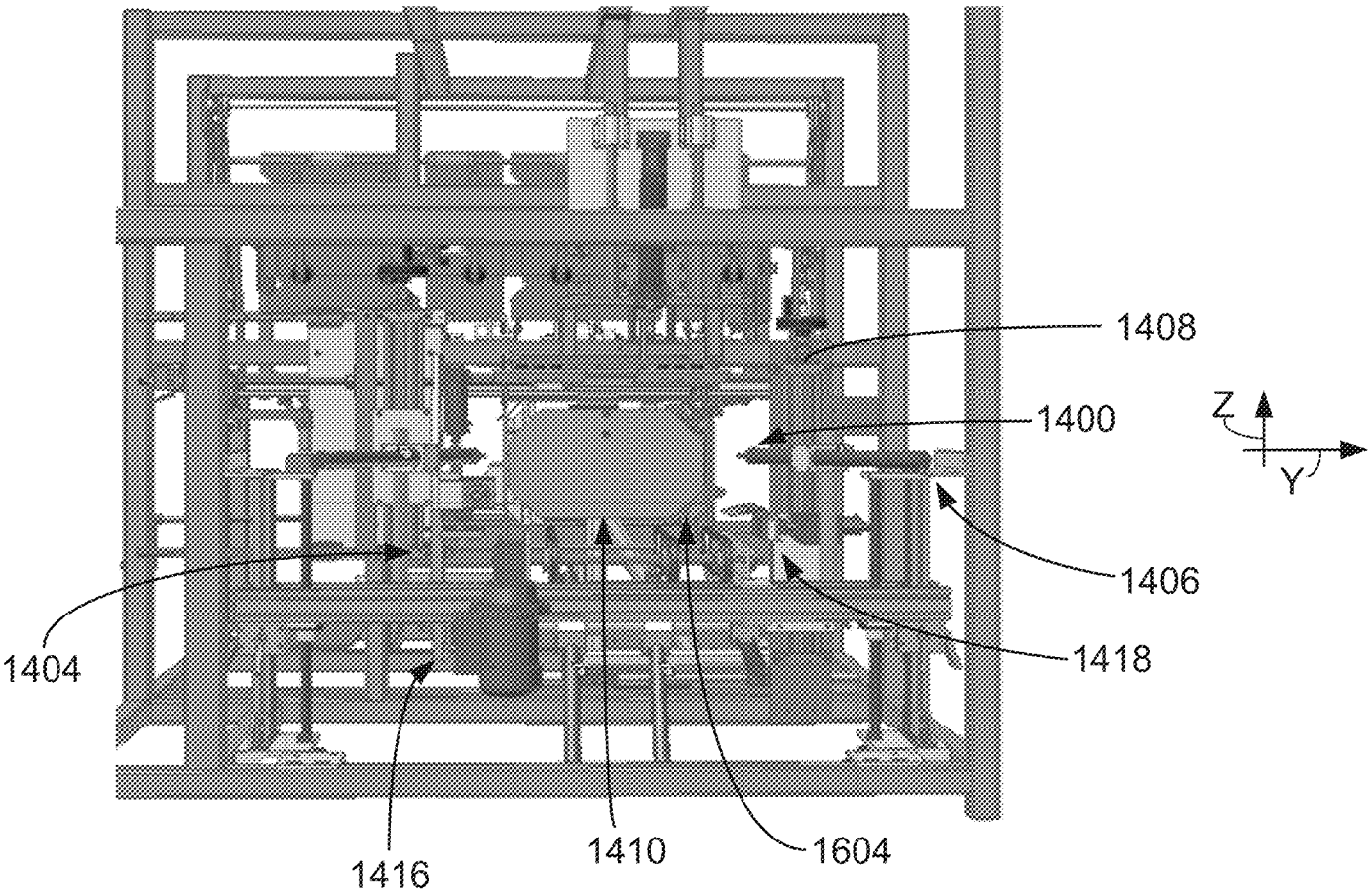
FIG. 26 is another perspective view of the mandrel wrap section shown in FIG. 25.
Figure 27:
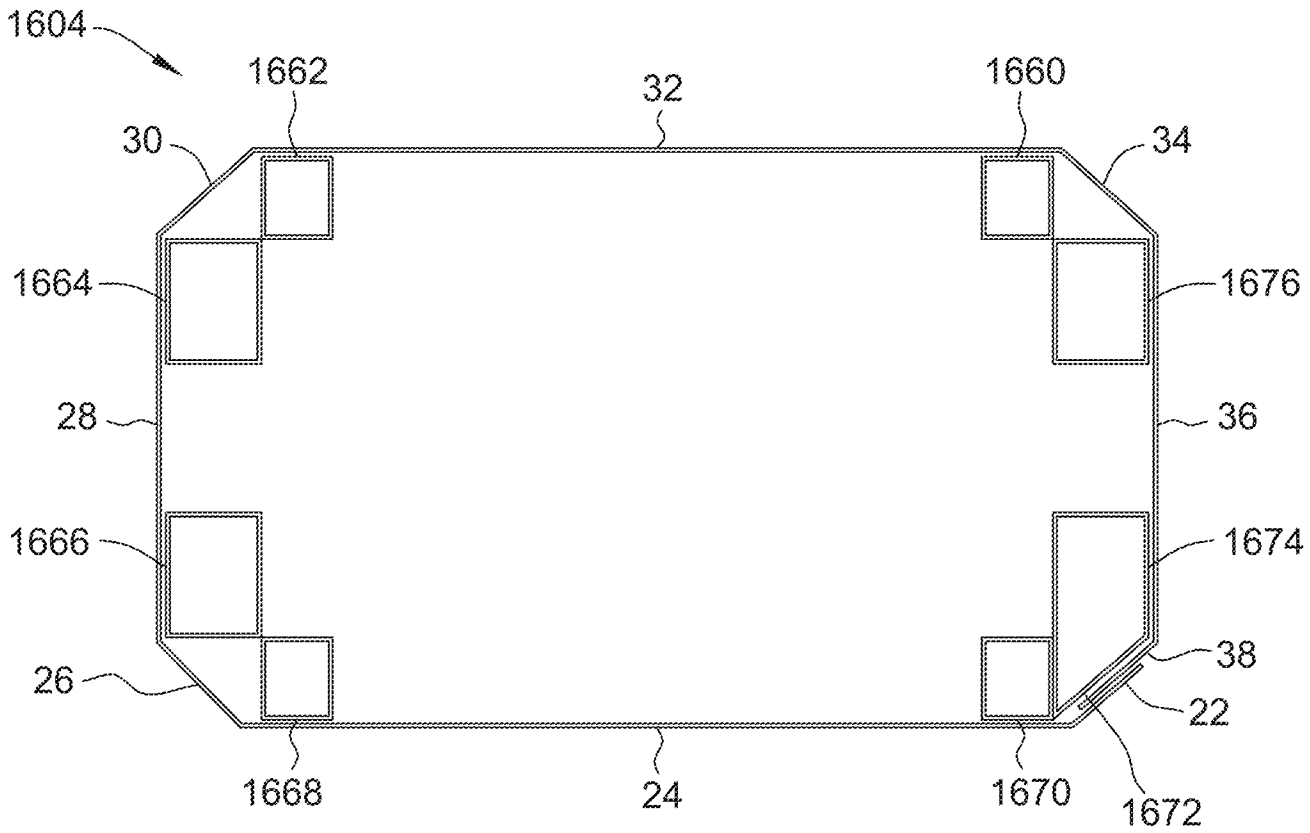
FIG. 27 is a cross-sectional view of a second mandrel which is part of the mandrel assembly shown in FIG. 16 with the blank shown in FIG. 1 wrapped around the second mandrel.
Figure 32:
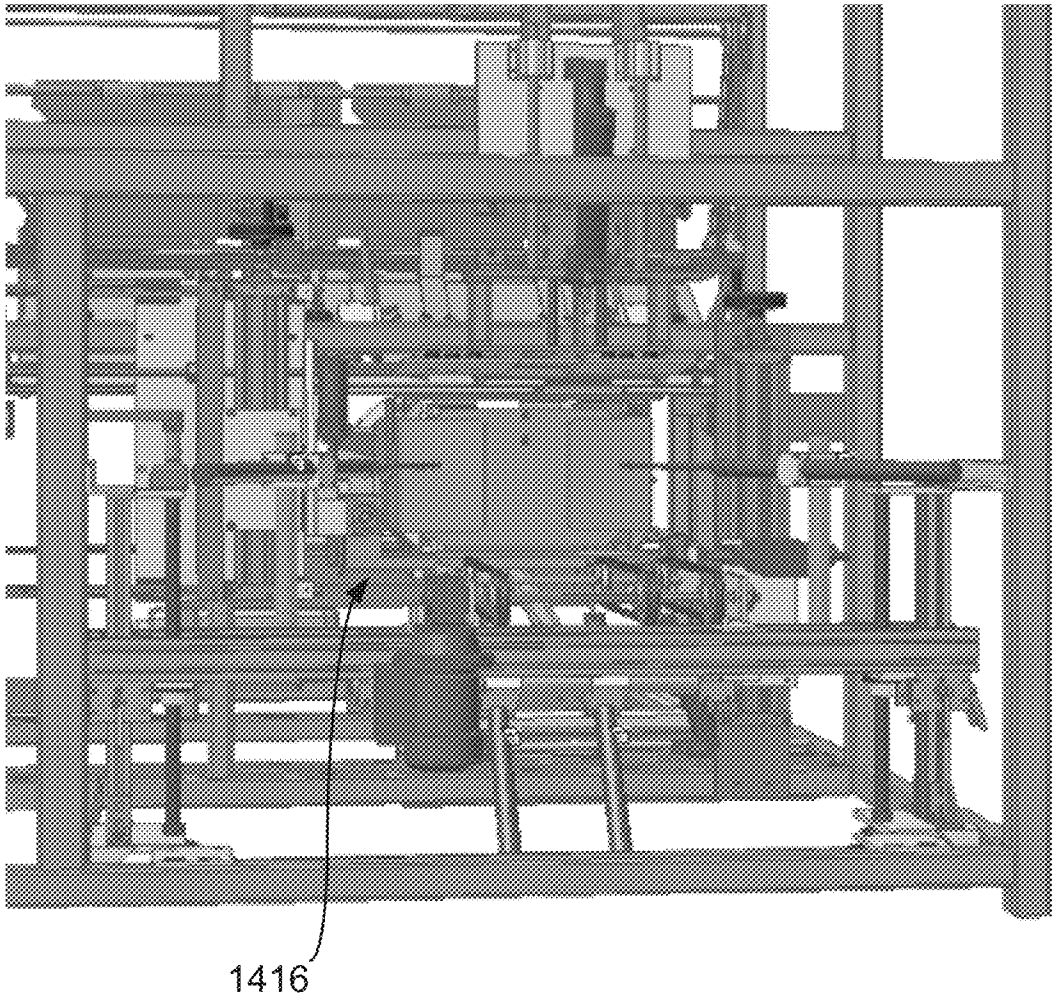
FIG. 32 is another perspective view of the fold-under assembly shown in FIG. 30 illustrating an example folding arm in an up position.
Figure 33:
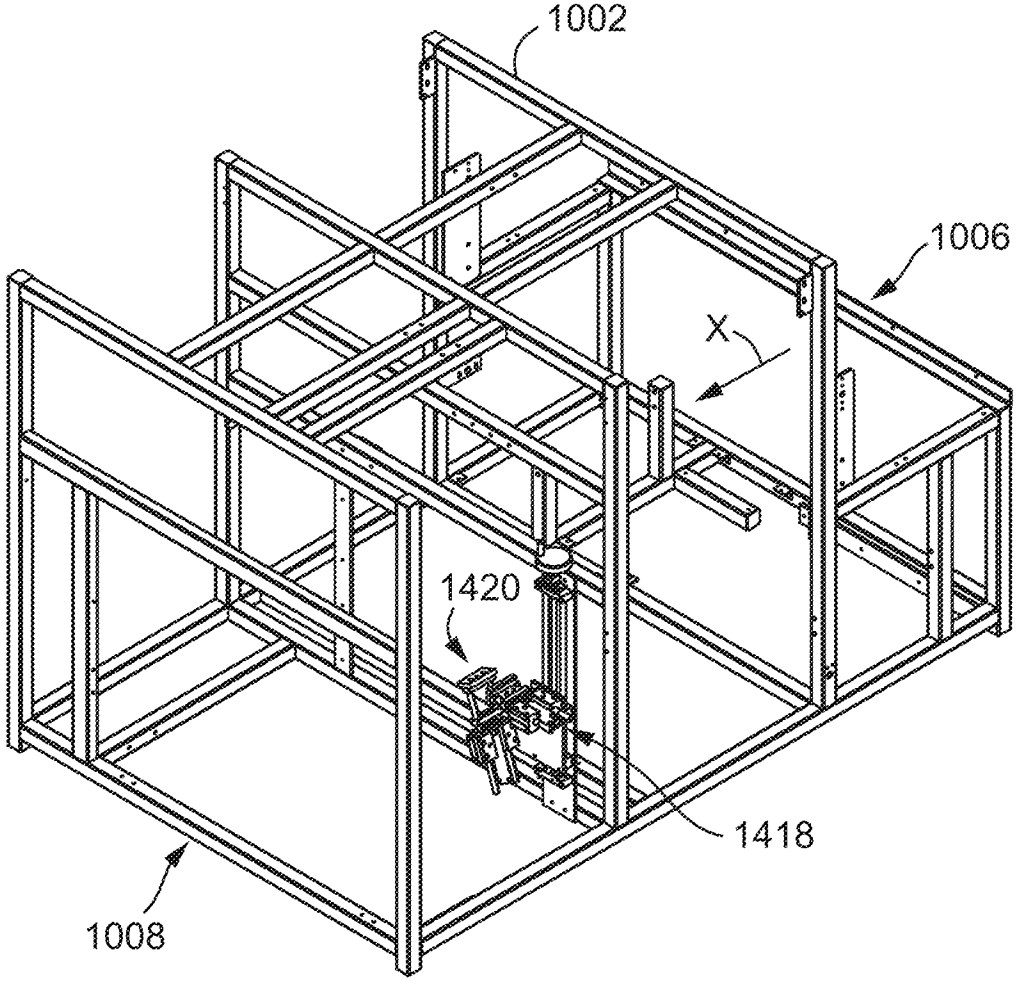
FIG. 33 is a perspective view of an example glue panel folder assembly and an example glue panel presser assembly which are part of the mandrel wrap section shown in FIG. 25.
Figure 34:
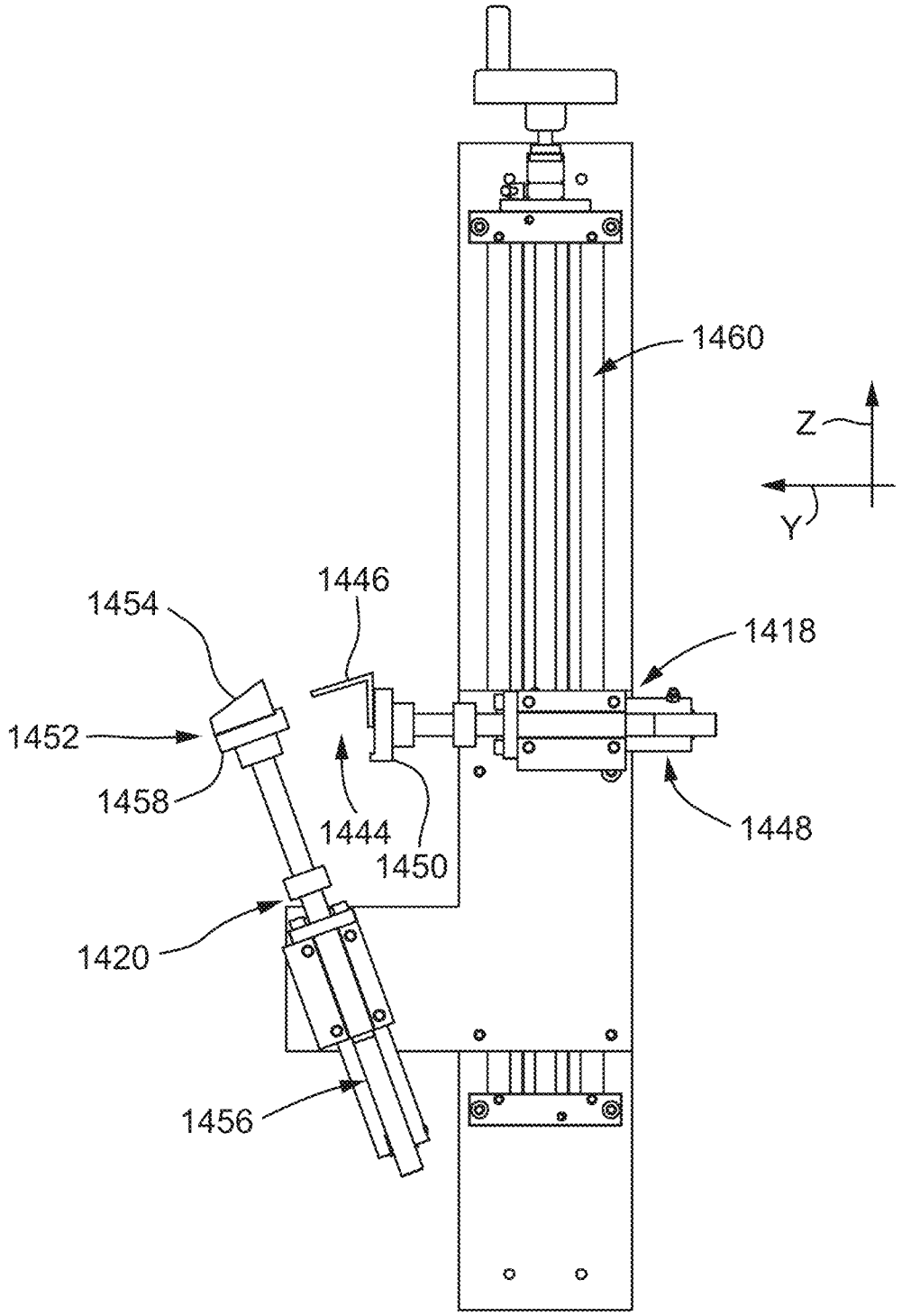
FIG. 34 is a side plan view of the glue panel folder assembly and the glue panel presser assembly shown in FIG. 33.
Figure 36:
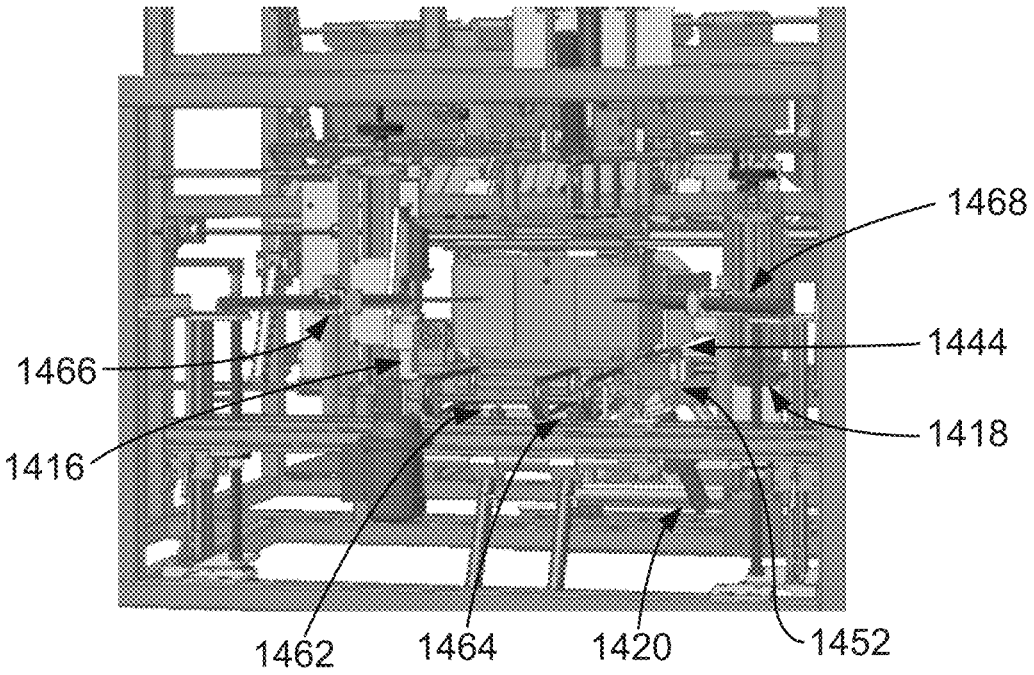
FIG. 36 is another perspective view of the glue panel folder assembly, the glue panel presser assembly, and the bottom folder assembly shown in FIG. 35.

Referring to FIGS. 26 and 32, folding arm 1424 of fold-under assembly 1416 wraps the second portion of blank 20 around second mandrel 1604. More specifically, folding arm 1424 is rotated such that engaging bar 1430, squaring bar 1432, and miter bar 1434 wrap the second portion of blank 20 around second mandrel 1604. Engaging bar 1430 folds first side panel 24 towards bottom faces 1668 and 1670 of second mandrel 1604 about fold lines 42 and/or 44 such that first side panel 24 is in face-to-face contact with bottom faces 1668 and/or 1670 of second mandrel 1604. Squaring bar 1432 and miter bar 1434 and position blank 20 in face-to-face contact with side face 1666 of second mandrel 1604 at panels 26 and/or 28. Referring to FIGS. 35-37, as folding arm 1424 is rotated from the first position to the second position, glue panel folder assembly 1418 is moved towards glue panel 38 to fold glue panel 38 about fold line 54 toward corner face 1672 of second mandrel 1604. In the example embodiment, glue panel folder assembly 1418 folds glue panel 38 in face-to-face contact with corner face 1672 of second mandrel 1604. During and/or after folding of glue panel 38 by glue panel folder assembly 1418, glue panel presser assembly 1420 is moved towards first corner panel 22 and/or glue panel 38, and presses first corner panel 22 and glue panel 38 together to form a manufacturer joint of container 200. Presser plate 1452 of glue panel presser assembly 1420 is held against panels 22 and 38 for a predetermined time period and/or duration to ensure that adhesive bonds panels 22 and 38 together. In the example embodiment, glue panel presser assembly 1420 also folds first corner panel 22 about fold line 40 toward corner face 1672 of second mandrel 1604. Accordingly, fold-under assembly 1416, glue panel folder assembly 1418, and glue panel presser assembly 1420 cooperate to fold blank 20 along fold lines 40, 42, 44, and 54 to form container 200.

Referring to FIGS. 35-37, 40 and 42, before and/or during rotation of folding arm 1424 from the first position to the second position, bottom folder assembly 1406 rotates bottom panels 62, 96, and 102 about fold lines 66, 100, and 106, respectively. More specifically, tips 1470 of end panel bullet arms 1466 and 1468 fold first and second end panels 96 and 102 about fold lines 100 and 106, respectively, to be in face-to-face contact with ejection plate 1484, and tips 1470 of side panel bullet arms 1462 and 1464 fold first bottom side panel 62 about fold line 66 towards ejection plate 1484 to be adjacent to and/or in contact with ejection plate 1484. After bottom panels 62, 96, and 102 are folded a desired or predetermined distance, upper plate 1480 of bottom presser assembly 1408 rotates downward and folds second bottom side panel 68 against bottom panels 62, 96, and/or 102 and/or ejection plate 1484. Upper plate 1480 presses panels 62, 68, 96, and/or 102 against ejection plate 1484 for a predetermined period and/or duration of time to ensure that adhesive bonds panels 62, 68, 96, and/or 102 together. In the illustrated embodiment, side panel bullet arms 1462 and 1464 are retracted as upper plate 1480 is rotated downwards so as to avoid contact between bullet arms 1462 and 1464 and upper plate 1480. In alternative embodiments, upper plate 1480 may have notches or cutouts (not shown) defined therein corresponding to bullet arms 1462 and 1464 such that bullet arms 1462 and 1464 may be held in the second position while upper plate 1480 rotates downward and presses panels 62, 68, 96, and/or 102 against ejection plate 1484.

Figure 42:
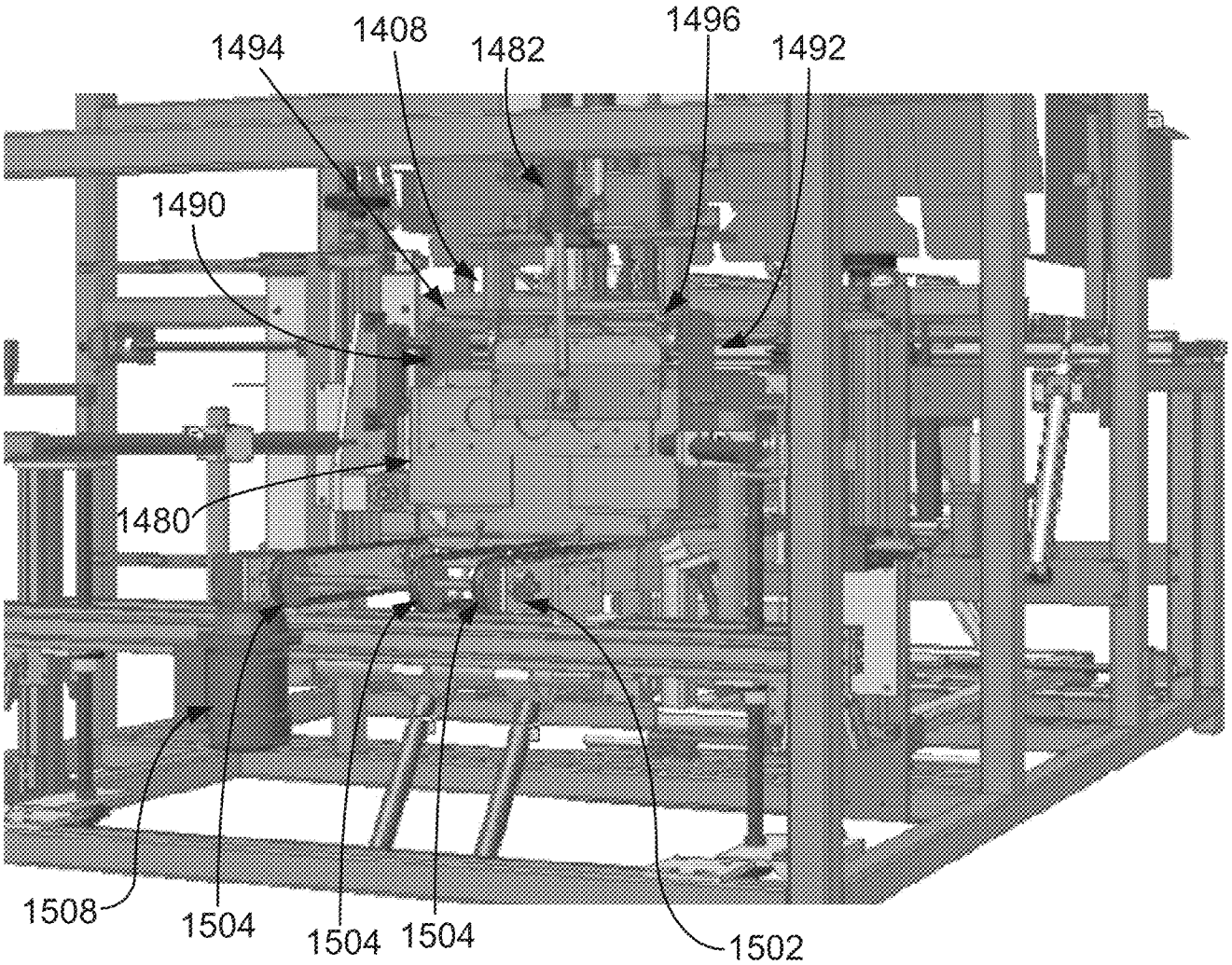
FIG. 42 is a perspective view of the bottom presser assembly and the conveyor assembly shown in FIG. 40.

Referring to FIGS. 42-43, ejection assembly 1410 facilitates removal of formed container 200 from mandrel wrap section 1400 to outfeed section 1500. More specifically, ejection plate 1484 applies a force to bottom wall 222 of container 200 to remove container 200 from mandrel assembly 1600. In the example embodiment, ejection plate 1484 is at a first position within and/or adjacent to second mandrel 1604 during formation of container 200. To remove container 200, ejection plate 1484 is moved to a second position adjacent outfeed section 1500. As ejection plate 1484 is moved, container 200 is moved toward outfeed section 1500. At outfeed section 1500 container 200 is conveyed downstream from machine 1000 for loading and/or top wall formation by conveyor assembly 1502. For example, after container 200 is formed and a product is placed inside container 200, top panels 60, 70, 84, and 104 are closed to form top wall 224 for shipping of the product.

In alternative embodiments, machine 1000, sections 1100, 1200, 1300, 1400, and 1500, and assemblies, subassemblies, and components thereof may be configured to form a container by folding a blank up and around a mandrel assembly, rather than down and around a mandrel assembly. For example, in one particular alternative embodiment, pre-folding assembly 1302 may be positioned beneath mandrel assembly 1600, and configured to fold a blank 20 up and around mandrel assembly 1600. Further, mandrel assembly 1600 may be oriented at 180 degrees with respect to the orientation shown in FIG. 16 such that miter plates 1610 and 1612 are mounted to a bottom of adjustable plates 1606 and 1608. Further, machine 1000 may include additional guide rails positioned beneath mandrel assembly 1600 configured to have a blank 20 placed thereon and slid along the guide rails in the container forming direction X. Such guide rails may have a construction and/or a configuration substantially similar to mandrel guide rails 1634, 1636, 1638, and/or 1640. Further, in such an embodiment, mandrel retention assembly 1402 may be positioned below mandrel assembly 1600, and plate-over tool 1412 may be configured to be raised, rather than lowered, to secure a blank against second mandrel 1604 while the blank is wrapped around second mandrel 1604 to form a container. Further, wrapping assembly 1404 may be positioned above mandrel assembly 1600, and folding arm 1424 of fold-under assembly 1416 may be configured to rotate downwards, rather than upwards, to fold a portion of a blank around mandrel assembly 1600. Further, bottom presser assembly 1408 may be positioned below mandrel assembly 1600, and upper plate 1480 (better described as a lower plate in such an embodiment) may be configured to rotate upwards towards ejection plate 1484 to press panels 62, 68, 96, and/or 102 against ejection plate 1484 to form a bottom wall of a container. Further, in such an embodiment, blanks 20 may be loaded into magazine feed section 1100 in a substantially horizontal orientation, substantially similar to the orientation of blank 20 when placed on first mandrel 1602 by vacuum transfer section 1200 (shown in FIG. 15). Blanks 20 may be fed directly into pre-fold section 1300 by magazine feed section 1100 by sliding a blank 20 along the additional guide rails (not shown) positioned beneath mandrel assembly 1600 using magazine drives 1102 and 1104. Thus, in such an embodiment, vacuum transfer section 1200 may be omitted from machine 1000. Further, in such an embodiment, pre-fold section 1300 may include a stopper substantially similar to stopper 1488 configured to stop a blank 20 within pre-fold section 1300.

Figure 44:
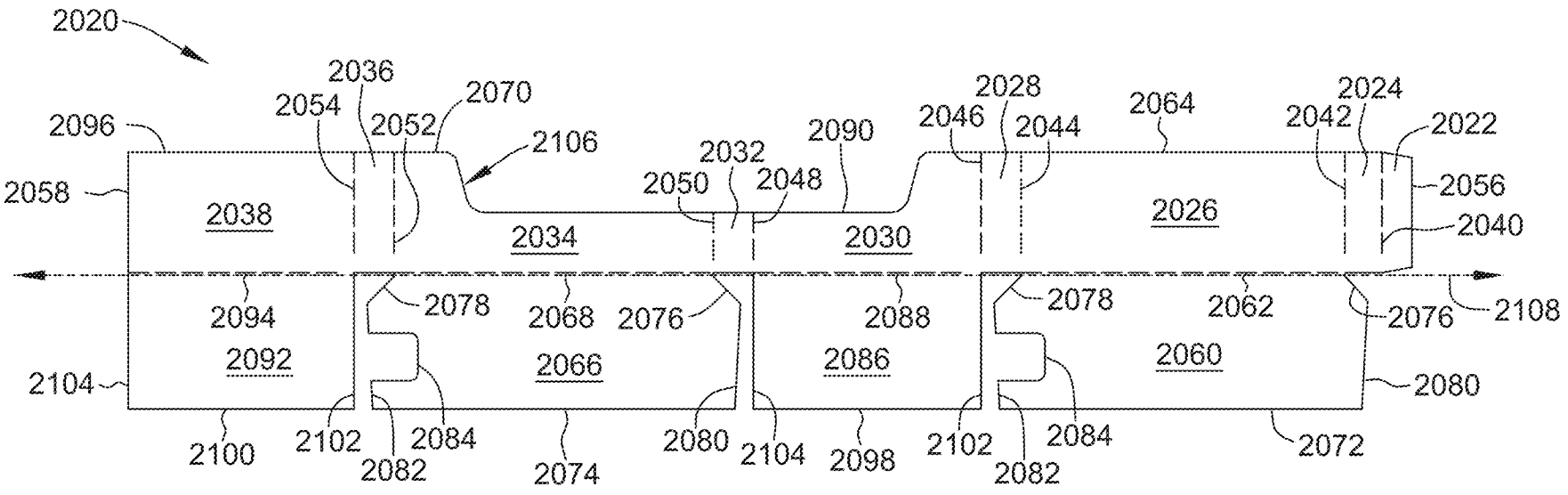
FIG. 44 is an interior view of a tray blank that may be used with the machine described herein.

Referring to FIG. 44, a blank of sheet material for forming a tray is indicated generally at 2020. As explained below in more detail, tray blank 2020 is coupled to another blank (a lid blank 2420, shown in FIG. 46) to form a blank assembly (such as blank assembly 2920, shown in FIG. 52) that is used to form a different embodiment of container 200 (shown in FIGS. 2-5), namely a RRP container (such as container 2800, shown in FIGS. 49-51). As shown in FIG. 44, tray blank 2020 includes a series of aligned wall panels and end panels connected together by a plurality of preformed, generally parallel, fold lines. Specifically, the wall panels include a tray glue panel 2022, a first tray corner panel 2024, a first tray side panel 2026, a second tray corner panel 2028, a first tray end panel 2030, a third tray corner panel 2032, a second tray side panel 2034, a fourth tray corner panel 2036, and a second tray end panel 2038 connected in series along a plurality of fold lines 2040, 2042, 2044, 2046, 2048, 2050, 2052, and 2054. Tray glue panel 2022 extends from a first free edge 2056 to fold line 2040, first tray corner panel 2024 extends from tray glue panel 2022 along fold line 2040, first tray side panel 2026 extends from first tray corner panel 2024 along fold line 2042, second tray corner panel 2028 extends from first tray side panel 2026 along fold line 2044, first tray end panel 2030 extends from second tray corner panel 2028 along fold line 2046, third tray corner panel 2032 extends from first tray end panel 2030 along fold line 2048, second tray side panel 2034 extends from third tray corner panel 2032 along fold line 2050, fourth tray corner panel 2036 extends from second tray side panel 2034 along fold line 2052, and second tray end panel 2038 extends from fourth tray corner panel 2036 along fold line 2054 to a second free edge 2058.

A first tray bottom side panel 2060 extends from first tray side panel 2026 along a preformed fold line 2062 that is generally parallel to an opposing free edge 2064 of first tray side panel 2026. Similarly, a second tray bottom side panel 2066 extends from second tray side panel 2034 along a preformed fold line 2068 that is generally parallel to an opposing free edge 2070 of second tray side panel 2034. Fold lines 2062 and 2068 are generally parallel to each other and generally perpendicular to fold lines 2042, 2044, 2050, and 2052.

First tray bottom side panel 2060 and second tray bottom side panel 2066 each include a free edge 2072 and 2074, respectively. Tray bottom side panels 2060 and 2066 each include opposing first angled edge portions 2076 and 2078 that are each obliquely angled with respect to respective fold lines 2062 and/or 2068. Further, tray bottom side panels 2060 and 2066 each include opposing second angled edge portions 2080 and 2082 extending from first angled edge portions 2076 and 2078 at an oblique angle. Second angled edge portions 2080 and 2082 are also obliquely angled with respect to respective fold lines 2062 and 2068. First tray bottom side panel 2060 and second tray bottom side panel 2066 each include a notch 2084 extending inwardly into a respective tray bottom side panel 2060 or 2066 from second angled edge portion 2082.

A first tray bottom end panel 2086 extends from first tray end panel 2030 along a preformed fold line 2088 that is parallel to an opposing free edge 2090 of first tray end panel 2030. Similarly, a second tray bottom end panel 2092 extends from second tray end panel 2038 along a preformed fold line 2094 that is parallel to an opposing free edge 2096 of second tray end panel 2038. Fold lines 2088 and 2094 are generally parallel to each other and generally perpendicular to fold lines 2046, 2048, 2054, and 2058.

First tray bottom end panel 2086 and second tray bottom end panel 2092 each include a free edge 2098 and 2100, respectively. Tray bottom end panels 2086 and 2092 each include opposing side edge portions 2102 and 2104 that are each substantially parallel to respective fold lines 2046, 2048, 2054, and 2058.

A viewing window 2106 (broadly, a notch) extends inwardly into tray blank 2020 from free edges 2070 and 2090 of second tray side panel 2034 and first tray end panel 2030, respectively. Viewing window 2106 extends across first tray end panel 2030, third tray corner panel 2032, and second tray side panel 2034 in a direction parallel to a central horizontal axis 2108 of tray blank 2020.

Figure 45:
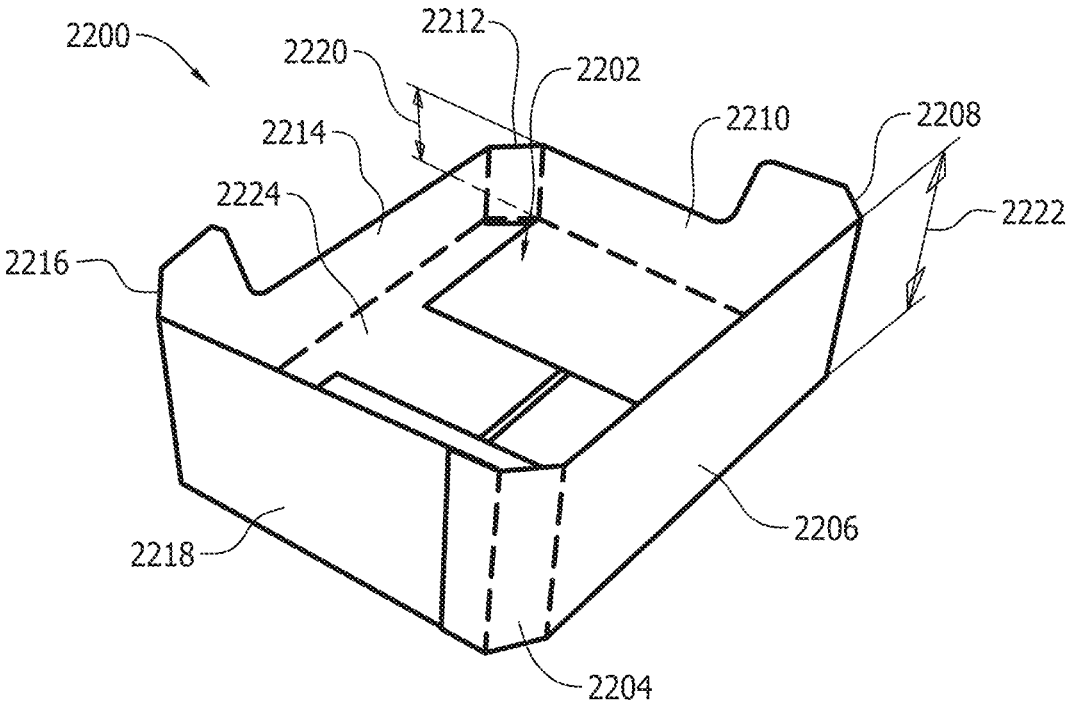
FIG. 45 is a perspective view of an example embodiment of a tray that may be formed from the tray blank shown in FIG. 44.

The shape, size, and arrangement of tray bottom side panels 2060 and 2066 as shown in FIG. 44 and described above facilitates forming an octagonal tray 2200 having angled corners, an example of which is shown in FIG. 45. More specifically, the shape, size, and arrangement of tray bottom side panels 2060 and 2066 facilitates forming tray 2200 having tray corner walls that are obliquely angled with respect to, and interconnect tray side walls and tray end walls of formed tray 2200. Further, the shape, shape, size, and arrangement of tray panels 2030, 2032, and 2034 as shown in FIG. 44 and described above facilitates forming an octagonal tray 2200 with a viewing window to enable viewing of products contained within tray 2200.

FIG. 45 illustrates a perspective view of an example tray 2200 in an erected configuration that may be formed from tray blank 2020 (shown in FIG. 44). Tray 2200 includes a plurality of walls defining a cavity 2202. More specifically, tray 2200 includes a first tray corner wall 2204, a first tray side wall 2206, a second tray corner wall 2208, a first tray end wall 2210, a third tray corner wall 2212, a second tray side wall 2214, a fourth tray corner wall 2216, and a second tray end wall 2218. First tray end wall 2210, third tray corner wall 2212, and second tray side wall 2214 each have a height 2220 that is smaller than a height 2222 of walls 2204, 2206, 2208, 2216, and/or 2218 to facilitate viewing of products contained within tray 2200. In the example embodiment, first tray corner wall 2204 connects first tray side wall 2206 to second tray end wall 2218, second tray corner wall 2208 connects first tray side wall 2206 to first tray end wall 2210, third tray corner wall 2212 connects first tray end wall 2210 to second tray side wall 2214, and fourth tray corner wall 2216 connects second tray side wall 2214 to second tray end wall 2218. Further, tray bottom panels 2060, 2066, 2086, and 2092 form a bottom wall 2224 of tray 2200. Although tray 2200 may have other orientations without departing from the scope of the present disclosure, in the embodiment shown in FIG. 45, tray end walls 2210 and 2218 are substantially parallel to each other, tray side walls 2206 and 2214 are substantially parallel to each other, first tray corner wall 2204 and third tray corner wall 2212 are substantially parallel to each other, and second tray corner wall 2208 and fourth tray corner wall 2216 are substantially parallel to each other. Tray corner walls 2204, 2208, 2212, and 2216 are obliquely angled with respect to tray walls 2206, 2210, 2214, and 2218 they interconnect to form angled corners of tray 2200.

Figure 46:
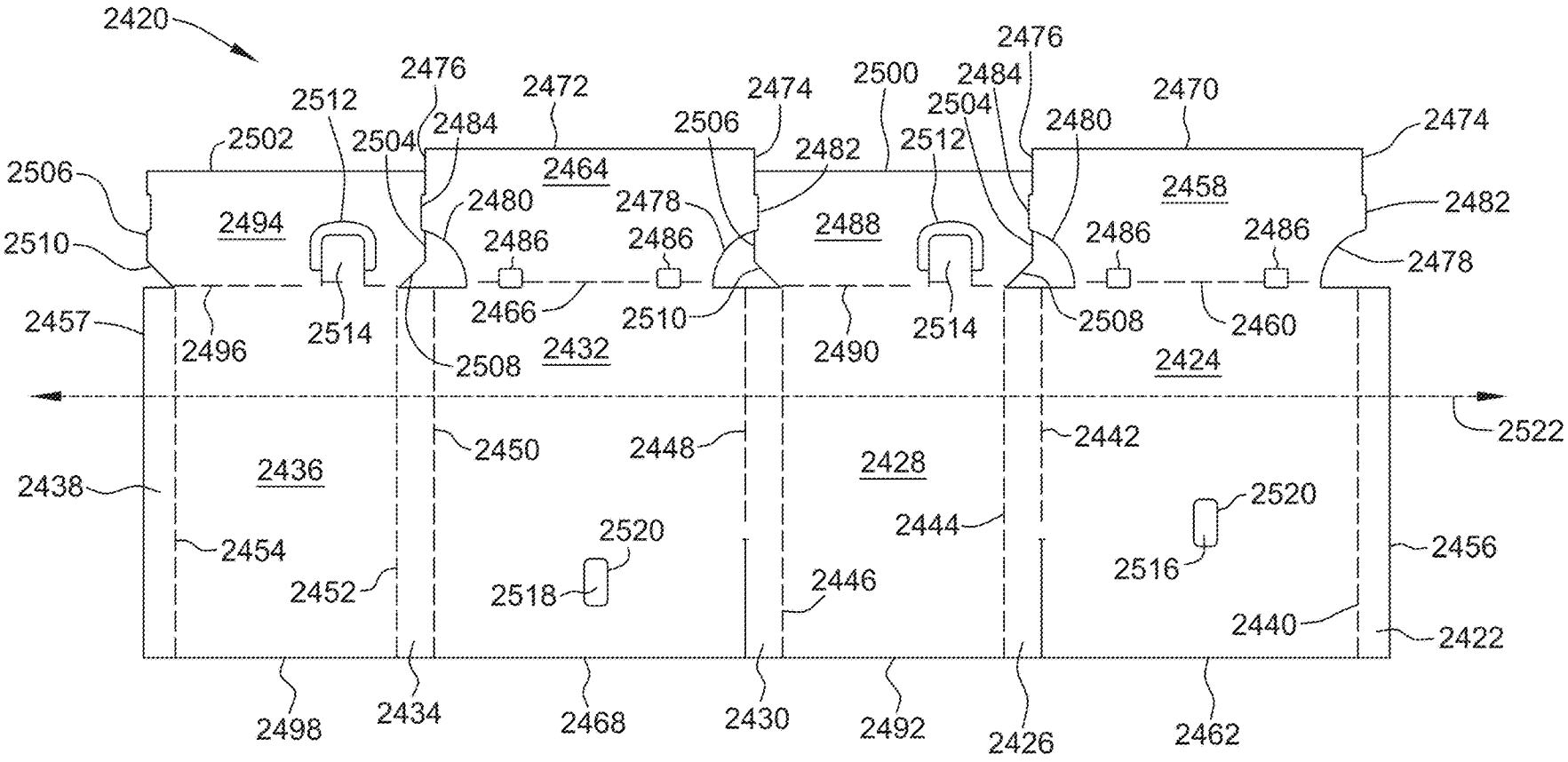
FIG. 46 is an interior view of a lid blank that may be used with the machine described herein.

FIG. 46 is an interior view of a blank 2420 of sheet material for forming a lid 2600 (shown in FIGS. 47 and 48) that is releasably attachable to tray 2200 (shown in FIG. 45). Lid blank 2420 includes a series of aligned wall panels and end panels connected together by a plurality of preformed, generally parallel, fold lines. Specifically, the wall panels include a first lid corner panel 2422, a first lid side panel 2424, a second lid corner panel 2426, a first lid end panel 2428, a third lid corner panel 2430, a second lid side panel 2432, a fourth lid corner panel 2434, a second lid end panel 2436, and a lid glue panel 2438 connected in series along a plurality of fold lines 2440, 2442, 2444, 2446, 2448, 2450, 2452, and 2454. First lid corner panel 2422 extends from a first free edge 2456 to fold line 2440, first lid side panel 2424 extends from first lid corner panel 2422 along fold line 2440, second lid corner panel 2426 extends from first lid side panel 2424 along fold line 2442, first lid end panel 2428 extends from second lid corner panel 2426 along fold line 2444, third lid corner panel 2430 extends from first lid end panel 2428 along fold line 2446, second lid side panel 2432 extends from third lid corner panel 2430 along fold line 2448, fourth lid corner panel 2434 extends from second lid side panel 2432 along fold line 2450, second lid end panel 2436 extends from fourth lid corner panel 2434 along fold line 2452, and lid glue panel 2438 extends from second lid end panel 2436 along fold line 2454 to a second free edge 2457.

A first lid top side panel 2458 extends from first lid side panel 2424 along a preformed fold line 2460 that is generally parallel to an opposing free edge 2462 of first lid side panel 2424. Similarly, a second lid top side panel 2464 extends from second lid side panel 2432 along a preformed fold line 2466 that is generally parallel to an opposing free edge 2468 of second lid side panel 2432. Fold lines 2460 and 2466 are generally parallel to each other and generally perpendicular to fold lines 2440, 2442, 2448, and 2450.

First lid top side panel 2458 and second lid top side panel 2464 each include a free edge 2470 and 2472, respectively. Lid top side panels 2458 and 2464 each include opposing side edge portions 2474 and 2476 that are each substantially parallel to respective fold lines 2440, 2442, 2448, and 2450. Further, lid top side panels 2458 and 2464 each include opposing arc portions 2478 and 2480 extending from respective fold lines 2460 and 2466 to a respective side edge portion 2474 or 2476. Further, lid top side panels 2458 and 2464 each include tabs 2482 and 2484 extending outward from side edge portions 2474 and 2476, respectively. Further, first lid top side panel 2458 and second lid top side panel 2464 each include cutouts 2486 extending along fold lines 2460 and 2466.

A first lid top end panel 2488 extends from first lid end panel 2428 along a preformed fold line 2490 that is parallel to an opposing free edge 2492 of first lid end panel 2428. Similarly, a second lid top end panel 2494 extends from second lid end panel 2436 along a preformed fold line 2496 that is parallel to an opposing free edge 2498 of second lid end panel 2436. Fold lines 2490 and 2496 are generally parallel to each other and generally perpendicular to fold lines 2444, 2446, 2452, and 2454.

First lid top end panel 2488 and second lid top end panel 2494 each include a free edge 2500 and 2502, respectively. Lid top end panels 2488 and 2494 each include opposing side edge portions 2504 and 2506 that are each substantially parallel to respective fold lines 2444, 2446, 2452, and 2454. Further, first lid top end panel 2488 and second lid top end panel 2494 each include opposing angled edge portions 2508 and 2510 that are each obliquely angled with respect to respective fold lines 2444, 2446, 2452, and 2454. Lid top end panels 2488 and 2494 also include cutouts 2512 and flaps 2514 extending from fold lines 2490 or 2496 into cutouts 2512.

Further, first lid side panel 2424 and second lid side panel 2432 each include a tear-away tab 2516 and 2518, respectively. Tear-away tabs 2516 and 2518 are detachably connected to first lid side panel 2424 and second lid side panel 2432, respectively, by perforation lines 2520. Tear-away tabs 2516 and 2518 are offset from one another in a direction transverse to a central horizontal axis 2522 of lid blank 2420 by a distance substantially equal to the difference between height 2220 of lid walls 2210, 2212, and 2214, and height 2222 of lid walls 2204, 2206, 2208, 2216, and 2218.

Figure 47:
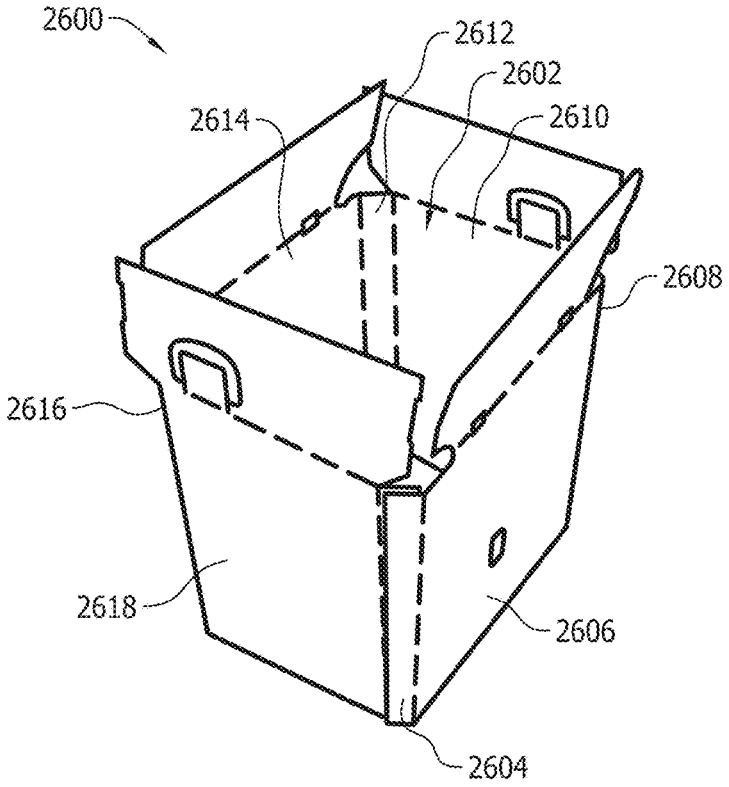
FIG. 47 is a perspective view of an example embodiment of a lid that may be formed from the lid blank shown in FIG. 46.
Figure 48:
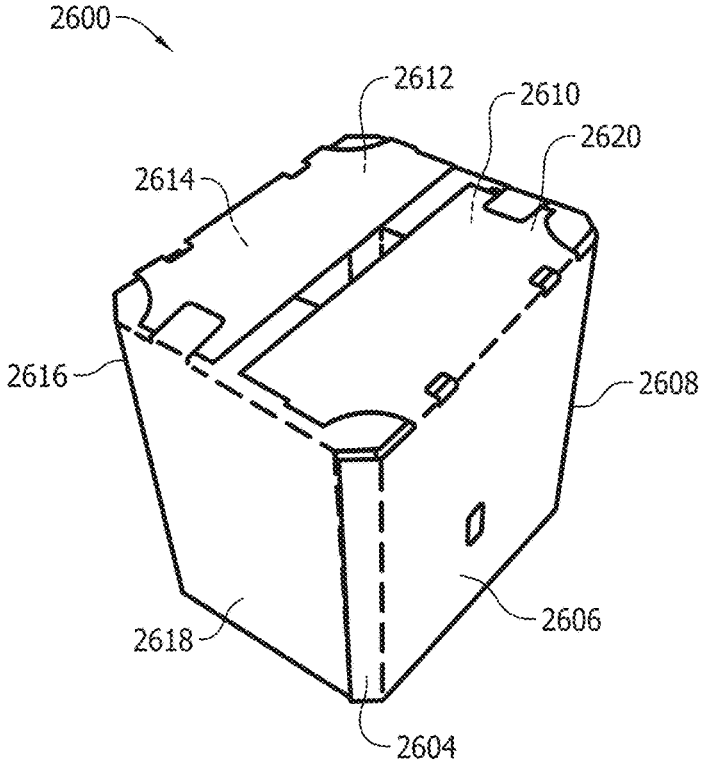
FIG. 48 is a perspective view of the lid shown in FIG. 47 in a closed state.

FIG. 47 illustrates a perspective view of an example lid 2600 in an erected, open configuration that may be formed from lid blank 2420 (shown in FIG. 46). FIG. 48 illustrates a perspective view of lid 2600 in a closed configuration. Lid 2600 includes a plurality of walls defining a cavity 2602. More specifically, lid 2600 includes a first lid corner wall 2604, a first lid side wall 2606, a second lid corner wall 2608, a first lid end wall 2610, a third lid corner wall 2612, a second lid side wall 2614, a fourth lid corner wall 2616, and a second lid end wall 2618. In the example embodiment, first lid corner wall 2604 connects first lid side wall 2606 to second lid end wall 2618, second lid corner wall 2608 connects first lid side wall 2606 to first lid end wall 2610, third lid corner wall 2612 connects first lid end wall 2610 to second lid side wall 2614, and fourth lid corner wall 2616 connects second lid side wall 2614 to second lid end wall 2618. Further, lid top panels 2458, 2464, 2488, and 2494 form a top wall 2620 of lid 2600. Although lid 2600 may have other orientations without departing from the scope of the present disclosure, in the embodiments shown in FIGS. 47 and 48, lid end walls 2610 and 2618 are substantially parallel to each other, lid side walls 2606 and 2614 are substantially parallel to each other, first lid corner wall 2604 and third lid corner wall 2612 are substantially parallel to each other, and second lid corner wall 2608 and fourth lid corner wall 2616 are substantially parallel to each other. Lid corner walls 2604, 2608, 2612, and 2616 are obliquely angled with respect to lid walls 2606, 2610, 2614, and 2618 they interconnect to form angled corners of lid 2600.

Figure 49:
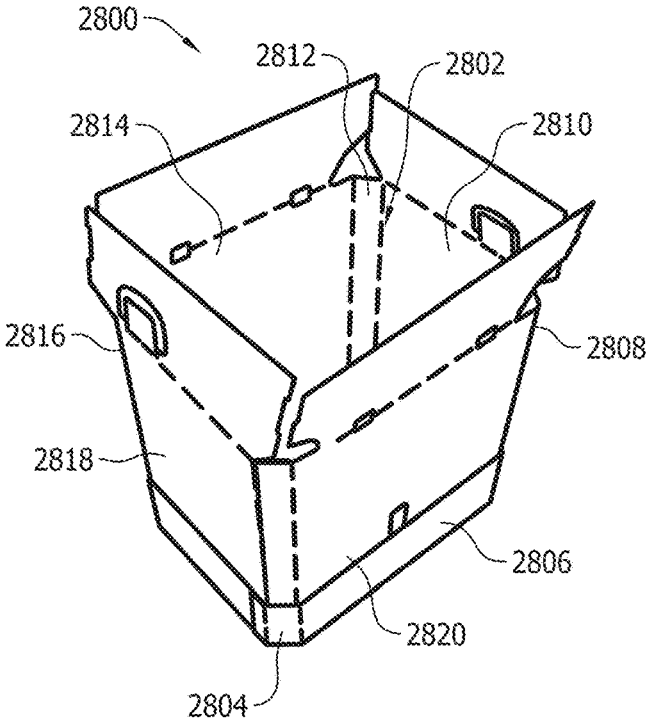
FIG. 49 is a perspective view of an example embodiment of a container that may be formed from the blanks shown in FIGS. 44 and 45.
Figure 50:
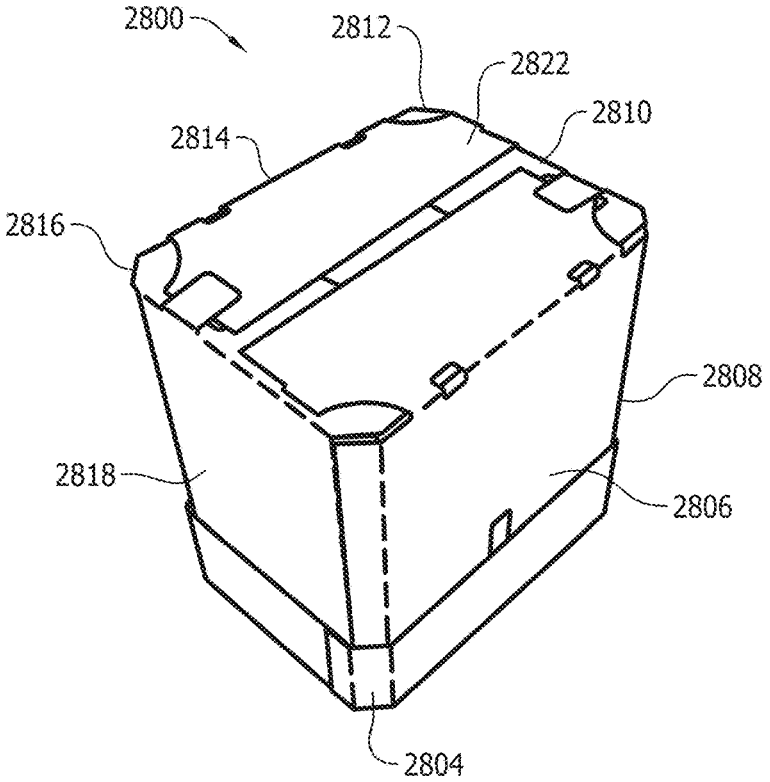
FIG. 50 is a perspective view of the container shown in FIG. 49 in a closed state.
Figure 51:
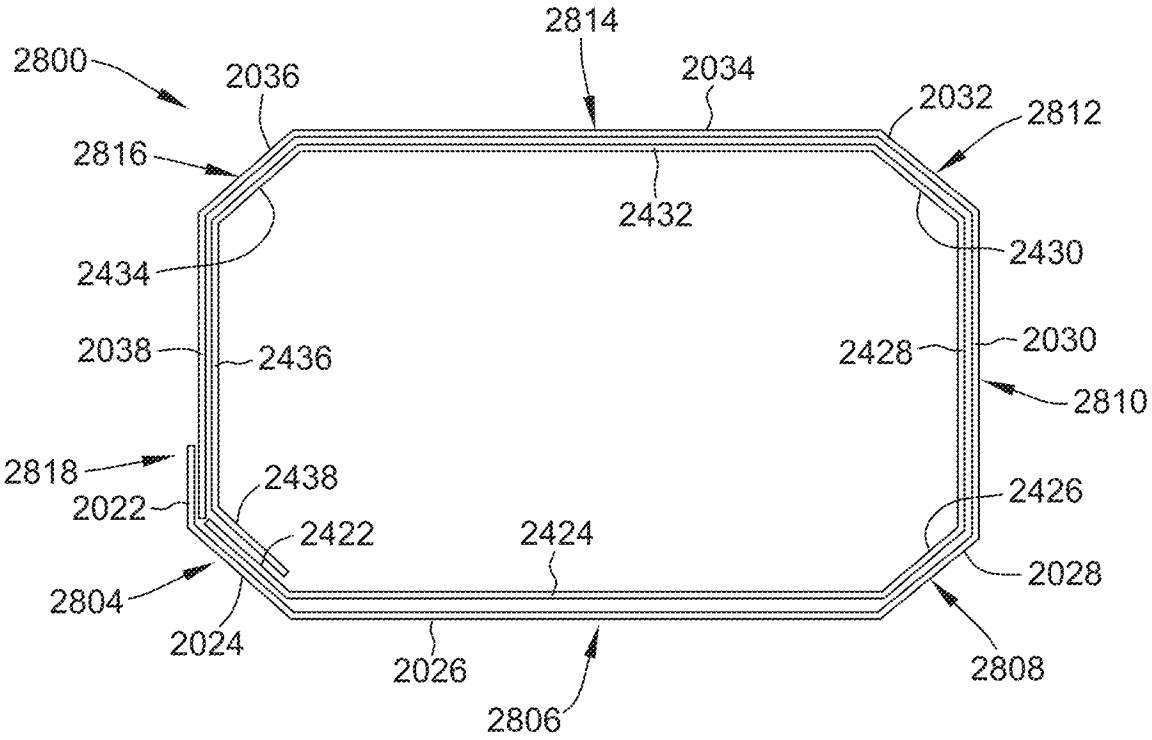
FIG. 51 is an overhead cross-sectional view of the container shown in FIG. 49.

FIG. 49 illustrates a perspective view of a container 2800 in an erected, open configuration, that may be formed from tray blank 2020 and lid blank 2420. FIG. 50 illustrates a perspective view of container 2800 in a closed configuration. FIG. 51 illustrates an overhead cross-sectional view of container 2800. Referring to FIGS. 49-51, in the example embodiment, container 2800 includes a plurality of walls defining a cavity 2802. More specifically, container 2800 includes a first corner wall 2804, a first side wall 2806, a second corner wall 2808, a first end wall 2810, a third corner wall 2812, a second side wall 2814, a fourth corner wall 2816, and a second end wall 2818. First corner wall 2804 includes first tray corner panel 2024, first lid corner panel 2422, and lid glue panel 2438; first side wall 2806 includes first tray side panel 2026 and first lid side panel 2424; second corner wall 2808 includes second tray corner panel 2028 and second lid corner panel 2426; first end wall 2810 includes first tray end panel 2030 and first lid end panel 2428; third corner wall 2812 includes third tray corner panel 2032 and third lid corner panel 2430; second side wall 2814 includes second tray side panel 2034 and second lid corner panel 2426; fourth corner wall 2816 includes fourth tray corner panel 2036 and fourth lid corner panel 2434; and second end wall 2818 includes second tray end panel 2038, second lid end panel 2436, and tray glue panel 2022.

In the example embodiment, first corner wall 2804 connects first side wall 2806 to second end wall 2818, second corner wall 2808 connects first side wall 2806 to first end wall 2810, third corner wall 2812 connects first end wall 2810 to second side wall 2814, and fourth corner wall 2816 connects second side wall 2814 to second end wall 2818. Further, tray bottom wall 2224 forms a bottom wall 2820 of container 2800, and lid top wall 2620 forms a top wall 2822 of container 2800. Although container 2800 may have other orientations without departing from the scope of the present disclosure, in the embodiments shown in FIGS. 49-51, end walls 2810 and 2818 are substantially parallel to each other, side walls 2806 and 2814 are substantially parallel to each other, first corner wall 2804 and third corner wall 2812 are substantially parallel to each other, and second corner wall 2808 and fourth corner wall 2816 are substantially parallel to each other. Corner walls 2804, 2806, 2808, and 2810 are obliquely angled with respect to walls 2806, 2810, 2814, and 2818 they interconnect to form angled corners of container 2800.

Tray bottom panels 2060, 2066, 2086, and 2092 are each orientated generally perpendicular to walls 2804, 2806, 2808, 2810, 2812, 2814, 2816, and 2818 to form bottom wall 2820. More specifically, tray bottom end panels 2086 and 2092 are folded beneath/inside of tray bottom side panels 2060 and 2066. Similarly, in a fully closed position (shown in FIG. 50), lid top panels 2458, 2464, 2488, and 2494 are each orientated generally perpendicular to walls 2804, 2806, 2808, 2810, 2812, 2814, 2816, and 2818 to form top wall 2822. Although container 2800 may be secured together using any suitable fastener at any suitable location on container 2800 without departing from the scope of the present disclosure, in one embodiment, adhesive (not shown) is applied to an outer surface of second tray end panel 2038 and/or an inner surface of tray glue panel 2022 to form second tray end wall 2218, and to an outer surface of tray glue panel 2022 and/or an inner surface of first lid corner panel 2422 to form first lid corner wall 2604. Further, adhesive may also be applied to an exterior surface of tear-away tabs 2516 and 2518 and/or an interior surface of first tray side panel 2026 and/or second tray side panel 2034 to form first side wall 2806 and second side wall 2814. In one embodiment, adhesive may also be applied to exterior surfaces of tray bottom end panels 2086 and/or 2092 and/or interior surfaces of tray bottom side panels 2060 and/or 2066 to secure tray bottom side panels 2060 and/or 2066 to tray bottom end panels 2086 and/or 2092 to form bottom wall 2820.

Although panels 2022, 2024, 2028, 2030, 2032, 2036, and 2038 of tray blank 2020 and panels 2422, 2426, 2428, 2430, 2434, 2436 and 2438 of lid blank 2420 are described herein using terms such as "end," "corner," and "glue," panels 2022, 2024, 2028, 2030, 2032, 2036, 2038, 2422, 2426, 2428, 2430, 2434, 2436 and 2438 of tray blank 2020 and lid blank 2420 may broadly be referred to as "side panels". Similarly, walls 2204, 2208, 2210, 2212, 2216, and 2218 of tray 2400, walls 2604, 2608, 2610, 2612, 2616, and 2618 of lid 2600, and walls 2804, 2808, 2810, 2812, 2816, and 2818 of container 2800 may broadly be referred to as "side walls".

As will be described below in more detail with reference to FIGS. 53-58, tray blank 2020 and lid blank 2420 are intended to form a container 2800 as shown in FIGS. 49-51. More specifically, in the example embodiment, tray blank 2020 and lid blank 2420 are adhered to one another prior to folding and/or securing together the panels of tray blank 2020 and lid blank 2420. That is, tray blank 2020 and lid blank 2420 are pre-glued to one another prior to folding and/or securing together the panels of tray blank 2020 and lid blank 2420. Container 2800 is subsequently formed by folding and/or securing the panels of tray blank 2020 and lid blank 2420 (shown in FIGS. 44 and 46).

Figure 52:
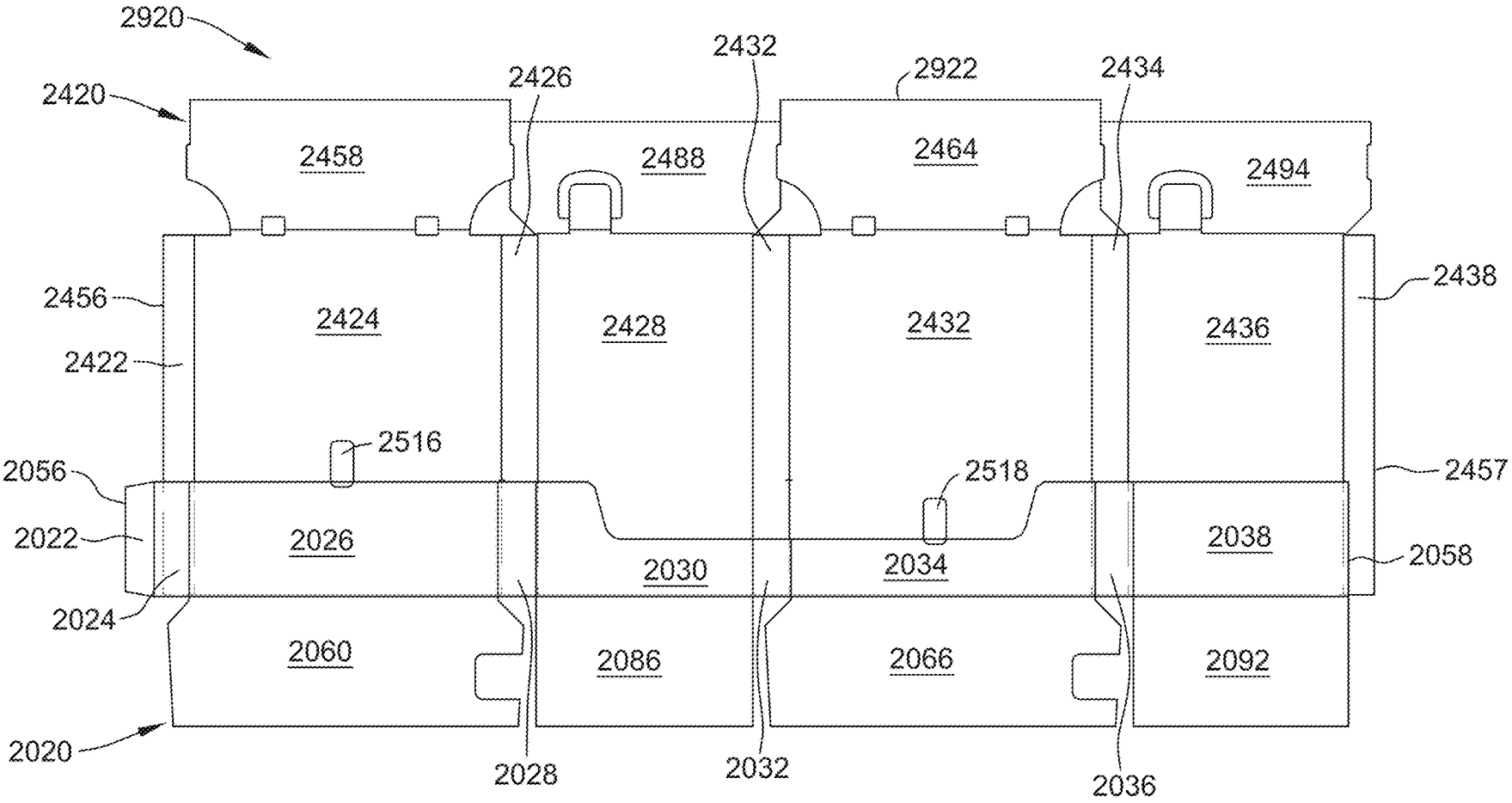
FIG. 52 is an exterior view of a blank assembly formed from the blanks shown in FIGS. 44 and 45.

FIG. 52 illustrates an exterior view of a blank assembly 2920 formed by attaching tray blank 2020 to lid blank 2420. As shown in FIG. 52, blank assembly 2920 is formed by placing an interior surface of tray blank 2020 in a face-to-face relationship with an exterior surface of lid blank 2420, and selectively adhering tray blank 2020 to lid blank 2420. More specifically, first tray corner panel 2024 is placed in an overlapping and face-to-face relationship with first lid corner panel 2422, first tray side panel 2026 is placed in an overlapping and face-to-face relationship with first lid side panel 2424, second tray corner panel 2028 is placed in an overlapping and face-to-face relationship with second lid corner panel 2426, first tray end panel 2030 is placed in an overlapping and face-to-face relationship with first lid end panel 2428, third tray corner panel 2032 is placed in an overlapping and face-to-face relationship with third lid corner panel 2430, second tray side panel 2034 is placed in an overlapping and face-to-face relationship with second lid side panel 2432, fourth tray corner panel 2036 is placed in an overlapping and face-to-face relationship with fourth lid corner panel 2434, and second tray end panel 2038 is placed in an overlapping and face-to-face relationship with second lid end panel 2436. Tray blank 2020 and lid blank 2420 are attached to one another by applying adhesive to an exterior surface of tear-away tabs 2516 and/or 2518, and/or applying adhesive to an interior surface of first tray side panel 2026 and/or second tray side panel 2034, and pressing tray side panels 2026 and 2034 together with respective tear-away tabs 2516 and 2518. Thus, when container 2800 is formed, lid 2600 is releasably coupled to tray 2200, and may be removed from tray 2200 by breaking away tear-away tabs 2516 and 2518 from lid 2600 and/or tray 2200. In the example embodiment, tray blank 2020 and lid blank 2420 are not adhered to one another along any other surface.

Figure 53:
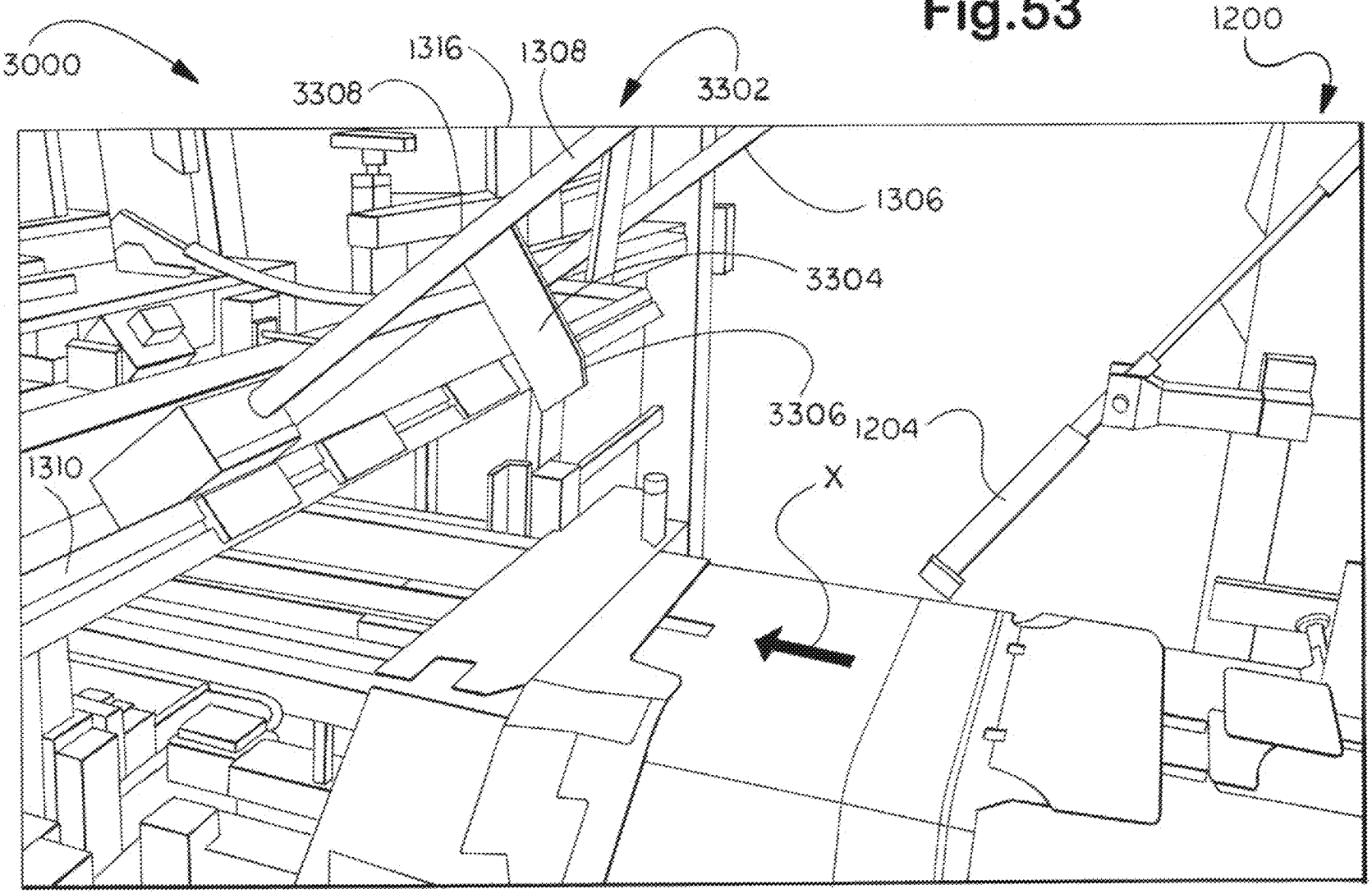
FIG. 53 is a perspective view of an alternate machine that may be used to form a container from the blank assembly shown in FIG. 52.
Figure 54:
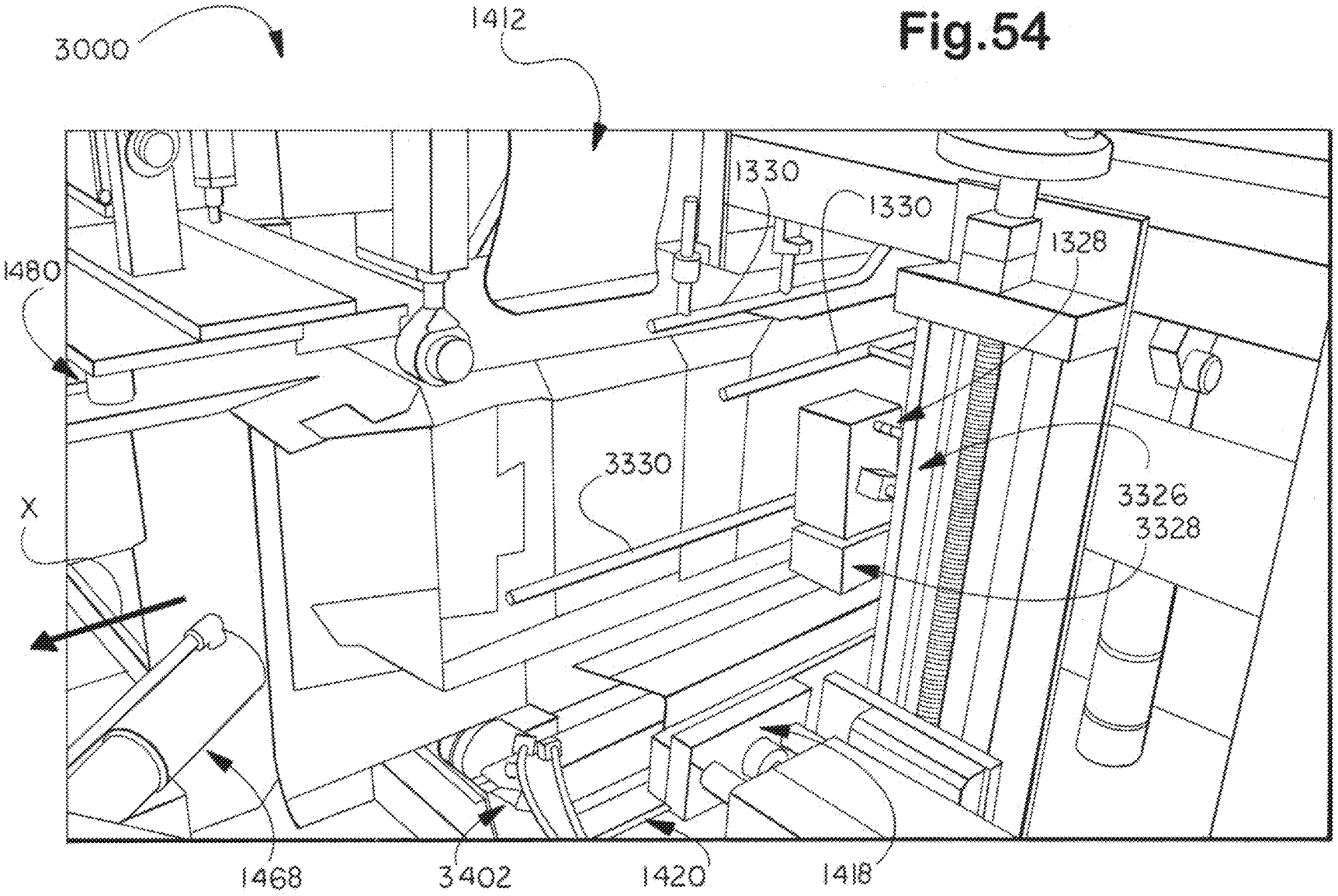
FIG. 54 is another perspective view of the machine shown in FIG. 53.
Figure 55:
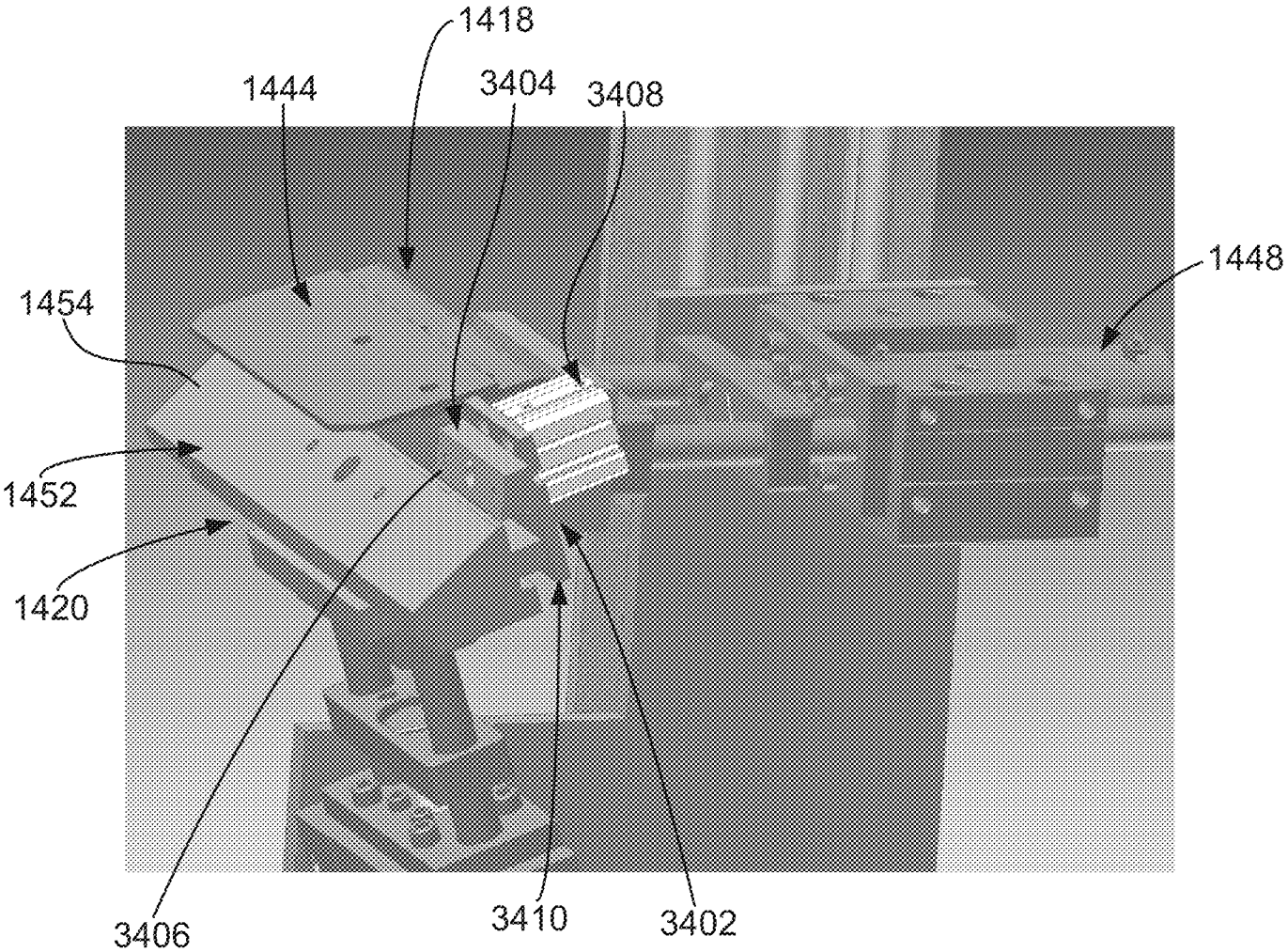
FIG. 55 is a perspective view of an example tray glue panel presser assembly and the glue panel folder assembly and the glue panel presser assembly shown in FIG. 33.
Figure 56:
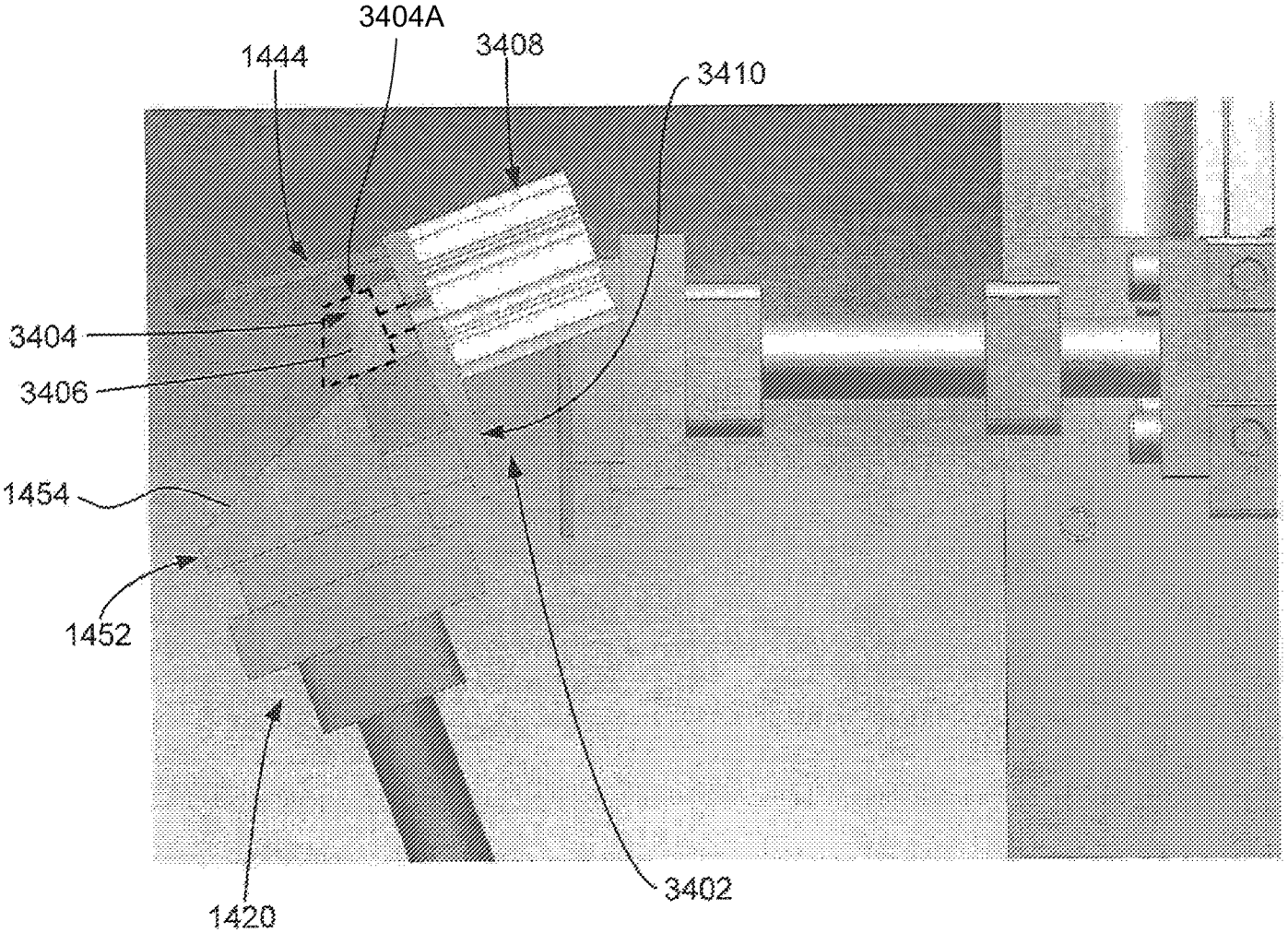
FIG. 56 is a side plan view of the glue panel folder assembly, the glue panel presser assembly, and the tray glue panel presser assembly shown in FIG. 55.
Figure 57:
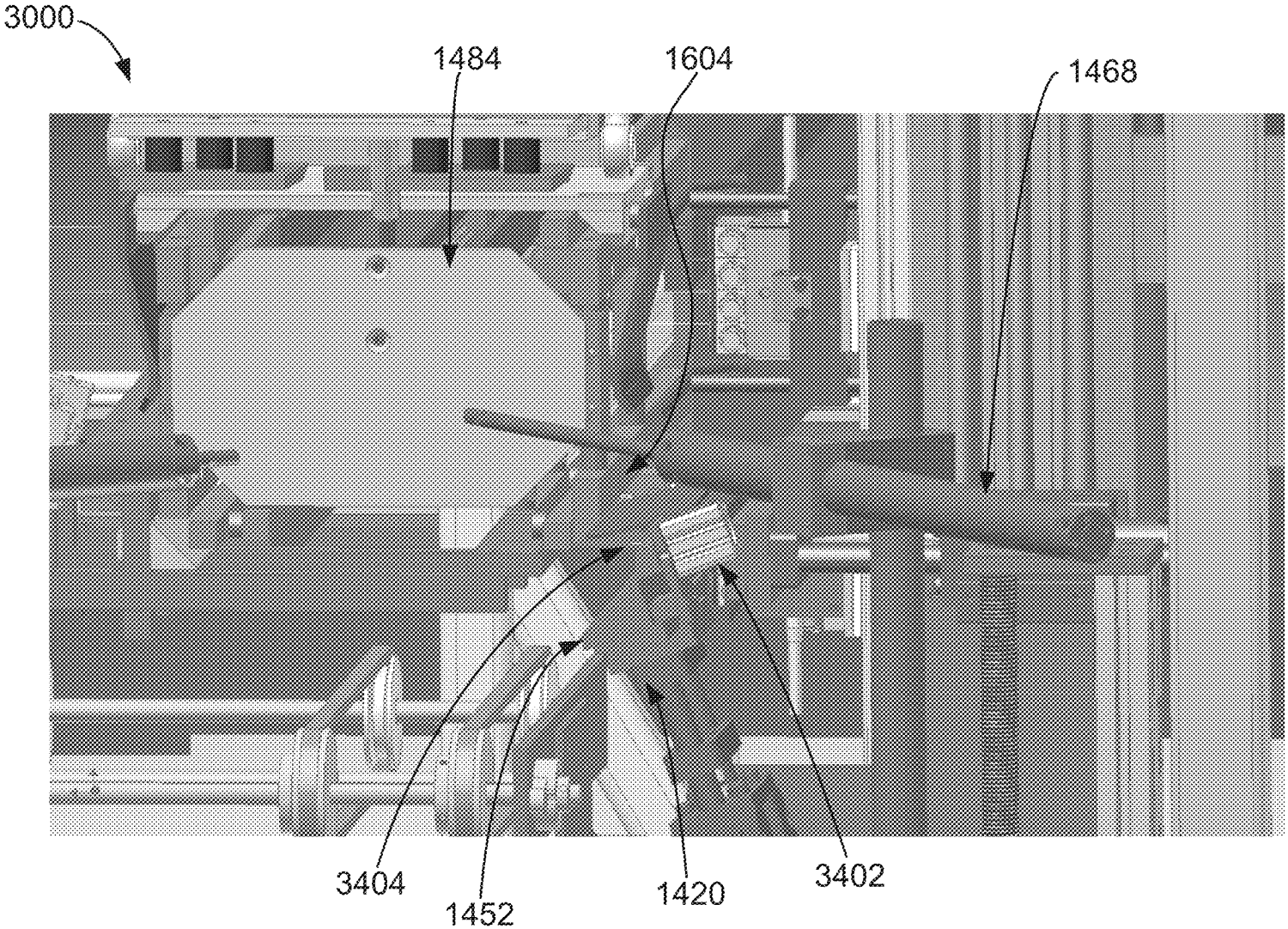
FIG. 57 is a perspective view of the glue panel folder assembly, the glue panel presser assembly, and the tray glue panel presser assembly shown in FIG. 55 within the machine shown in FIG. 53.

FIGS. 53 and 54 are perspective views of an alternate machine 3000 for forming a container, such as container 2800 (shown in FIGS. 49-51) from two or more blanks of sheet material, such as tray blank 2020 and lid blank 2420 (shown in FIGS. 44 and 46). Machine 3000 is substantially similar to machine 1000, and, as such, similar components are labeled with similar references. More specifically, machine 3000 is substantially similar to machine 1000, except machine 3000 includes a tray panel folder 3304 (shown in FIG. 53), a tray glue panel presser assembly 3402 (shown in FIGS. 54-56), an additional adhesive applicator 3328 (shown in FIG. 54), and an extended adhesive applicator guide rail 3330 (shown in FIG. 54).

Referring to FIG. 53, mandrel pre-fold section 3300 of machine 3000 includes a pre-folding assembly 3302 substantially similar to pre-folding assembly 1302 of machine 1000, except pre-folding assembly 3302 includes a tray panel folder 3304 coupled to one of folding fingers 1306 and/or 1308. Tray panel folder 3304 is configured to fold one or more panels of tray blank 2020 around first mandrel 1602 when pre-folding assembly 3302 moves from the first, raised position (shown in FIG. 53) to the second, lowered position (not shown). Further, tray panel folder 3304 is configured to maintain alignment of one or more panels of tray blank 2020 and/or lid blank 2420 as blank assembly 2920 is transferred from mandrel pre-fold section 3300 to mandrel wrap section 3400. More specifically, tray panel folder 3304 extends from folding finger 1306 and/or 1308 toward first mandrel 1602, and has a plate-like configuration with an outwardly flared portion 3306 at an end distal from the folding finger 1306 and/or 1308 to which tray panel folder 3304 is coupled. In the example embodiment, tray panel folder 3304 is coupled to folding finger 1308, and extends toward first mandrel 1602 at an approximately 90 degree angle with respect to folding finger 1308. In alternative embodiments, tray panel folder 3304 may be coupled to folding finger 1306, or both folding fingers 1306 and 1308. Further, tray panel folder 3304 may extend towards first mandrel 1602 at an angle other than approximately 90 degrees with respect to the folding finger to which tray panel folder 3304 is coupled.

Tray panel folder 3304 is adjustably coupled to folding finger 1306 and/or 1308 by a collar 3308. The position of tray panel folder 3304 along folding finger 1306 and/or 1308 may be adjusted, for example, by loosening collar 3308, selectively sliding collar to a new location, and tightening collar 3308 around folding finger 1306 and/or 1308.

In operation, folding fingers 1306 and 1308 and tray panel folder 3304 are initially positioned in a first, generally raised position (shown in FIG. 53). After a blank assembly 2920 is placed on first mandrel 1602 in the configuration shown in FIG. 52, folding fingers 1306 and 1308 and tray panel folder 3304 are rotated towards blank assembly 2920. Folding fingers 1306 and 1308 engage an upward-facing surface of a corresponding panel of lid blank 2420, and tray panel folder 3304 engages an upward-facing surface of a corresponding panel of tray blank 2020. Because tray blank 2020 and lid blank 2420 are only attached along tear-away-tabs 2516 and 2518 in the example embodiment, tray end panels 2086 and/or 2092 are not folded around first mandrel 1602 by folding of lid end panels 2428 and 2436. Thus, tray panel folder 3304 facilitates folding of tray end panels 2086 and/or 2092 around first mandrel 1602 and/or second mandrel 1604. Pre-folding assembly 3302, folding fingers 1306 and 1308, and tray panel folder 3304 are held in the second position while the pre-folded blank assembly 2920 is transferred from mandrel pre-fold section 3300 to mandrel wrap section 3400 (described in more detail below) to maintain alignment of blank assembly 2920 as blank assembly 2920 is transferred from mandrel pre-fold section 3300 to mandrel wrap section 3400.

Referring to FIG. 54, the adhesive applicator assembly 3326 of machine 3000 is substantially similar to adhesive applicator assembly 1326, except adhesive applicator assembly 3326 includes an additional adhesive applicator, indicated at 3328, and an elongated adhesive applicator guide rail 3330 configured to maintain alignment of one or more panels of tray blank 2020 or lid blank 2420 when blank assembly 2920 is positioned within mandrel wrap section 3400. Adhesive applicator 3328 is configured to apply adhesive to at least an exterior surface of one or more panels of tray blank 2020. In the example embodiment, adhesive applicator 3328 is configured to apply adhesive to an exterior surface of second tray end panel 2038 as blank assembly 2920 is transferred from first mandrel 1602 to second mandrel 1604.

Referring to FIGS. 54-58, mandrel wrap section 3400 of machine 3000 is substantially similar to mandrel wrap section 1400 of machine 1000, except mandrel wrap section 3400 includes a tray glue panel presser assembly 3402 configured to form a manufacturer joint of tray 2200 and/or container 2800 by folding and/or pressing a glue panel of tray blank 2020, such as tray glue panel 2022, against another panel of tray blank 2020. More specifically, tray glue panel presser assembly 3402 includes a presser plate 3404 having a pressing surface 3406 substantially parallel to side face 1674 of second mandrel 1604 (shown in FIG. 27). Presser plate 3404 is operatively coupled to a linear actuator 3408 that moves presser plate 3404 toward (see phantom outline 3404A) and away from second mandrel 1604. Presser plate 3404 is configured to contact and/or fold tray glue panel 2022 to form tray 2200 and/or container 2800. In the example embodiment, presser plate 3404 is configured to press tray glue panel 2022 and second tray end panel 2038 together against side face 1674 of second mandrel 1604 to form a manufacturer joint at second end wall 2818 of container 2800.

Figure 58:
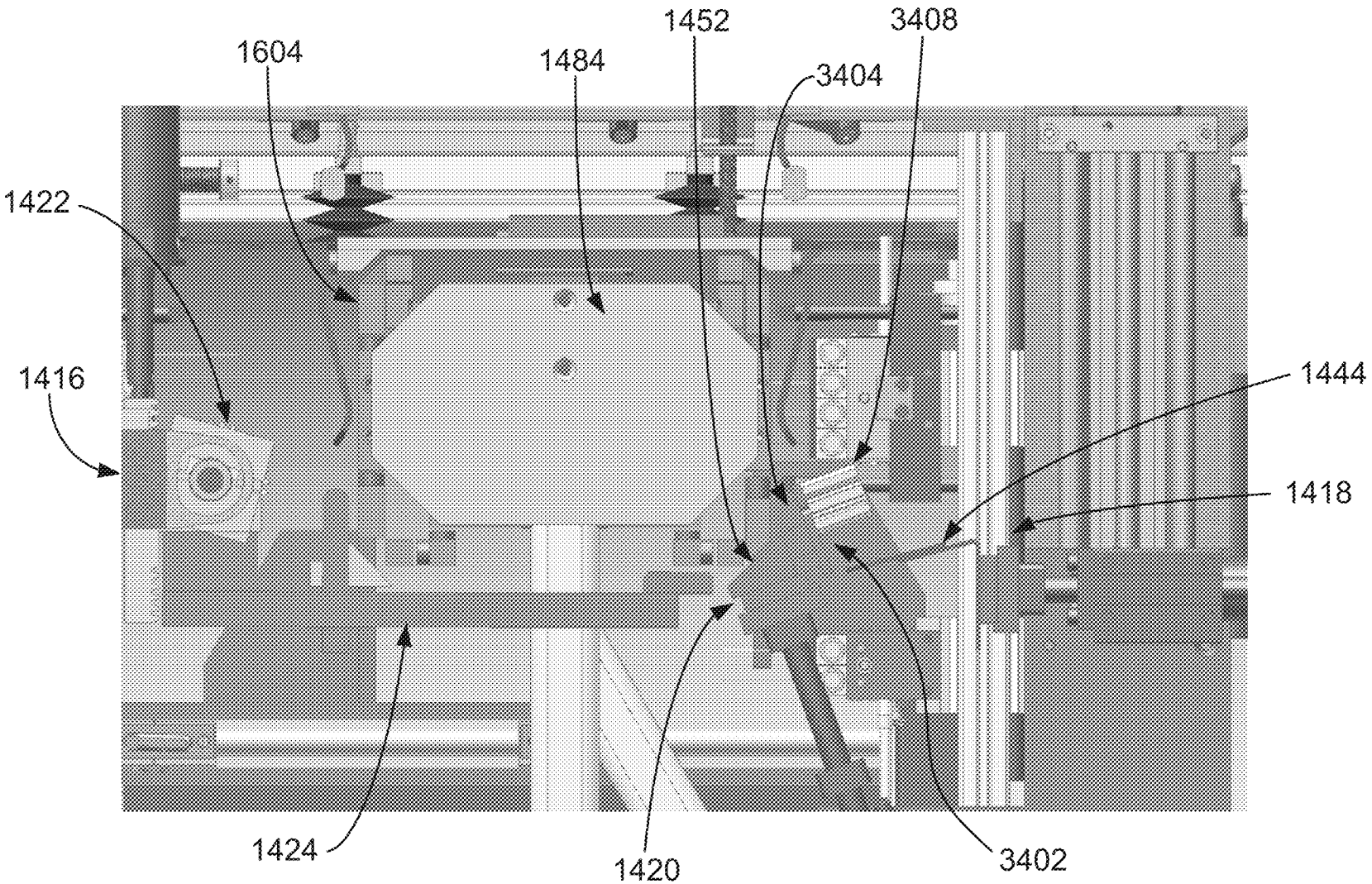
FIG. 58 is another perspective view of the glue panel folder assembly, the glue panel presser assembly, and the tray glue panel presser assembly shown in FIG. 57 within the machine shown in FIG. 53 looking from downstream to upstream on the machine.

In the example embodiment, tray glue panel presser assembly 3402 is included in glue panel presser assembly 1420. More specifically, tray glue panel presser assembly 3402 is mounted on glue panel presser assembly 1420 via mounting plate 3410 such that when presser plate 1452 of glue panel presser assembly 1420 moves from the first position (shown in FIG. 57) to the second position (shown in FIG. 58), tray glue panel presser assembly 3402 is positioned adjacent side face 1658 of second mandrel 1604 as shown in FIG. 58. Also, the length of angled plate 1444 is reduced in machine 3000 to accommodate tray glue panel presser assembly 3402 on glue panel presser assembly 1420. In alternative embodiments, tray glue panel presser assembly 3402 may be mounted on a structure other than glue panel presser assembly 1420, such as frame 1002.

As used herein, the term linear actuator refers to any actuator configured to provide a linear driving force to a member coupled thereto. In the example embodiment, each linear actuator 1112, 1204, 1312, 1320, 1414, 1440, 1448, 1456, 1474, 1476, 1478, 1482, 1486, 1498, and 3408 is a pneumatic cylinder actuated by compressed air. While linear actuators 1112, 1204, 1312, 1320, 1414, 1440, 1448, 1456, 1474, 1476, 1478, 1482, 1486, 1498, and 3408 are described herein with reference to pneumatic cylinders, it is understood that any linear actuator configured to provide a suitable linear driving force may be utilized as one or more of linear actuators 1112, 1204, 1312, 1320, 1414, 1440, 1448, 1456, 1474, 1476, 1478, 1482, 1486, 1498, and/or 3408 such as mechanical actuators, hydraulic actuators, and the like.

In operation, blank assembly 2920 is placed upon, folded around, and transferred along mandrel assembly 1600 in substantially the same manner as blank 20 in machine 1000, except tray panel folder 3304, tray glue panel presser assembly 3402, adhesive applicator 3328, and extended adhesive applicator guide rail 3330 cooperate with one another to form a tray 2200 and/or container 2800. Specifically, blank assembly 2920 is positioned over first mandrel 1602 by pick-and-place assembly 1202, and folding fingers 1306 and 1308 and tray panel folder 3304 are rotated from the first position to the second position to fold blank assembly 2920 around first mandrel 1602. In the example embodiment, folding fingers 1306 and 1308 fold first lid end panel 2428 and second lid end panel 2436 downward to be adjacent to and/or in contact with side faces 1618 and 1620 of miter plates 1610 and 1612 and/or side faces 1626 and 1628 of adjustable plates 1606 and 1608, respectively. Tray panel folder 3304 folds second tray end panel 2038 about fold line 2052 and/or 2054 toward mandrel assembly 1600, specifically, side face 1628 of adjustable plate 1608.

Transfer assembly 1304 facilitates transfer of partially formed container 2800 from mandrel pre-fold section 3300 to mandrel wrap section 3400. More specifically, pusher foot 1322 engages a trailing edge 2922 of blank assembly 2920 (shown in FIG. 52) and pushes blank assembly 2920 toward mandrel wrap section 3400 along mandrel guide rails 1634, 1636, 1638, and/or 1640. As described above, folding fingers 1306 and 1308 and tray panel folder 3304 of pre-folding assembly 3302 are held in the second position to facilitate maintaining the alignment of partially formed container 2800 as it is transferred from mandrel pre-fold section 3300 to mandrel wrap section 3400.

As blank assembly 2920 is transferred from mandrel pre-fold section 3300 to mandrel wrap section 3400, adhesive applicator assembly 3326 applies adhesive to blank assembly 2920 in substantially the same manner as adhesive applicator assembly 1326, except additional adhesive applicator 3328 applies adhesive to an external surface of second tray end panel 2038.

Wrapping assembly 1404 wraps an unfolded portion of blank assembly 2920 around second mandrel 1604 in substantially the same manner as wrapping assembly 1404 wraps blank 20 around second mandrel 1604. Specifically, in the example embodiment, folding arm 1424 is rotated such that engaging bar 1430, squaring bar 1432, and miter bar

1434 wrap a second portion of blank assembly 2920 around second mandrel 1604. More specifically, engaging bar 1430 folds first lid side panel 2424 and/or first tray side panel 2026 towards bottom faces 1668 and 1670 of second mandrel 1604 (shown in FIG. 27) such that first lid side panel 2424 and/or first tray side panel 2026 are in face-to-face contact with bottom faces 1668 and/or 1670 of second mandrel 1604. Squaring bar 1432 and miter bar 1434 position second tray corner panel 2028 and/or second lid corner panel 2426 in face-to-face contact with side face 1666 of second mandrel 1604.

As folding arm 1424 is rotated from the first position to the second position, glue panel folder assembly 1418 is moved towards lid glue panel 2438 to fold lid glue panel 2438 about fold line 2454 toward corner face 1672 of second mandrel 1604. During and/or after folding of lid glue panel 2438 by glue panel folder assembly 1418, glue panel presser assembly 1420 is moved towards first tray corner panel 2024, first lid corner panel 2422, and/or lid glue panel 2438, and presses first lid corner panel 2422 and lid glue panel 2438 together to form a manufacturer joint of lid 2600 and/or container 2800. Presser plate 1452 of glue panel presser assembly 1420 is held against first tray corner panel 2024 and lid panels 2422 and 2438 for a predetermined time period and/or duration to ensure that adhesive bonds lid panels 2422 and 2438 together. Further, while presser plate 1452 is held against first tray corner panel 2024 and lid panels 2422 and 2438, presser plate 3404 of tray glue panel presser assembly 3402 is moved towards tray glue panel 2022 and/or second tray end panel 2038, to fold tray glue panel 2022 about fold line 2040 towards side face 1674 of second mandrel 1604. Presser plate 3404 presses tray glue panel 2022 and second tray end panel 2038 together to form a manufacturer joint of tray 2200 and/or container 2800. Presser plate 3404 of tray glue panel presser assembly 3402 is held against tray glue panel 2022 and second tray end panel 2038 for a predetermined time period and/or duration to ensure that adhesive bonds tray panels 2022 and 2038 together.

Bottom folder assembly 1406 and bottom presser assembly 1408 of machine 3000 form bottom wall 2820 of container 2800 in substantially the same manner as bottom folder assembly 1406 and bottom presser assembly 1408 of machine 1000. Specifically, before and/or during rotation of folding arm 1424 from the first position to the second position, bottom folder assembly 1406 rotates tray bottom panels 2060, 2086, and 2092 about fold lines 2062, 2088, and 2094, respectively, to be in face-to-face contact with ejection plate 1484. Upper plate 1480 of bottom presser assembly 1408 rotates downward and folds second tray bottom side panel 2066 against tray bottom panels 2060, 2086, and/or 2092 and/or ejection plate 1484. Upper plate 1480 presses tray bottom panels 2060, 2066, 2086, and/or 2092 against ejection plate 1484 for a predetermined period and/or duration of time to ensure that adhesive bonds tray bottom panels 2060, 2066, 2086, and/or 2092 together.

Ejection assembly 1410 of machine 3000 facilitates removal of formed container 2800 in substantially the same manner as ejection assembly 1410 of machine 1000.

In contrast to at least some known container forming machines, in the methods and machine described herein, blanks and/or blank assemblies are placed above and/or on top of one or more mandrels during the folding and/or wrapping methods described herein. As a result, the blank ad/or blank assembly may be wrapped around the mandrel without lifting or moving the blank and/or blank assembly out of the plane in which it is initially placed on the mandrel. Thus, no complex lift mechanisms are needed to form a container from the blank and/or blank assembly using the methods and machine described herein. Further, in the methods and machines described herein, blanks and blank assemblies are pre-folded around a first mandrel and subsequently wrapped around a second mandrel downstream from the first mandrel. Because the container is formed at multiple mandrels, simple linear actuators, as opposed to complex servomechanisms and control systems, may be utilized to form containers from blanks. As a result, the overall footprint and cost of the machine may be reduced as compared to known container forming machines.

Example embodiments of containers formed from blanks and a machine for making the same are described above in detail. The container, blanks, and machine are not limited to the specific embodiments described herein, but rather, components of the blanks, containers, and/or machine may be utilized independently and separately from other components and/or steps described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a container from a blank assembly using a machine, the blank assembly including a tray blank coupled to a lid blank, the tray blank defining a tray portion of the container, the lid blank defining a lid portion of the container that is separable from the tray portion of the container, the machine including a mandrel assembly having a first mandrel and a second mandrel positioned downstream from the first mandrel, the method comprising:

folding, using a pre-folding assembly, a first portion of the blank assembly about, and in face-to-face contact with, at least a first face of the first mandrel to form a partially formed container;

transferring, using a transfer assembly, the partially formed container from the first mandrel to the second mandrel along a pair of guide rails extending between the first mandrel and the second mandrel;

wrapping a second portion of the blank assembly about, and in face-to-face contact with, at least a first face of the second mandrel to form the container, wherein the first face of the second mandrel opposes the first face of the first mandrel with respect to a vertical direction; and ejecting the container from the second mandrel.

2. The method of claim 1, wherein folding the first portion of the blank assembly further comprises:

rotating a pre-folding assembly from a first position to a second position, the pre-folding assembly including folding rods and a tray panel folder, wherein the folding rods are configured to contact and rotate lid side panels about the first mandrel, and the tray panel folder is configured to contact and rotate a tray side panel about the first mandrel; and holding the folding rods and the tray panel folder in the second position while the partially formed container is transferred from the first mandrel to the second mandrel to maintain alignment of the partially formed container.

3. The method of claim 1, wherein folding the first portion of the blank assembly further comprises:

folding at least a first lid side panel of the lid blank and an opposing second lid side panel of the lid blank into face-to-face contact with opposing side faces of the first mandrel; and folding at least a first tray side panel into face-to-face contact with the first lid side panel.

4. The method of claim 3, wherein wrapping a second portion of the blank assembly further comprises folding a third lid side panel of the lid blank into face-to-face contact with the first face of the second mandrel.

5. The method of claim 1, wherein transferring the partially formed container further comprises using a pusher foot that extends through the first face of the first mandrel to transfer the partially formed container along the pair of guide rails from the first mandrel to the second mandrel.

6. The method of claim 1, further comprising applying adhesive to the partially formed container as the partially formed container is transferred from the first mandrel to the second mandrel.

7. The method of claim 6, wherein applying adhesive to the partially formed container further comprises applying the adhesive using adhesive applicators arranged in a substantially horizontal orientation.

8. The method of claim 1, wherein wrapping the second portion of the blank assembly about the first face of the second mandrel further comprises engaging the first portion of the blank assembly against an opposing second face of the second mandrel during said wrapping.

9. The method of claim 8, wherein engaging the first portion of the blank assembly comprises lowering a plate-over tool into engagement with the blank assembly.

10. The method of claim 1, wherein transferring the partially formed container from the first mandrel to the second mandrel comprises transferring the partially formed container in a blank transfer direction into engagement with a stopper that impedes further motion of the partially formed container in the blank transfer direction.

11. The method of claim 10, wherein ejecting the container from the second mandrel comprises advancing the container past the stopper, which does not impede motion of the container in the blank transfer direction.

12. The method of claim 1, wherein the blank assembly includes a plurality of panels, wherein folding the first portion of the blank assembly about the first face of the first mandrel comprises folding a first subset of a plurality of panels downward with respect to the vertical direction.

13. The method of claim 12, wherein wrapping the second portion of the blank assembly about the first face of the second mandrel comprises folding a second subset of the plurality of panels upward with respect to the vertical direction.

14. The method of claim 1, further comprising:

folding a third portion of the blank assembly against a second face of the second mandrel to form a bottom surface of the container, wherein the second face of the second mandrel is orthogonal to the first face of the second mandrel.

15. The method of claim 14, wherein folding the third portion of the blank assembly against the second face of the second mandrel comprises rotating a plurality of bottom panels against an ejection plate of the second mandrel, and wherein ejecting the container from the second mandrel comprises advancing the ejection plate in a blank transfer direction to disengage the container from at least the first face of the second mandrel.

16. A method of forming a container from a blank assembly using a machine, the blank assembly including a tray blank coupled to a lid blank, the machine including a mandrel assembly having a first mandrel and a second mandrel positioned downstream from the first mandrel, the method comprising:

folding, using a pre-folding assembly, a first portion of the blank assembly downwardly, in face-to-face contact with, and around the first mandrel to form a partially formed container;

transferring the partially formed container from the first mandrel to the second mandrel;

wrapping a second portion of the blank assembly upwardly, in face-to-face contact with, and around the second mandrel to form the container; and ejecting the container from the second mandrel.

17. The method of claim 16, further comprising applying adhesive to the partially formed container as the partially formed container is transferred from the first mandrel to the second mandrel.

18. The method of claim 17, wherein applying adhesive to the partially formed container further comprises applying the adhesive using adhesive applicators arranged in a substantially horizontal orientation.

19. The method of claim 16, wherein wrapping the second portion of the blank assembly upwardly and around the second mandrel further comprises engaging the first portion of the blank assembly against a top face of the second mandrel during said wrapping.

20. The method of claim 19, wherein engaging the first portion of the blank assembly comprises lowering a plate-over tool into engagement with the blank assembly.

* * * * *